US008469112B1

(12) United States Patent
Silva, Jr. et al.

(10) Patent No.: US 8,469,112 B1
(45) **Date of Patent: *Jun. 25, 2013**

(54) DRY SPRINKLER

(75) Inventors: Manuel R. Silva, Jr., Cranston, RI (US); Thomas E. Archibald, Providence, RI (US); James W. Mears, Warwick, RI (US); Donald B. Pounder, North Kingston, RI (US); Yoram Ringer, Providence, RI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/835,445

(22) Filed: Jul. 13, 2010

Related U.S. Application Data

(63) Continuation of application No. 12/369,716, filed on Feb. 11, 2009, now Pat. No. 7,802,628, which is a continuation of application No. 10/622,631, filed on Jul. 21, 2003, now Pat. No. 7,516,800.

(60) Provisional application No. 60/427,214, filed on Nov. 19, 2002, provisional application No. 60/432,998, filed on Dec. 13, 2002, provisional application No. 60/432,994, filed on Dec. 13, 2002, provisional (Continued)

(51) Int. Cl.
*A62C 37/08* (2006.01)
*A62C 35/00* (2006.01)

(52) U.S. Cl.
USPC ..... 169/37; 169/17

(58) Field of Classification Search
USPC ..... 169/17, 37, 39–42, 56, 57
See application file for complete search history.

(56) References Cited

U.S. PATENT DOCUMENTS 269,930 A 1/1883 Harris
306,662 A 10/1884 Stratton (Continued)

FOREIGN PATENT DOCUMENTS

AU 199865360 9/1998
CA 2462636 8/2005

(Continued)

OTHER PUBLICATIONS

Plaintiff Tyco—Second Amended Complaint, (13 pages) (Oct. 4, 2010).

(Continued)

*Primary Examiner* — Darren W Gorman
(74) *Attorney, Agent, or Firm* — Perkins Coie LLP

(57) ABSTRACT

A dry sprinkler for a fire protection system. The preferred dry sprinkler has a metallic disc annulus positionable within a passageway to skew a central axis of a face of the metallic disc annulus with respect to a longitudinal axis of the dry sprinkler so that an expected minimum flow rate based on a rated discharge coefficient is provided. The dry sprinkler operates to provide an expected flow rate over a range of start pressures. The expected flow rate is based on a K-factor rating. The dry sprinkler provides an acceptable level of fluid flow rate from the expected flow rate based on the K-factor for a range of start pressures.

33 Claims, 50 Drawing Sheets

Related U.S. Application Data application No. 60/432,995, filed on Dec. 13, 2002, provisional application No. 60/432,996, filed on Dec. 13, 2002, provisional application No. 60/443,611, filed on Dec. 16, 2002, provisional application No. 60/432,999, filed on Dec. 13, 2002, provisional application No. 60/433,582, filed on Dec. 16, 2002, provisional application No. 60/432,997, filed on Dec. 13, 2002, provisional application No. 60/432,984, filed on Dec. 13, 2002, provisional application No. 60/432,985, filed on Dec. 13, 2002, provisional application No. 60/432,983, filed on Dec. 13, 2002, provisional application No. 60/432,982, filed on Dec. 13, 2002, provisional application No. 60/433,001, filed on Dec. 13, 2002, provisional application No. 60/433,004, filed on Dec. 13, 2002, provisional application No. 60/433,002, filed on Dec. 13, 2002, provisional application No. 60/433,003, filed on Dec. 13, 2002, provisional application No. 60/433,610, filed on Dec. 16, 2002, provisional application No. 60/433,599, filed on Dec. 16, 2002, provisional application No. 60/433,605, filed on Dec. 16, 2002, provisional application No. 60/433,612, filed on Dec. 16, 2002, provisional application No. 60/433,005, filed on Dec. 13, 2002.

(56) References Cited

U.S. PATENT DOCUMENTS

| | | | | |
|---|---|---|---|---|
| 316,581 | A | | 4/1885 | Stratton |
| 433,477 | A | | 8/1890 | Lapham |
| 514,162 | A | | 2/1894 | Newton |
| 546,087 | A | | 9/1895 | Carpenter |
| 575,121 | A | | 1/1897 | Lapham |
| 640,757 | A | | 1/1900 | Gates et al. |
| 720,013 | A | | 2/1903 | Esty |
| 824,128 | A | | 6/1906 | Martin |
| 1,165,313 | A | | 12/1915 | Bower |
| 1,285,133 | A | | 11/1918 | Gross |
| 1,338,469 | A | | 4/1920 | Waage et al. |
| 1,816,016 | A | | 7/1931 | Knight |
| 1,903,150 | A | | 3/1933 | Tyden |
| 2,135,138 | A | | 11/1938 | Kendall |
| 2,155,990 | A | | 4/1939 | Hodgman, Jr. |
| 2,180,258 | A | | 11/1939 | Rowley |
| 2,211,399 | A | * | 8/1940 | Winslow ..... 169/39 |
| 2,291,813 | A | | 8/1942 | Knight |
| 2,291,818 | A | | 8/1942 | Loepsinger |
| 2,357,227 | A | | 8/1944 | Rowley |
| 2,558,450 | A | | 6/1951 | Martin |
| 2,591,872 | A | | 4/1952 | Rider |
| 2,697,008 | A | | 12/1954 | Rowley |
| 2,724,614 | A | | 11/1955 | Rider |
| 2,732,018 | A | | 1/1956 | Grimes |
| 2,768,696 | A | | 10/1956 | Sherburne |
| 2,862,565 | A | | 12/1958 | Dukes |
| 2,871,953 | A | | 2/1959 | Bray |
| 3,007,528 | A | | 11/1961 | Gloeckler |
| 3,061,015 | A | | 10/1962 | Cann, Jr. |
| 3,067,823 | A | | 12/1962 | Kavanagh |
| 3,080,000 | A | | 3/1963 | Gloeckler |
| 3,135,331 | A | | 6/1964 | Lee |
| 3,195,647 | A | | 7/1965 | Campbell et al. |
| 3,401,751 | A | | 9/1968 | Loftin et al. |
| 3,414,112 | A | | 12/1968 | Ravn |
| 3,525,402 | A | | 8/1970 | Hattori |
| 3,561,537 | A | | 2/1971 | Dix et al. |
| 3,584,689 | A | | 6/1971 | Willms |
| 3,625,289 | A | | 12/1971 | Gloeckler |
| 3,653,444 | A | | 4/1972 | Livingston |
| 3,675,894 | A | | 7/1972 | Friedell |
| 3,682,251 | A | | 8/1972 | Livingston |
| 3,716,103 | A | | 2/1973 | Tanaka et al. |
| 3,722,596 | A | | 3/1973 | Livingston |
| 3,743,022 | A | | 7/1973 | Livingston |
| 3,768,736 | A | | 10/1973 | Cox |
| 3,783,947 | A | | 1/1974 | Dix et al. |
| 3,802,512 | A | | 4/1974 | Todtenkopf |
| 3,812,915 | A | | 5/1974 | Livingston |
| 3,818,994 | A | | 6/1974 | Livingston |
| 3,834,463 | A | | 9/1974 | Allard et al. |
| 3,888,313 | A | | 6/1975 | Freeman |
| 3,896,880 | A | | 7/1975 | Asp |
| 3,904,126 | A | | 9/1975 | Allard |
| 3,924,687 | A | | 12/1975 | Groos |
| 3,927,805 | A | | 12/1975 | Stull |
| 3,970,218 | A | | 7/1976 | Lee |
| 4,007,878 | A | | 2/1977 | Anderson |
| 4,014,388 | A | | 3/1977 | Anderson |
| 4,015,665 | A | | 4/1977 | Simons et al. |
| 4,066,129 | A | | 1/1978 | Anderson |
| 4,079,786 | A | | 3/1978 | Moling |
| 4,091,872 | A | | 5/1978 | Mountford |
| 4,091,873 | A | | 5/1978 | Werner |
| 4,099,675 | A | | 7/1978 | Wohler et al. |
| 4,105,076 | A | | 8/1978 | Simons et al. |
| 4,113,021 | A | | 9/1978 | Werner |
| 4,121,665 | A | | 10/1978 | Woycheese |
| 4,136,740 | A | | 1/1979 | Groos et al. |
| 4,139,062 | A | | 2/1979 | Rago |
| 4,150,811 | A | | 4/1979 | Condit |
| 4,177,862 | A | | 12/1979 | Bray |
| 4,220,208 | A | | 9/1980 | Jackson et al. |
| 4,228,858 | A | | 10/1980 | Sclafani |
| 4,237,982 | A | | 12/1980 | Sclafani |
| 4,258,795 | A | | 3/1981 | Hansen |
| 4,273,195 | A | | 6/1981 | Fischer et al. |
| 4,279,309 | A | | 7/1981 | Fischer et al. |
| 4,280,562 | A | | 7/1981 | Glinecke |
| 4,296,815 | A | | 10/1981 | Mears |
| 4,296,816 | A | | 10/1981 | Fischer |
| 4,403,626 | A | | 9/1983 | Paul, Jr. |
| 4,405,018 | A | | 9/1983 | Fischer |
| 4,417,626 | A | | 11/1983 | Hansen |
| 4,511,003 | A | | 4/1985 | Randall |
| 4,580,729 | A | | 4/1986 | Pounder |
| 4,625,915 | A | | 12/1986 | Cockman |
| 4,630,682 | A | | 12/1986 | Pieczykolan |
| 4,657,085 | A | | 4/1987 | Jacobsen |
| 4,732,216 | A | | 3/1988 | Polan |
| 4,800,961 | A | | 1/1989 | Klein |
| 4,880,063 | A | | 11/1989 | Leininger et al. |
| 4,893,679 | A | | 1/1990 | Martin et al. |
| 4,901,799 | A | | 2/1990 | Pepi et al. |
| 4,930,578 | A | | 6/1990 | Barnett et al. |
| 4,976,320 | A | | 12/1990 | Polan |
| 5,020,601 | A | | 6/1991 | Retzloff et al. |
| 5,022,468 | A | | 6/1991 | Byrne |
| 5,036,923 | A | | 8/1991 | Shea, Sr. |
| 5,094,298 | A | | 3/1992 | Polan |
| 5,143,657 | A | | 9/1992 | Curtis |
| 5,152,344 | A | | 10/1992 | Fischer et al. |
| 5,188,185 | A | | 2/1993 | Mears |
| 5,190,222 | A | | 3/1993 | Haruch |
| 5,195,592 | A | | 3/1993 | Simons |
| 5,228,520 | A | | 7/1993 | Gottschalk |
| 5,257,827 | A | | 11/1993 | Takeuchi et al. |
| D348,719 | S | | 7/1994 | Dolan |
| 5,333,794 | A | | 8/1994 | Haruch |
| 5,366,022 | A | | 11/1994 | Meyer et al. |
| 5,373,989 | A | | 12/1994 | Hattori |
| 5,392,993 | A | | 2/1995 | Fischer |
| 5,415,239 | A | | 5/1995 | Kotter et al. |
| 5,523,682 | A | | 6/1996 | Leon |
| 5,533,576 | A | | 7/1996 | Mears |
| 5,570,713 | A | | 11/1996 | Stoltz et al. |
| 5,579,846 | A | | 12/1996 | Meyer et al. |
| 5,584,344 | A | | 12/1996 | Meyer et al. |
| 5,609,211 | A | | 3/1997 | Meyer et al. |
| 5,628,367 | A | | 5/1997 | Truax et al. |
| 5,664,630 | A | | 9/1997 | Meyer et al. |

| | | | |
|---|---|---|---|
| 5,669,449 | A | 9/1997 | Polan et al. |
| 5,687,914 | A | 11/1997 | Bosio et al. |
| 5,722,599 | A | 3/1998 | Fries |
| 5,753,149 | A | 5/1998 | Shepherd et al. |
| 5,775,431 | A | 7/1998 | Ondracek |
| 5,810,263 | A | 9/1998 | Tramm |
| 5,829,532 | A | 11/1998 | Meyer et al. |
| 5,829,684 | A | 11/1998 | Fishcer |
| 5,839,667 | A | 11/1998 | Fishcer |
| 5,862,994 | A | 1/1999 | Pounder et al. |
| 5,865,256 | A | 2/1999 | Pounder |
| 5,890,657 | A | 4/1999 | Ponte |
| 5,915,479 | A | 6/1999 | Ponte |
| 5,957,392 | A | 9/1999 | Pincus |
| 5,967,240 | A | 10/1999 | Ondracek |
| 6,000,473 | A | 12/1999 | Reilly |
| 6,029,749 | A | 2/2000 | Reilly et al. |
| 6,059,044 | A | 5/2000 | Fischer |
| 6,098,718 | A | 8/2000 | Sato |
| 6,152,236 | A | 11/2000 | Retzloff et al. |
| 6,155,494 | A | 12/2000 | Fabbri et al. |
| 6,158,520 | A | 12/2000 | Reilly et al. |
| 6,216,793 | B1 | 4/2001 | Sundholm |
| 6,246,333 | B1 | 6/2001 | Doner et al. |
| 6,276,460 | B1 | 8/2001 | Pahila |
| 6,367,559 | B1 | 4/2002 | Winebrenner |
| 6,446,732 | B1 | 9/2002 | Polan |
| 6,450,265 | B1 | 9/2002 | Ponte |
| 6,454,017 | B1 | 9/2002 | Fischer et al. |
| 6,502,643 | B1 | 1/2003 | Meyer et al. |
| 6,554,077 | B2 | 4/2003 | Polan |
| 6,851,482 | B2 | 2/2005 | Dolan |
| 6,868,917 | B2 | 3/2005 | Meyer et al. |
| 6,976,543 | B1 | 12/2005 | Fischer |
| 7,036,603 | B2 | 5/2006 | Thomas et al. |
| 7,143,834 | B2 | 12/2006 | Dolan |
| 7,165,624 | B1 | 1/2007 | Fischer |
| 7,275,603 | B2 | 10/2007 | Polan |
| 7,516,800 | B1 | 4/2009 | Silva, Jr. et al. |
| 7,559,376 | B2 | 7/2009 | Silva, Jr. |
| 7,624,812 | B2 | 12/2009 | Pahila |
| 7,730,959 | B2 | 6/2010 | Fischer |
| 7,802,628 | B1 | 9/2010 | Silva, Jr. et al. |
| 7,819,201 | B2 | 10/2010 | Pounder et al. |
| 2002/0050531 | A1 | 5/2002 | Dolan |
| 2003/0075343 | A1 | 4/2003 | Ballard |
| 2005/0121206 | A1 | 6/2005 | Dolan |
| 2005/0173562 | A1 | 8/2005 | Franson et al. |
| 2006/0060361 | A1 | 3/2006 | Pounder et al. |
| 2006/0102362 | A1 | 5/2006 | Polan |
| 2006/0113093 | A1 | 6/2006 | Silva, Jr. |
| 2007/0114047 | A1 | 5/2007 | Fischer |
| 2007/0187116 | A1 | 8/2007 | Jackson et al. |
| 2007/0246232 | A1 | 10/2007 | Pahila |
| 2008/0257564 | A1 | 10/2008 | Cordell et al. |
| 2009/0126950 | A1 | 5/2009 | Rogers |
| 2009/0211772 | A1 | 8/2009 | Silva, Jr. |
| 2009/0294138 | A1 | 12/2009 | Jackson et al. |
| 2010/0032173 | A1 | 2/2010 | Fischer |
| 2010/0071916 | A1 | 3/2010 | Fischer |

FOREIGN PATENT DOCUMENTS

| | | | |
|---|---|---|---|
| CA | 2358744 | | 9/2009 |
| DE | 2508355 | A1 | 9/1976 |
| DE | 2700431 | A1 | 7/1978 |
| DE | G8708851.7 | | 9/1987 |
| DE | 3910287 | A1 | 10/1990 |
| DE | 4103862 | | 8/1992 |
| DE | 4136912 | A1 | 5/1993 |
| DE | 4480591 | T1 | 3/1996 |
| DE | 4480591 | C2 | 11/2000 |
| EP | 0 695 562 | A2 | 2/1996 |
| GB | 765125 | | 1/1957 |
| GB | 1307095 | | 2/1973 |
| GB | 1556217 | | 11/1979 |
| GB | 1570080 | | 6/1980 |
| GB | 2195241 | A | 4/1988 |
| GB | 2206043 | A | 12/1988 |
| GB | 2293337 | A | 3/1996 |
| GB | 2293337 | B | 8/1997 |
| GB | 2336777 | | 11/1999 |
| JP | 49-98198 | | 8/1974 |
| JP | 50-16793 | | 2/1975 |
| JP | 54-143100 | | 10/1979 |
| JP | 3-27259 | | 3/1991 |
| JP | 4-150873 | | 5/1992 |
| JP | 04-329969 | | 11/1992 |
| JP | 11-104262 | | 4/1999 |
| WO | WO 82/00603 | | 3/1982 |
| WO | WO 95/19851 | | 7/1995 |
| WO | WO98/18525 | | 5/1998 |
| WO | WO 98/28042 | | 7/1998 |
| WO | WO 2006/058330 | | 6/2006 |

OTHER PUBLICATIONS

Defendant Reliable—Reliable's Answer, Affirmative Defenses, and Counterclaims in Response to Plaintiffs Second Amended Complaint, (13 pages) (Oct. 29, 2010).

Plaintiff Tyco—Answer to Counterclaims, (3 pages (Nov. 22, 2010).

Defendant Reliable—Reliable's Response to Tyco's First Set of Interrogatories (Nos. 1-4), (8 pages), (Jan. 7, 2011).

Plaintiff Tyco—Plaintiff's List of Terms and Proposed Constructions, (4 pages), (Feb. 8, 2011).

Defendant Reliable—Reliable's Prelimininary List of Claim Terms to be Construed by the Court and Proposed Constructions, (10 pages), (Feb. 8, 2011).

Defendant Reliable—Reliable's Supplemental Response to Tyco's First Set of Interrogatories plus Exhibits A-E, (77 pages), (Mar. 15, 2011).

Plaintiff Tyco—Plaintiff's Memorandum in Support of Its Proposed Claim Construction, (24 pages), (Mar. 17, 2011).

Defendant Reliable—Reliable's Opening Claim Construction Brief, (73 pages), (Mar. 17, 2011).

Defendant Reliable—Reliable's Response to Tyco's Second Set of Interrogatories, (4 pages), (Mar. 30, 2011).

Plaintiff Tyco—Plaintiff's Memorandum in Response to Reliable's Opening Claim Construction Brief, (61 pages), (Apr. 14, 2011).

Defendant Reliable—Reliable's Responsive Claim Construction Brief, (23 pages), (Apr. 14, 2011).

Defendant Reliable—Reliable's Response to Tyco's Third Set of Interrogatories (Nos. 6-8), (8 pages), (May 27, 2011).

Response to Office Action, US 2007/0187116, Mar. 13, 2008, pp. 1-25.

Office Action, US 2007/0187116, Dec. 13, 2007, pp. 1-13.

Grinnell Corporation; Dry Sprinklers, Quick Response, Data Sheet of Model F960; Jun. 1998; 1 sheet.

Grinnell Corporation; Engineering drawings of Model F960 Dry Pendent Bulb Type Sprinkler Yoke; Rev. Jan. 3, 1991; 1 sheet.

Grinnell Corporation; Engineering drawings of Model F960 Dry Pendent Bulb-Type Sprinkler Assembly; Apr. 24, 1991; 1 sheet.

Viking Corp.; Technical Data, "Model M Quick Response Dry Pendent Sprinkler"; Apr. 9, 1998; 4 sheets.

Factory Mutual Research Corporation; "Approval Standard for Automatic Sprinklers for Fire Protection, Class Series 2000" (Sections 4.8 and 4.13); May 1998; 5 pages.

Underwriters Laboratories Inc.; "UL 199 Standard for Automatic Sprinklers for Fire-Protection Service" (Sections 20 and 29); Apr. 8, 1997; 4 pages.

James E. Golinveaux; "A Technical Analysis: The Use and Maintenance of Dry Type Sprinklers" (http://www.tyco-fire.comITFP_common/DrySprinklers.pdf); Jun. 2002; 15 pages.

Victaulic; "Models V3606 and V3605 Dry Type Standard Spray Pendent and Recessed Pendent Standard and Quick Response"; 2002; 4 sheets.

Dry Pendent Drop Sprinkler, Data Sheet AS.159, 2 pages.

Viking Corp, Technical Data, Dry Pendent Sprinklers Model C 4 sheets, Jan. 1987.

Chemetron Fire Systems, Model ME-1 Flush Type Dry Pendent:, 4 sheets.

Engineering drawings of the Dry Pendent Drop Sprinkler described in Data Sheet AS.159, 10 pages.

Total Walther Feuerschutz GmbH, Hängender Trockensprinkler GHTS 15, Dry Pendent Sprinkler anti-gel Kenblatt-Nr. 4-044-03, 2 sheets, Jan. 1989.
Reliable. "Model G3 Dry Sprinkler", 4 sheets, Nov. 1987.
Victaulic. Models V3608 and V3607 Standard Spray Pendent and Recessed Pendent Standard and Quick Response, 4 sheets, Apr. 2001.
Victaulic. Models V3604 and V3603 Dry Type Upright- Standard and Quick Response, 4 sheets, Apr. 2001.
Globe Fire Sprinkler Corporation, "Automatic Sprinklers Model J Bulb Spray Series Dry Type Pendent Recessed Pendent", 8 sheets. Aug. 1990.
Globe Fire Sprinkler Corporation, "Dry Pendent Sprinklers Model F960 Designer. 1/2 Orifice", 4 sheets, Feb. 2001.
Central Sprinkler Corporation, "Dry Pendent Sprinklers Recessed, Flush and Extended Types Model A-1", 2 sheets. 1986.
Preussag Minimax. "Sprinkler-Teile/Parts Trockensprinkler dry sprinkler", 2 sheets, Jan. 1989.
First Sprinkler—Color Photo 01.
First Sprinkler—Color Photo 02.
First Sprinkler—Color Photo 03.
First Sprinkler—Color Photo 04.
First Sprinkler—Color Photo 05.
First Sprinkler—Color Photo 06.
First Sprinkler—Color Photo 07.
First Sprinkler—Color Photo 08.
U.S. Appl. No. 12/833,823, filed Jul. 9, 2010—Co-Pending Related Continuation Application of parents U.S. Appl. No. 12/369,716 (now USP 7,802,628) wich is a Continuation U.S. Appl. No. 10/622,631 (now USP 7,516,800).
USPTO File Wrapper for USP 7,624,812 to Pahila REL00039203-00039526.
USPTO File Wrapper for USP 7,730,959 to Fischer REL00041834-00042755.
Excerpt from "UL 199, Standard for Automatic Sprinklers for Fire-Protection Service," (Apr. 8, 1997), describing 10 Pan Distribution Test, pp. 31-32 REL00042823-REL00042824.
Underwriters Laboratories Inc., UL 1767, "Standard for Safety, Early-Suppression Fast-Response Sprinklers," First Edition, Feb. 1990. REL00042825-REL00042855.
Factory Mutual Engineering Corp., "Loss Prevention Data 2-2, Early Suppression Fast Responses Sprinklers," Apr. 1987 REL00042856-REL00042864.
Factory Mutual Research, "Approval Standard, Early Suppression Fast Responses Automatic Sprinklers," Jun. 1986 REL00042865-REL00042923.
"Automatic" Sprinkler Corporation of America product sheets entitled Automatic ESFR Glass Bulb Sprinkler, Feb. 1988, pp. J 5.3, J 5.4. REL00042924-REL00042925.
ASCOA First Systems data sheets entitled "Automatic ESFR Glass Bulb Sprinkler," Mar. 1992, pp. 1.1, 1.2. REL00042926-REL00042927.
Grinnell Corporation data sheets entitled "Early Suppression Fast Response Sprinklers/Model ESFR-1 Pendent, 14.3 K-Factor," Apr. 1988. REL00042928-REL00042929.
Reliable Automatic Sprinkler product announcement, "ESFR Model H Early Suppression Fast Response Sprinklers," Oct. 1992, 3 pp. total. REL00042930-REL00042932.
Central Sprinkler Company catalog sheets entitled Central ESFR-1 3-93/ESFR Early Suppression Fast Response, Mar. 1993, 4 pps. REL00042933-00042936.
Drawing entitled, "International Jumbo Sprinkler Head-Deflector," DWG No. 1-117, Automatic Sprinkler Co. of America, Mar. 1926, 1 pg. REL00042937.
Sheet entitled, "Grinnell Jumbo Sprinkler Issue A," Grinnell Corp., Feb. 1969, 1 pg. REL00042938.
Drawing entitled "Solder-Type-Issue A 1/14," Grinnell Sprinkler Yoke, Body, Strut, Diaphragm and Disc, General Fire Extinguisher Company, Apr. 1917, 1 pg. REL00042939.
Drawing entitled "1 Grinnell Jumbo Sprinkler Detail Solder Type Issue A," General Fire Extinguisher Co., Apr. 1917, 1 pg. REL00042940.
NJ Thompson, Fire Behavior and Sprinklers, Chapter 6, "Automatic Sprinkler Protection," National Fire Protection Association, 1964, Forward, Table of Contents, pp. 72-91. REL00042941-REL00042953.
Newsletter for Fire Protection Engineers and Industry, No. 11, Jul. 1968, Orinda, California, 8 pp. REL00042954-REL00042961.
D.G. Goodfellow et al., Technical Report entitled "Optimization of Sprinkler Protection for United States Postal Service III. Protection of Plastic Letter Trays," Factory Mutual Research Corp., Oct. 1971, 39 pp. REL00042962-REL00043000.
D.G. Goodfellow et al., Technical Report entitled "Optimization of Sprinkler Protection for United States Facilities/IV Protection of Plastic Letter Trays with 0.64-in. Retrofit Sprinklers," Factory Mutual Research Corporation, Jul. 1974, 30 pp. with cover and introductory pages. REL00043001-REL00043030.
E.W.J. Troup, Technical Report entitled "New Developments in Ceiling-Level Protection for the High-Challenge Fire," Factory Mutual Research Corporation, Jan. 1974. REL00043031-REL00043066.
P.J. Chicarello et al., Technical Report entitled "Large-Scale Fire Test Evaluation of Early Suppression Fast Response (ESFR) Automatic Sprinklers," Factory Mutual Research Corp. May 1986, cover-p. 18, pp. 122-128. REL00043067-REL00043096.
C. Yao, "The Development of the ESFR Sprinkler System," First Safety Journal, Elsevier Scientific Ltd., Kidlington, Oxford, 1988, vol. 14, No. 11, pp. 65-73. REL00043097-REL00043105.
C. Yao, "Overview of FMRC's Sprinkler Technology Research," Factory Mutual Research Corporation, May 1992. REL00043106-REL00043132.
Approved Product News, Factory Mutual Engineering Corp., vol. 4, No. 2, Dec. 1998, pp. 1-5, 8-12, 16. REL00043133-REL00043134.
Fire Protection Handbook, 17th Edition, National Fire Protection Association, 1991, Title page, inner page, Table of Contents, p. IX and pp. 5-127 through 5-163 and 5-174 through 5-197. REL00043135-REL00043186.
K. Bell, "Presentation to American Fire Sprinkler Association-Large K-Factor Sprinklers," Nov. 1992, 59 pp. total; 19 pp. text and 40 pp. slide photocopies REL00043187-REL00043245.
Search Report under Section 17, issued by GB Patent Office for corresponding GB Patent Application No. 9911294.8, dated Aug. 24, 1999. REL00043246.
National Fire Protection Associate, NFPA 13—Standard for the Initiation of Sprinkler System, 1996 edition, pp. 13-1 through 13-148. REL00043247-REL00043294.
National Fire Protection Associate, NFPA 231—Standard for General Storage, 1998 edition, pp. 231-1 through 231-31. REL00043395-REL00043425.
National Fire Protection Associate, NFPA 231C—Standard for Rack Storage of Materials, 1998 edition, pp. 231C-1 through 231C-75. REL00043426-REL00043500.
File History of U.S. Appl. No. 09/292,152, filed Apr. 15, 1999, now U.S. Patent No. 7,165,624, Michael Fischer. REL00043501-REL00044194.
File History of U.S. Appl. No. 09/134,493, filed Aug. 14, 1998, now U.S. Patent No. 6,059,044, Michael Fischer. REL00044195-REL00044410.
File History of U.S. Appl. No. 09/079,789, filed May, 15, 1998, now Abandoned, Michael Fischer. REL00044411-REL00044801.
McCormick, Michael G., Staff Engineering Associate, Letter From Underwriters Laboratories Inc., re: Central K25.2 ESFR Sprinkler 10-Pan Distribution Test, Sep. 5, 2007. (3 pages). REL00044802-REL00044804.
Six color photographs of sprinkler case with "I.S. Co." on deflector and PAT.03 on the body and 1903 stamped on the release link, labeled Jun. 1995, 2 pp.; six color photographs of sprinkler case with "Globe" and 280 on body, G A S Co. on deflector and stamped 1926 on release ink, labeled Jun. 1995, 2 pp.; five color photographs of Grinnell Corporation "Jumbo A Automatic Sprinkler-1 ¼" Orifice, labeled Jun. 1995, 2 pp; five color photographs of Grinnell Corporation, "Jumbo A" automatic sprinkler—1" orifice, labeled Jun. 1995, 2 pp., body painted red. REL00044805-REL00044812.
Sprinkler Photo. REL00044813.

The Reliable Automatic Sprinkler Co., Inc., Datasheet—Model G VELO PEND Specific Application NFPA 231C .6 Density/2,000 Sq. Ft., Bulletin 149A, Oct. 1997, REL00044814-00044815.
The Reliable Automatic Sprinkler Co., Inc., Datasheet—Model G VELO PEND Very Extra Large Orifice Pendent Sprinkler, NFPA 13,231,and 231C, Bulletin 146A, Oct. 1997, REL00044816-REL00044817.
Central Sprinkler Company Data Sheets for "Ultra K25 ESFR Low Pressure Early Suppression Fast Response" (4 pages) (1998). REL00044818-REL00044821.
GEM Sprinkler Company, Datasheet for Early Suppression Fast Response Sprinklers, Model ESFR25™ Pendent, 25.2 K-Factor, 1 inch NPT, Feb. 2000, (4 pages), REL00044822-REL00044825.
GEM Sprinkler Company, Datasheet for Early Suppression Fast Response Sprinklers (FM) & Specific Application ESFR Sprinklers (UL & C-UL), Model ESFR-25™ Pendent, Nov. 1998, (4 pages) REL00044826-REL00044829.
Plaintiff Tyco —Complaint in *Tyco Fire Products LP* (*Plaintiff Tyco*) v. *The Viking Corp.* (6 pages) (Defendant Viking) (Apr. 26, 2007). REL00044830-REL00044835.
Defendant Viking—Answer to Complaint, Affirmative Defenses, Counterclaims and Jury Demand (13 pages) (May 16, 2007). REL00044836-REL00044848.
Plaintiff Tyco—Motion to Strike Affirmative Defenses and Memorandum of Law in Support of Motion to Strike; Reply to Counterclaim of Defendant (14 pages) (Jun. 4, 2007). REL00044849-REL00044862.
Plaintiff Tyco—Motion for Preliminary Injunction; Memorandum of Law in Support; Proposed Order; Declaration of J. Golinveaux (46 pages) (Jun. 13, 2007). REL00044863-REL00044908.
Plaintiff Tyco—Declaration of Donald Pounder in Support of Motion for Preliminary Injunction (37 pages) (Jun. 14, 2007). REL00044909-REL00044945.
Defendant Viking—Motion for Leave to Amend Answer to Complaint, Counterclaims and Jury Demand; Memorandum in Support of Motion; Exhibits A-C (42 pages) (Jun. 21, 2007). REL00044946-REL00044987.
Defendant Viking—Response in Opposition to Plaintiff's Motion to Strike Affirmative Defenses; Proposed Order; Index of Exhibits; Exhibits A-E (95 pages) (Jun. 21, 2007). REL00044988-REL00045082.
Defendant Viking—Response in Opposition to Plaintiff Motion for Preliminary Injunction; Proposed Order; Index of Exhibits; Exhibits A-D, Exhibits F-S (217 pages) (Jul. 16, 2007). REL00045083-REL0045299.
Defendant Viking—Declaration of T. Deegan in Support of Opposition to Plaintiff Motion for Prelim. Injunction, Appendices A1, B1, C1, Exhibits 1-27 (372 pages) (Jul. 17, 2007). REL00045300-REL00045671.
Defendant Viking—Declaration of S. Franson in Support of Opposition to Plaintiff Motion for Preliminary Injunction (7 pages) (Jul. 17, 2007). REL00045672-REL00045678.
Defendant Viking—First Amended Answer to Complaint, Affirmative Defenses, Counterclaims and Jury Demand (14 pages) (Jul. 19, 2007) REL00045679-REL00045692.
Plaintiff Tyco—First Amended Complaint (6 pages) (Jul. 30, 2007). REL00045693- REL00045698.
Stipulation of Voluntary Dismissal of Action (2 pages) (Jan. 8, 2008). REL00045699-REL00045700.
Pacer—Civil Docket for *Tyco Fire Products LP* v. *The Viking Corporation* Case No. 2:07-cv-01683-WY (E.D. Pa) (Aug. 29, 2008). REL00045701-REL00045709.
Sprinkler Photo (VK510 identified as Exhibit C) REL00045784.
Sprinkler Photo (VK503 identified as Exhibit D) REL00045785.
Factory Mutual Research, Preliminary Guidelines, ESFR Sprinklers, Prepared for Participants in the ESFR Program; Jan. 1984 (Identified as Exhibit F). REL00045786-REL00045797.
Transportation and Distribution, "ESFRS: Superior Warehouse Fire Protection", Sep. 1989 (Identified as Exhibit H). REL00045798-REL00045799.
National Engineer, "Early Suppression-Fast Response Sprinklers: A New Level of Industrial Fire Protection", Sep. 1989 (Identified as Exhibit G). REL00045800-REL00045801.
The Viking Corporation; Engineering drawings of Model ESFR 25K Pendent Sprinkler Deflector; Sep. 30, 2002; 1 sheet. REL00045802.
The Viking Corporation; Engineering drawings Deflector, Pendent Sprinkler of Model 17K Dry Pendent Sprinkler; Nov. 29, 2006; 1 sheet. REL00045803.
Gem Sprinkler—Datasheet for Early Suppression Fast Response Sprinklers Model ESFR-1 Pendent, 14.3 K-Factor, Apr. 1988 (2 pages), REL00045804-REL00045805.
Sprinkler Photos, REL00045806-REL00045812.
National Fire Protection Association, NFPA 13 Standard for the Installation of Sprinkler Systems, pp. 13-21 to 13-22, 2 pages, 2002 edition. REL00045813-REL00045815.
Testing Data for Central 1997 K25 ESFR PD—UL 199 Rotating 10 Pan, dated Jul. 12, 2007, 1 page. REL00045816.
National Fire Protection Association, NFPA 13, Special Designs of Storage Protection, 2007 Edition, p. 13-189. REL00045817.
National Fire Protection Association, NFPA 13, Installation of Sprinkler Systems, 2007 Edition, p. 13-186. REL00045818.
Sprinkler Photos, Central 1997 K25 ESFR PD. REL00045819.
Central Sprinkler Company Data Sheets for "Ultra K25 ESFR Low Pressure Early Suppression Fast Response" (4 pages) (1998). REL00045820-REL00045823.
The Viking Corporation—Dry Pendent Sprinklers Model C, Sprinkler 101, Jan. 1987 (4 pages), REL00046079-REL00046082.
Chemetron Fire Systems, Star Model ME-1 Flush Type Dry Pendent REL00046083-REL00046084.
Total Walther Feuerschutz GmbH, Hangender Trockensprinkler GHTS 15, Dry Pendent Sprinkler—Sprinkler Anti-gel, Jan. 17, 1989, 2 pages. REL00046085-REL00046086.
The Reliable Automatic Sprinkler Co., Inc., Datasheet for Model G3 Dry Sprinkler, Bulletin 116D, 4 pages, REL00046087-REL00046090.
Victaulic Company, Datasheet for 40.61, Models V3608 and V3607 Standard Spray Pendent and Recessed Pendent Standard and Quick Response; 3124, Revision A, 2001, 4 pages, REL00046091-REL00046094.
Victaulic Company, Datasheet for 40.63, Models V3604 and V3603 Dry Type Upright; 3126, Revision A, 2001, 4 pages, REL00046095-REL00046098.
Globe Fire Sprinkler Corporation, Datasheet for Automatic Sprinklers Model J Bulb Spray Series Dry Type Pendent Recessed Pendent, Bulletin ASB-DP, Aug. 1990, 2 pages. REL00046099-REL00046102.
Grinnell Corporation, Datasheet for Dry Pendent Sprinklers, Issue C Solder Type, 1/2" Orifice, Jul. 1986. REL00046103-REL00046106.
Grinnell Corporation, Datasheet for Dry Pendent Sprinklers, Model F960 Designer 1/2" Orifice, Jul. 1986. REL00046107-REL00046110.
Central Sprinkler Corporation, Dry Pendent Sprinklers Recessed, Flush and Extended Types Model "A-1", 1986, REL00046111-REL00046112.
Preussag Minimax. "Sprinkler-Teile/Parts Trockensprinkler dry sprinkler", 2 sheets, Jan. 1989. REL00046113-REL00046114.
Dry Pendent Drop Sprinkler, Data Sheet AS.159, 2 pages REL00046115-REL00046116.
Engineering drawings of the Dry Pendent Drop Sprinkler described in Data Sheet AS.159, 10 pages. REL00046117-REL00046126.
First Sprinkler—Color Photo 01; First Sprinkler—Color Photo 02; First Sprinkler—Color Photo 03; First Sprinkler—Color Photo 04; First Sprinkler—Color Photo 05; Second Sprinkler—Color Photo 06; Second Sprinkler—Color Photo 07; Second Sprinkler—Color Photo 08. REL00046127-REL00046134.
Response to Office Action, US 2007/0187116, Mar. 13, 2008, pp. 1-25. REL00046135-REL00046159.
Office Action, US 2007/0187116, Dec. 13, 2007, pp. 1-13. REL00046160-REL00046172.
Grinnell Corporation; Dry Sprinklers, Quick Response, Data Sheet of Model F960; Jun. 1998; 1 sheet. REL00046173.
Grinnell Corporation; Engineering drawings of Model F960 Dry Pendent Bulb Type Sprinkler Yoke; Rev. Jan. 3, 1991; 1 sheet. REL00046174.

Grinnell Corporation; Engineering drawings of Model F960 Dry Pendent Bulb-Type Sprinkler Assembly; Apr. 24, 1991; 1 sheet. REL00046175.
Viking Corp.; Technical Data, "Model M Quick Response Dry Pendent Sprinkler"; Apr. 9, 1998; 4 sheets. REL00046176-REL00046179.
"Approval Standard for Automatic Sprinklers for Fire Protection;" Class Series 2000; May 1998; Factory mutual Corporation; pp. 1-90. REL00046180-REL00046184.
Underwriters Laboratories Inc.; "UL 199 Standard for Automatic Sprinklers for Fire-Protection Service" (Sections 20 and 29); Apr. 8, 1997; 4 pages. REL00046185-REL00046188.
James E. Golinveaux; "A Technical Analysis: The Use and Maintenance of Dry Type Sprinklers" (http://www.tycoFire.comITFP_common/DrySprinklers.pdf); Jun. 2002; 15 pages. REL00046189-REL00046202.
Victaulic; "Models V3606 and V3605 Dry Type Standard Spray Pendent and Recessed Pendent Standard and Quick Response"; 2002; 4 sheets. REL00046203-REL00046206.
"Duraspeed Sprinkler—Rack Storage—Q-17;" Sprinklers, Nozzles and Accessories/Section 4; Grinnell Fire Protection Systems Company, Inc.; Bulletin No. 211; Jan. 1975; 2 pgs. REL00046265-REL00046266.
"Approval Standard for Early Suppression-Fast Response (ESFR) Automatic Sprinklers;" Class No. 2008; Aug. 1996; Factory Mutual Research Corporation; pp. 1-47. REL00046267-REL00046319.
"Installation of Sprinkler Systems;" NFPA 13; 1999 Edition; National Fire Protection Association. REL00046320-REL00046636.
"Approval Standard for Automatic Sprinklers for Fire Protection;" Class Series 2000; May 1998; Factory mutual Corporation; pp. 1-90. REL00046637-REL00046641.
"Application of the Tyco Fire Products;" Sep. 2007, 21 pages, Tyco Fire & Building Products [online] [retrieved Oct. 30, 2007 from the Internet: URL<http://www.tyco-fire.com/TFP_common/EC25_EC17_WhitePaper.pdf>] REL00046642-REL00046663.
Central Sprinkler Company, Datasheet for Central ESFR Early Suppression Fast Response Pendent Automatic Sprinkler—ESFR-1, 1-95, No. 2-13.0 , 4 pages, 1995, REL00047029-REL00047032.
GEM Sprinkler Company Press Release and Announcement, "Gem Sprinkler Company Introduces New 11.2 K-Factor ECLH Pendent and Recessed Pendent Sprinklers", Oct. 7, 2009, 3 pages, REL00047033-REL00047035.
Page dated Nov. 2004 identifying Viking's K-17 Sprinkler and Viking's Extended Coverage, Ordinary Hazard. REL00047036.
USPTO File Wrapper for USP 7,624,812 to PAHILA. REL00047057-REL00047443.
USPTO File Wrapper for USP 5,775,431 to ONDRACEK. REL00047444-REL00047547.
USPTO File Wrapper for USP 5,967,240 to ONDRACEK. REL00047548-REL00047630.
USPTO File Wrapper for USP 6,450,265 to PONTE. REL00047631-REL00047739.
Underwriters Laboratories Inc. Directory, Fire Protection Equipment 1996, REL00047740-REL00047759.
The Reliable Automatic Sprinkler Co., Inc. Datasheet for Model G VELO Pendent Very Extra Large Orifice Sprinkler, Bulletin 146, Rev. E, Oct. 2009, REL00047760-REL00046671.
Viking Corp.; Technical Datasheet, "Model M Quick Response Extra-Large Orifice Sprinkler"; Jul. 16 1998; 3 sheets. REL00047762-REL00047764.
Central Sprinkler Company, Datasheet for Central ELO-231 Storage Upright or Pendent Automatic Sprinkler K-Factor = 11.4, No. 2-9.-0, 1994. REL00047765-REL00047768.
Sprinkler Photos, 1 page REL00047769.
Sprinkler Photos, 3 pages REL00047770-REL00047773.
Sprinkler Photos, 3 pages REL00048267-REL00048269.
Defendant Reliable—Reliable's Supp Response to Tyco's First Set of Interrogatories (Nos. 1-2) plus Supp Invalidity Charts—Exhibits M and N (164 pages), (Aug. 5, 2011).
Defendant Reliable—Reliable's Amended Response to Tyco's First Set of Interrogatories (Nos. 1-4) plus Supp Invalidity Charts—Exhibits M and N (153 pages), (Oct. 5, 2011).
Tyco DS-1 Jul. 2001 Datasheets (TFP500, TFP510, TFP520).
Tyco DS-2 Oct. 2001 Datasheets (TFP530, TFP540).
Defendant Reliable—Prior Art References Produced at REL00039117-REL00039535.
Defendant Reliable—Prior Art References Produced at REL000411194-REL00048269.
Defendant Reliable—Prior Art References Produced at REL00048278-REL00048566.

* cited by examiner

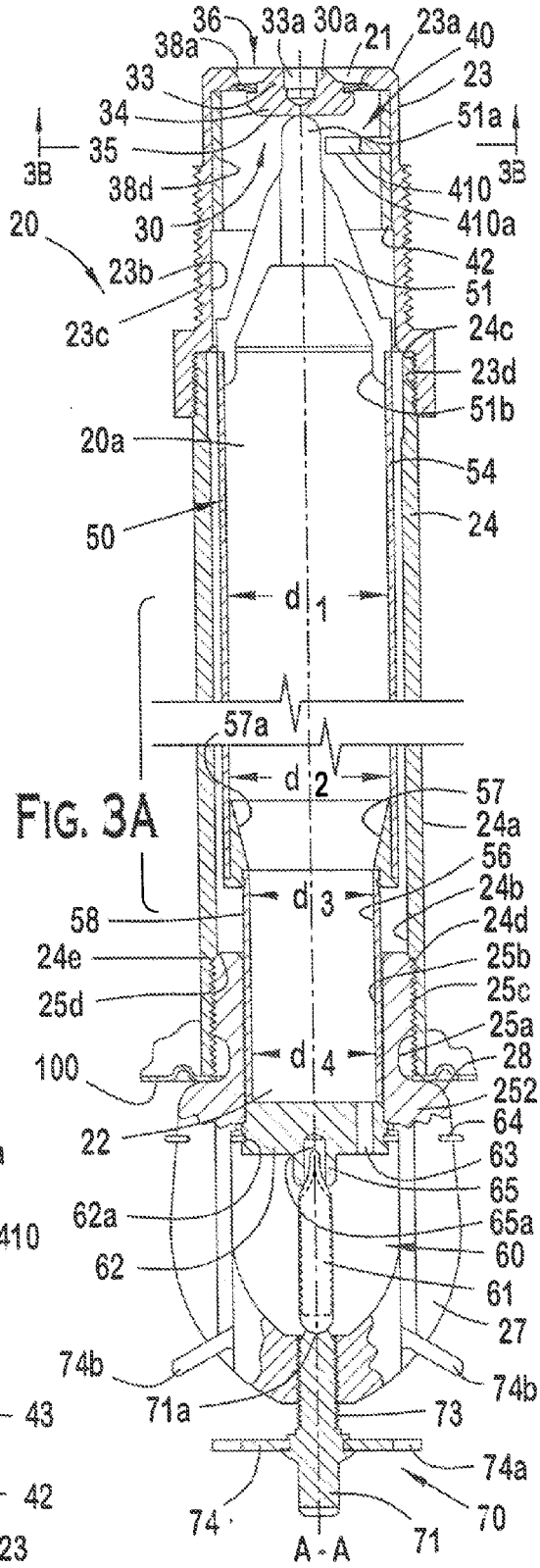
FIG. 3A
FIG. 3B
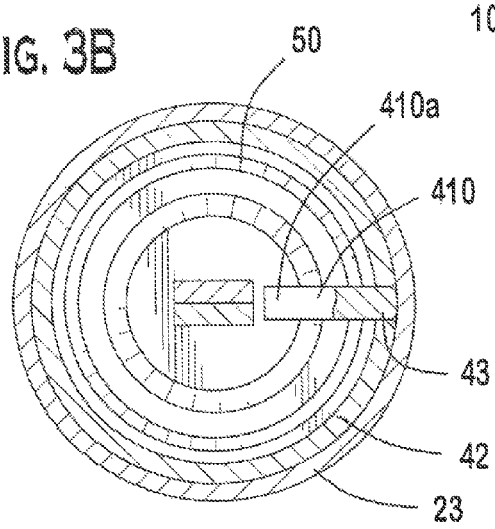

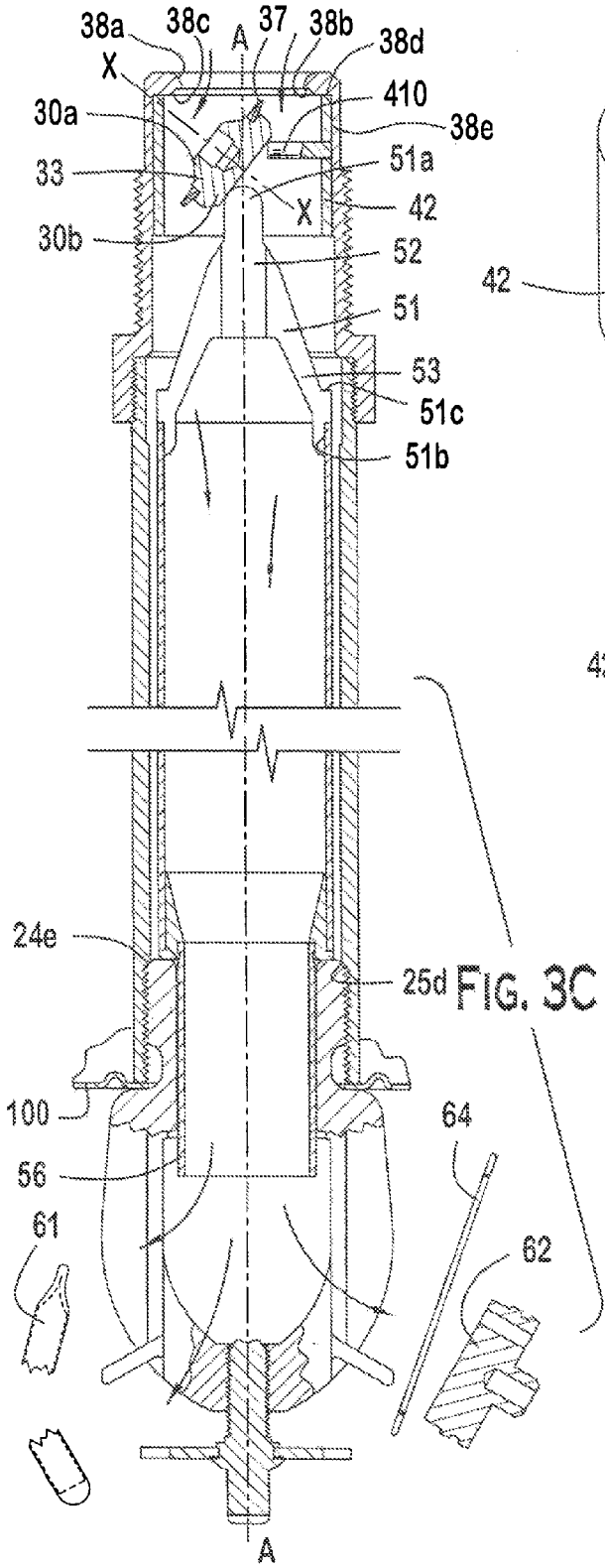
FIG. 3C
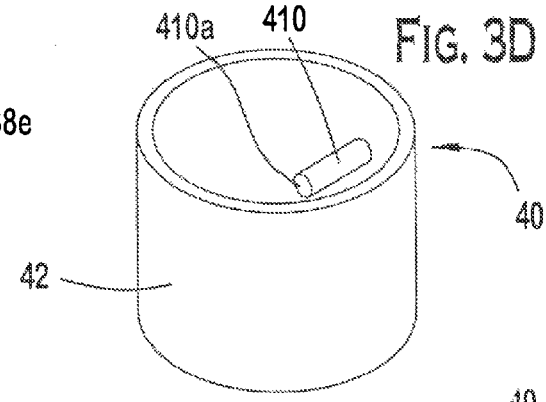
FIG. 3D
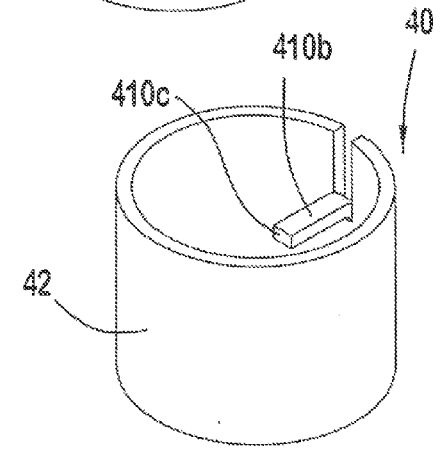
FIG. 3E
FIG. 3F
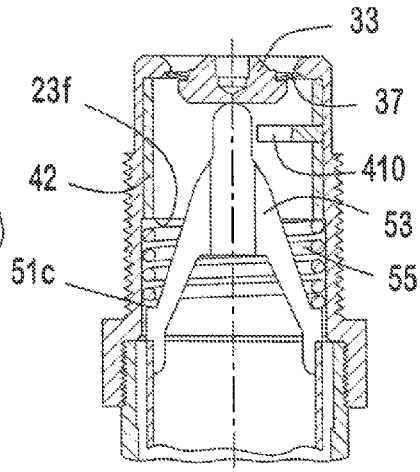

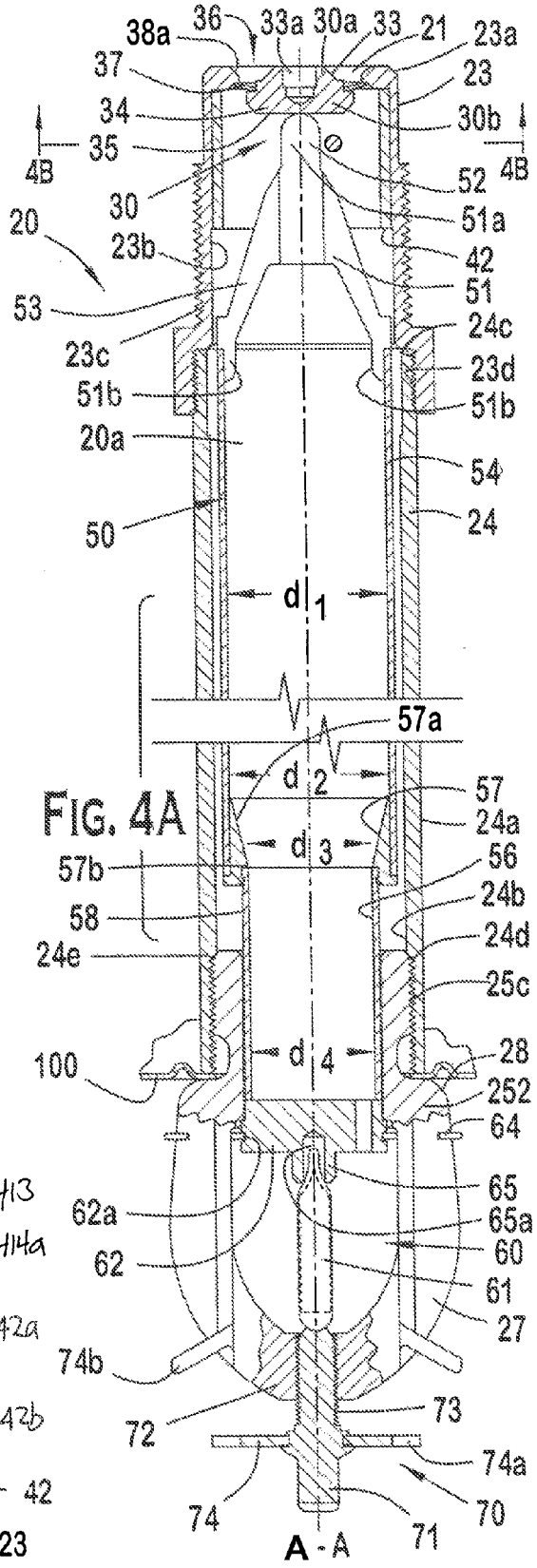
FIG. 4A
FIG. 4B
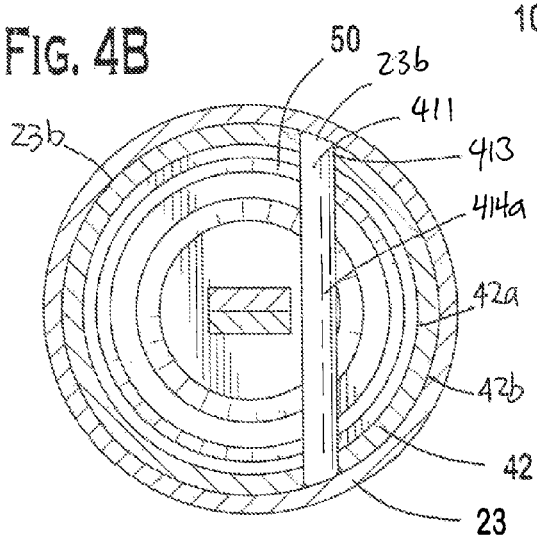

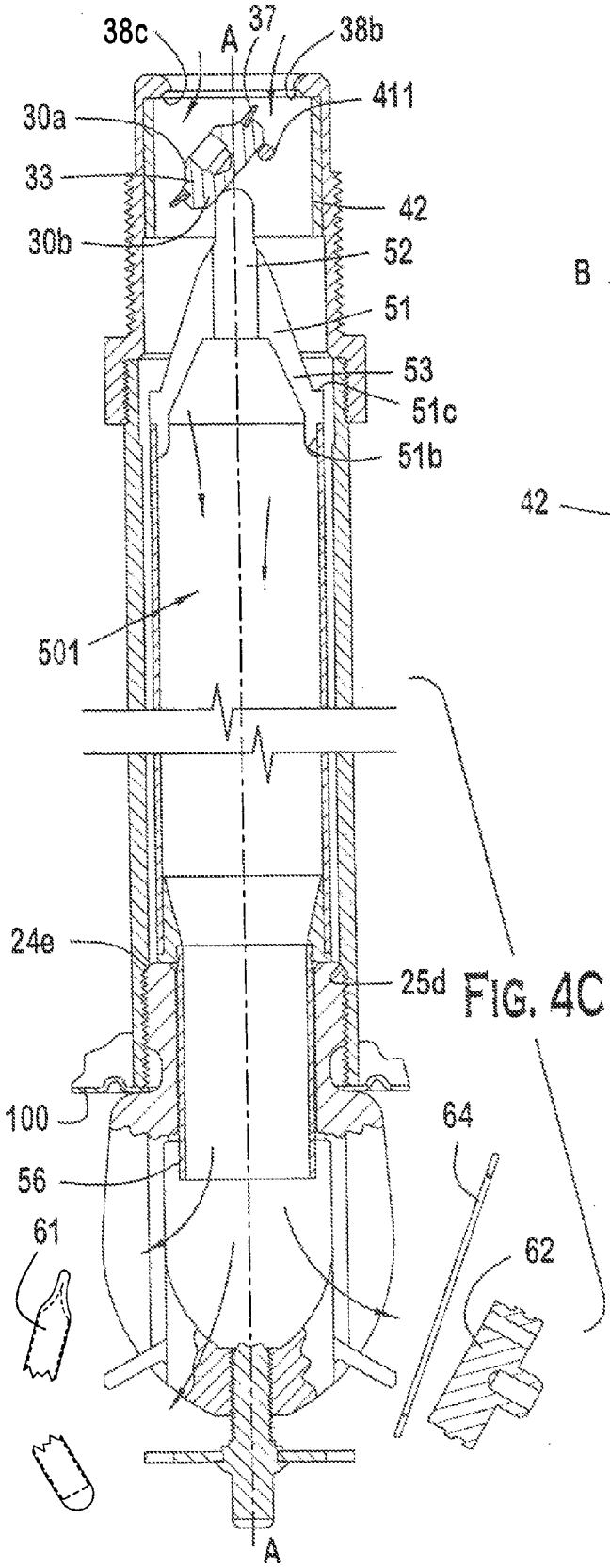
FIG. 4C
FIG. 4D
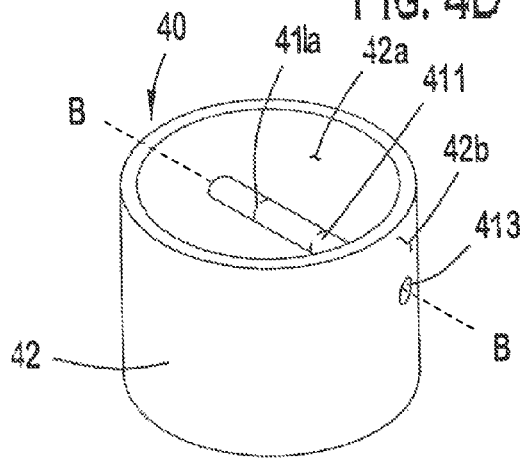
FIG. 4E
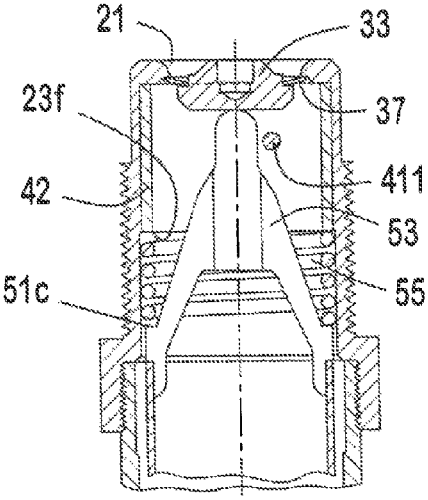

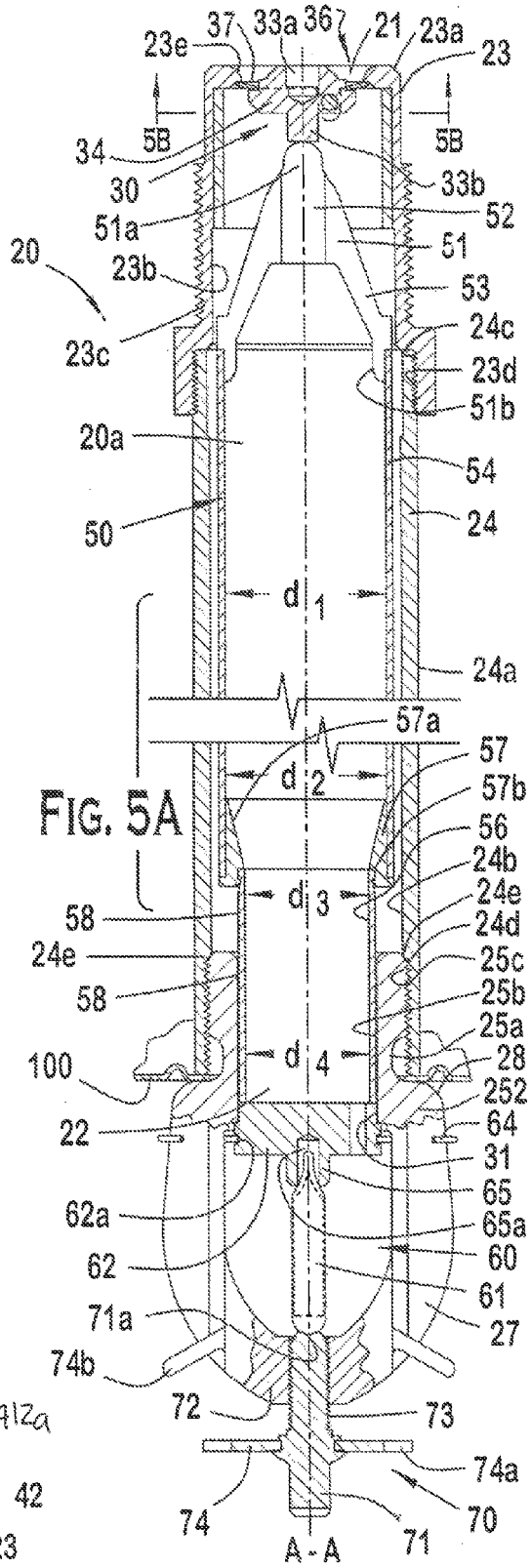
FIG. 5A
FIG. 5B
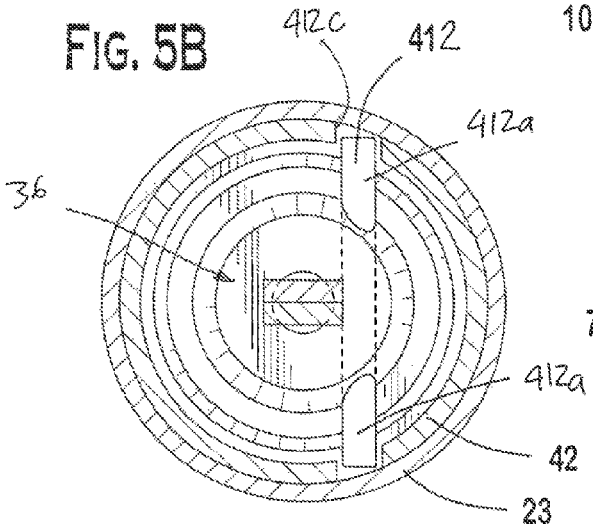

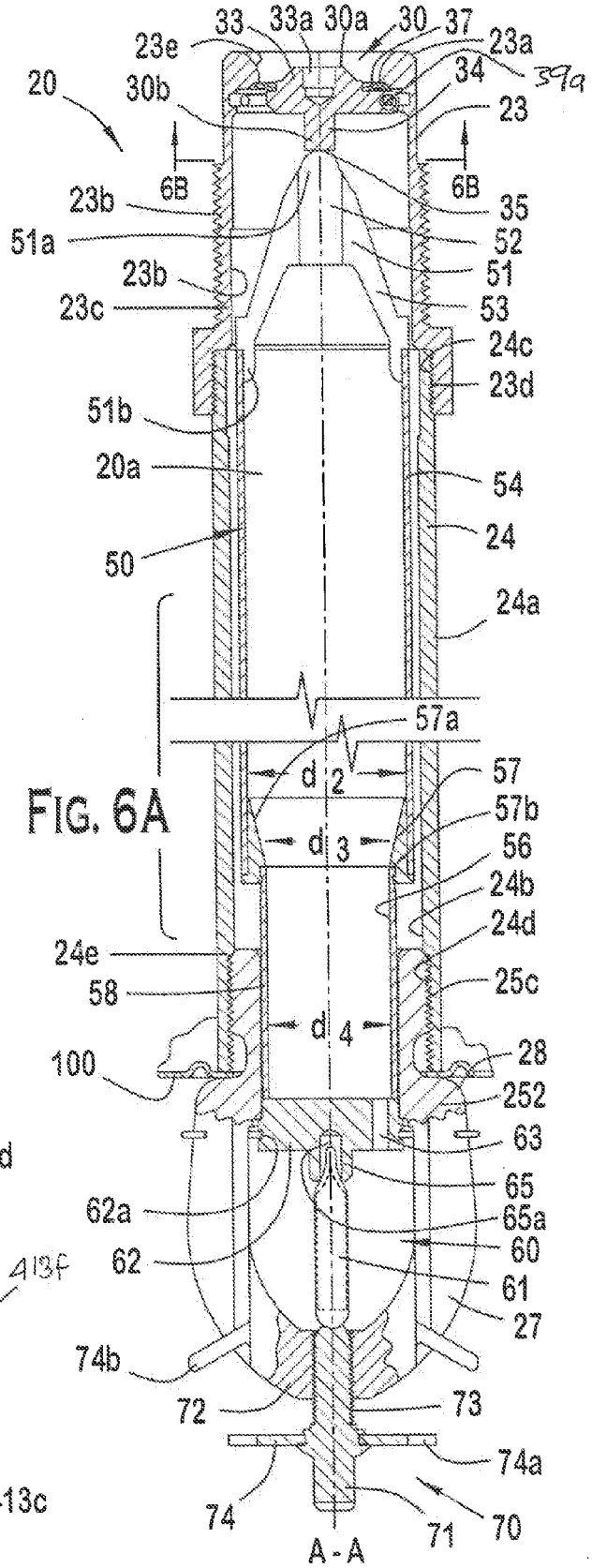
FIG. 6A
FIG. 6B
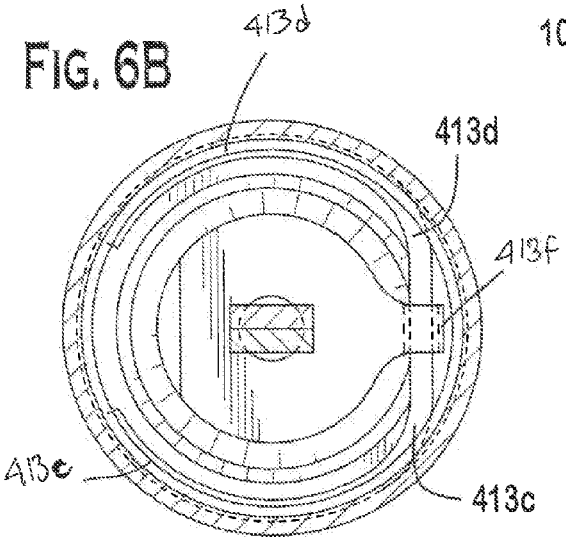

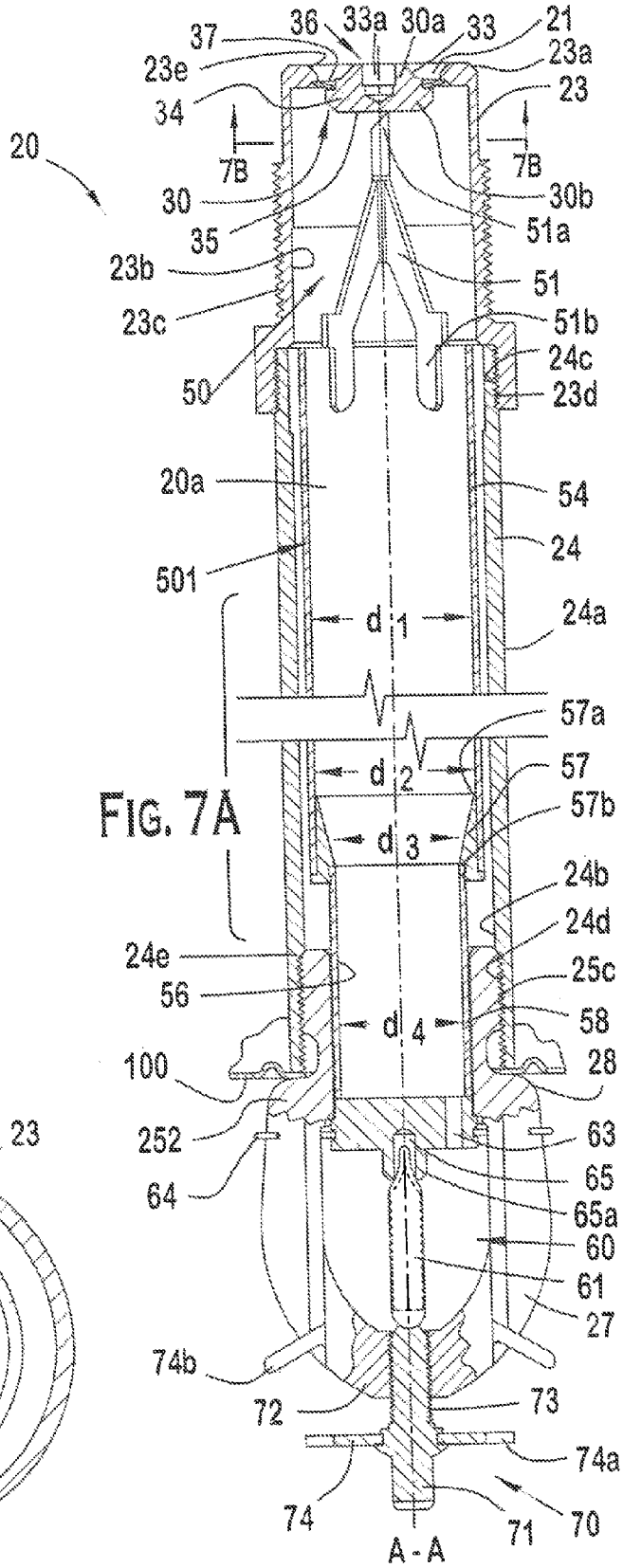
FIG. 7A
FIG. 7B
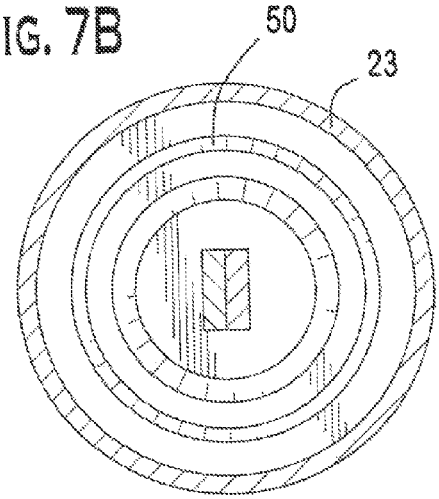

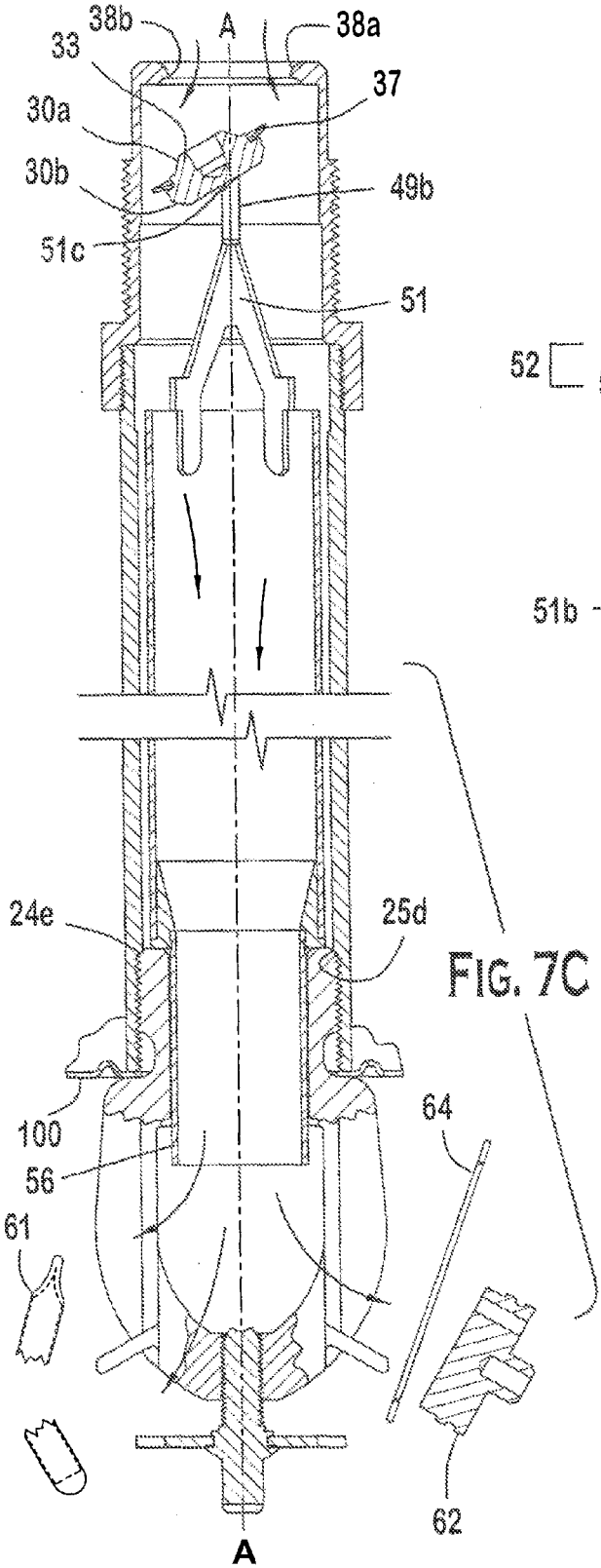
FIG. 7C
FIG. 7D
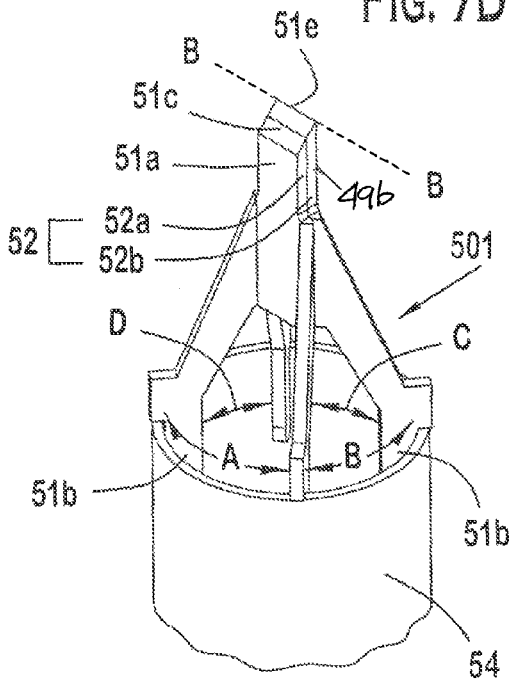
FIG. 7E
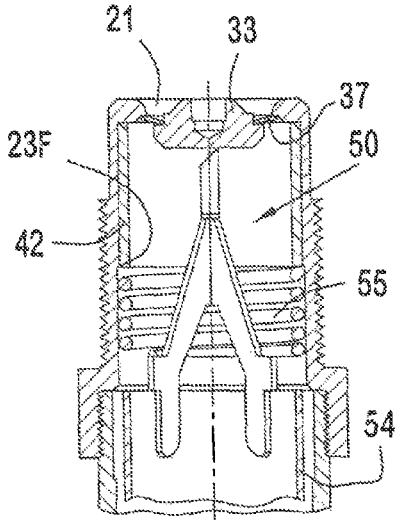

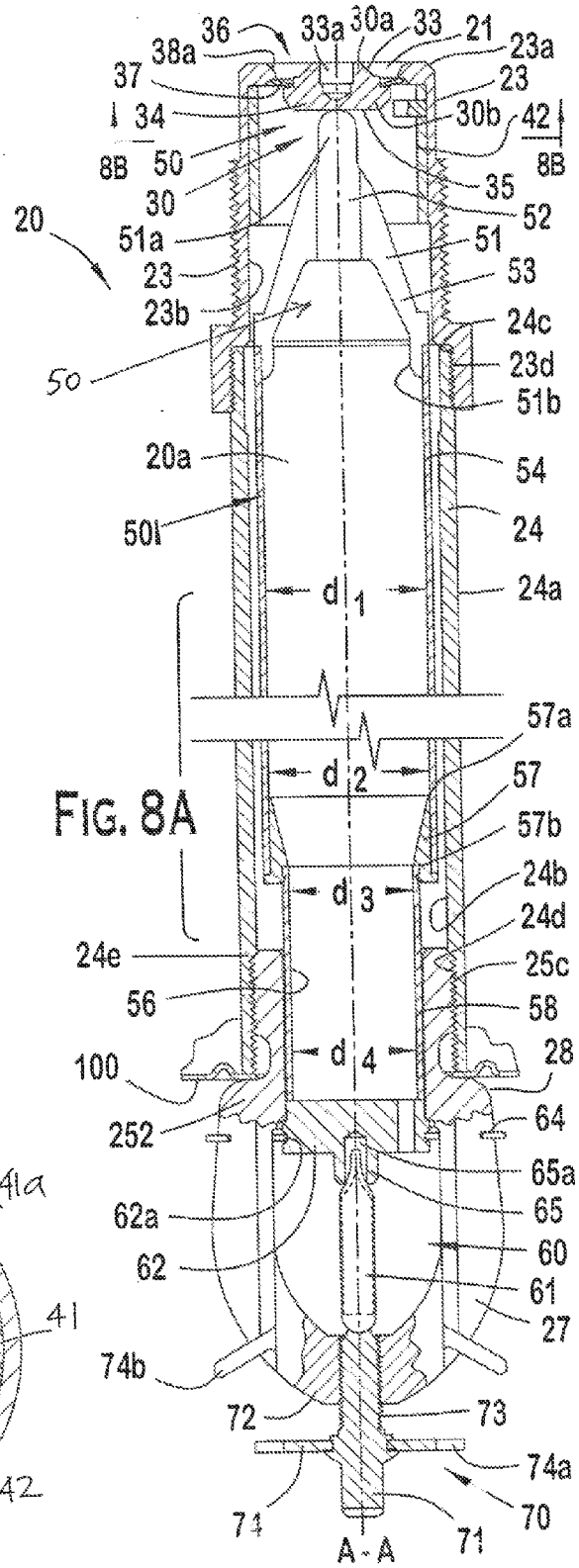
FIG. 8A
FIG. 8B
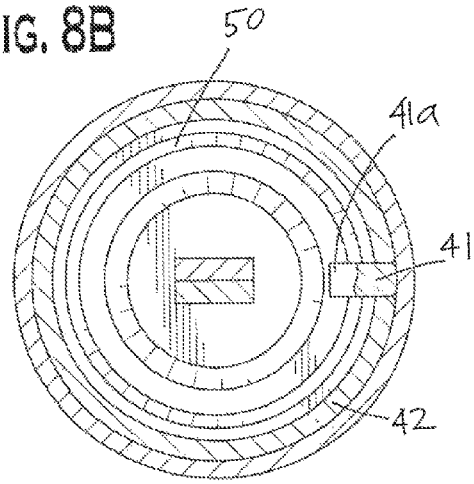

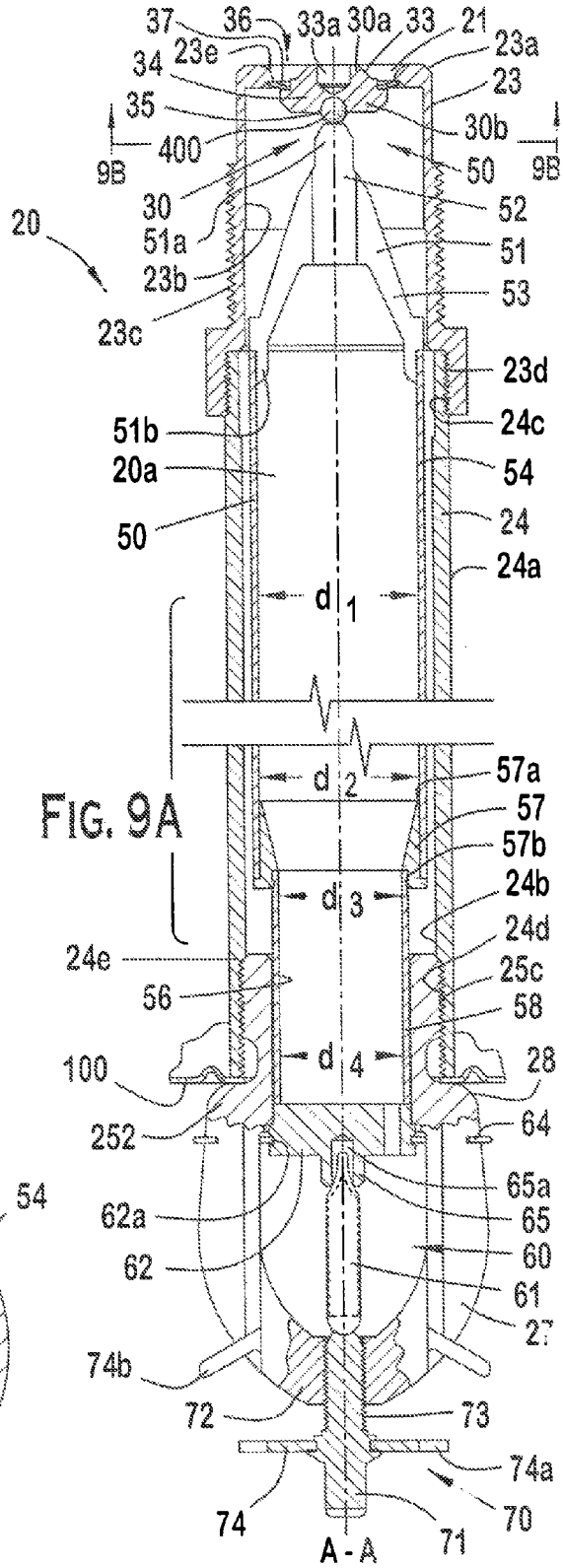
FIG. 9A
FIG. 9B
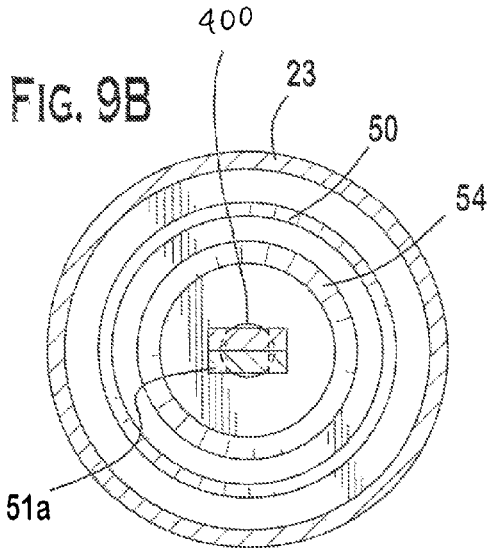

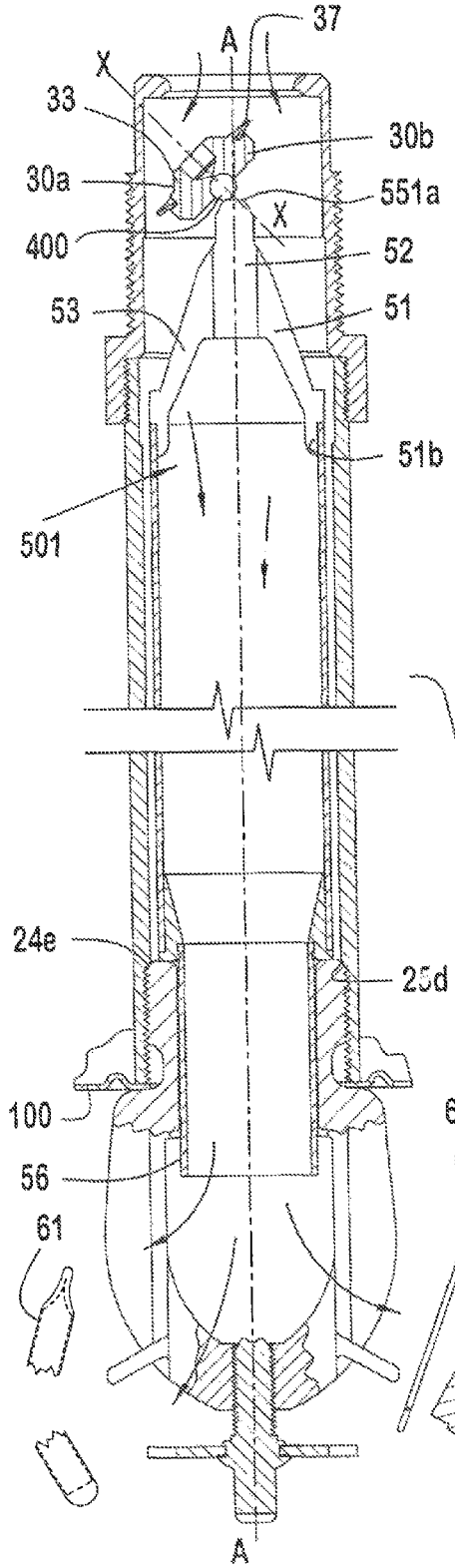
FIG. 9C
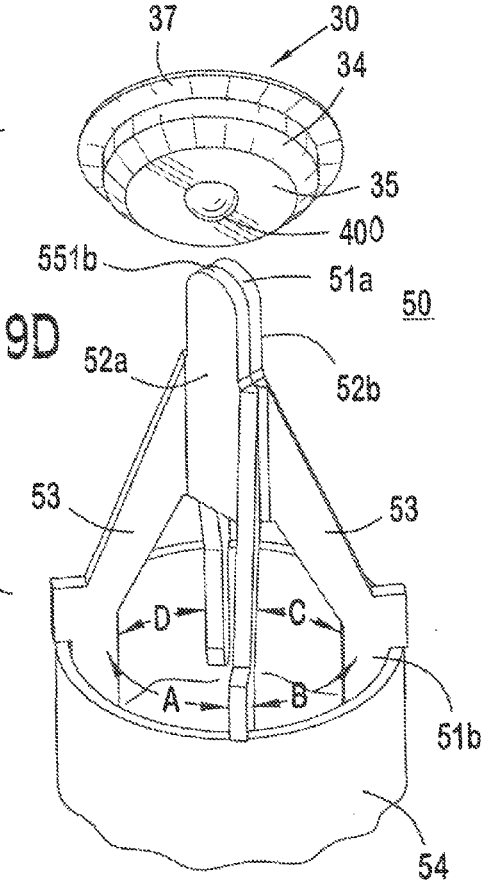
FIG. 9D
FIG. 9E
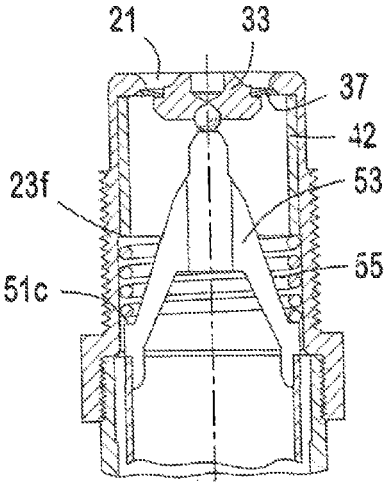

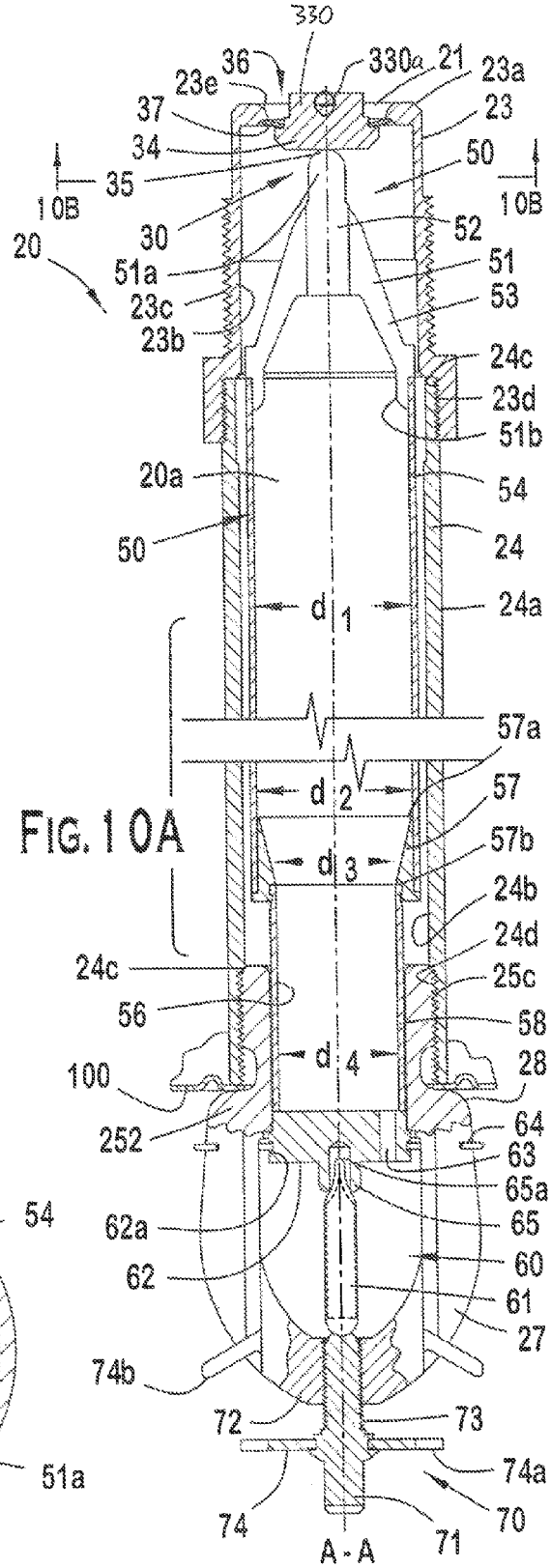
FIG. 10A
FIG. 10B
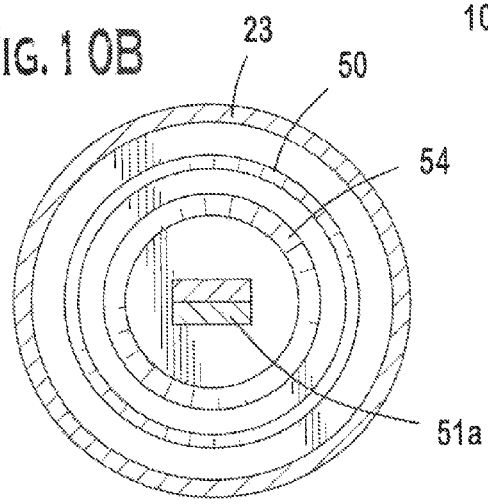

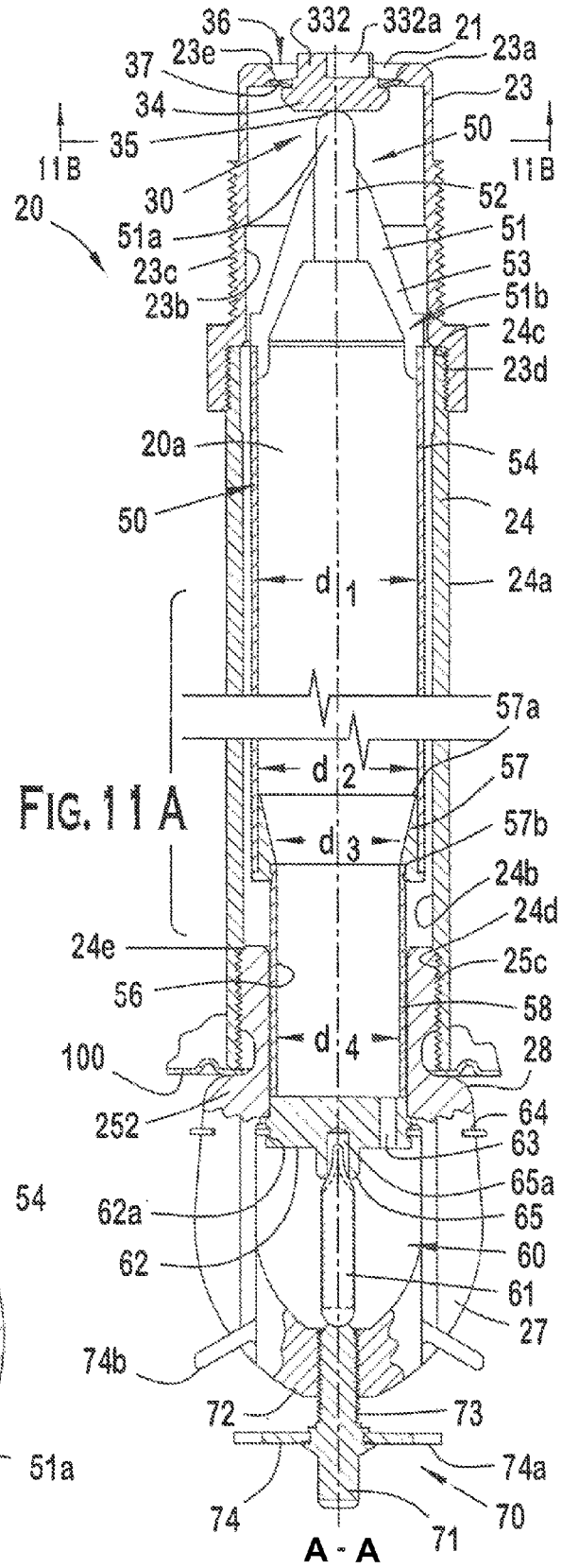
FIG. 11 A
FIG. 11 B
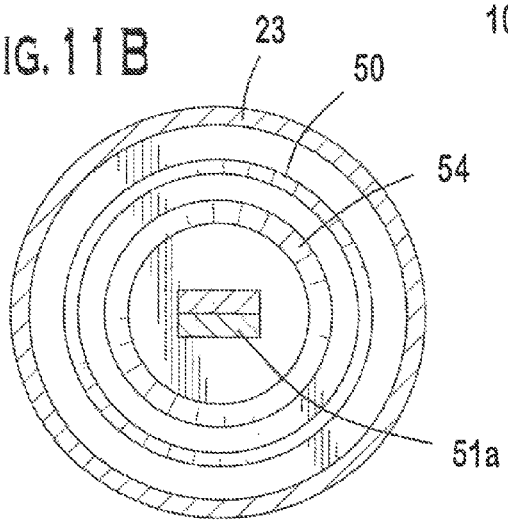

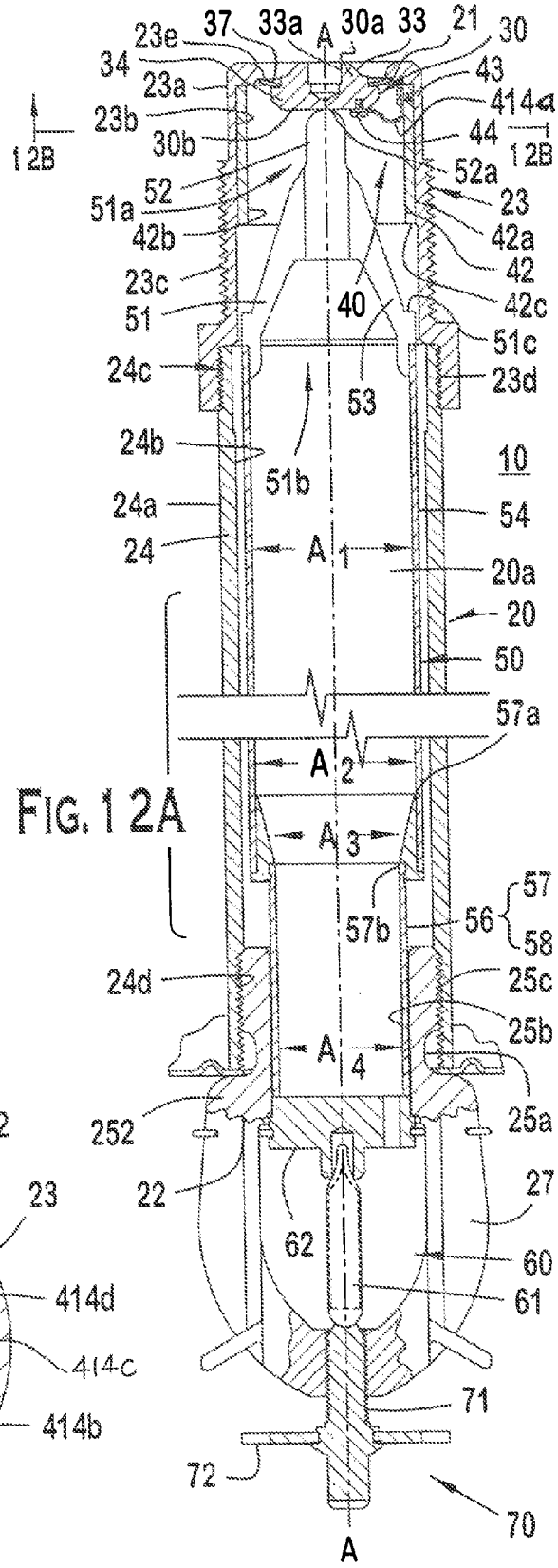
FIG. 12A
FIG. 12B
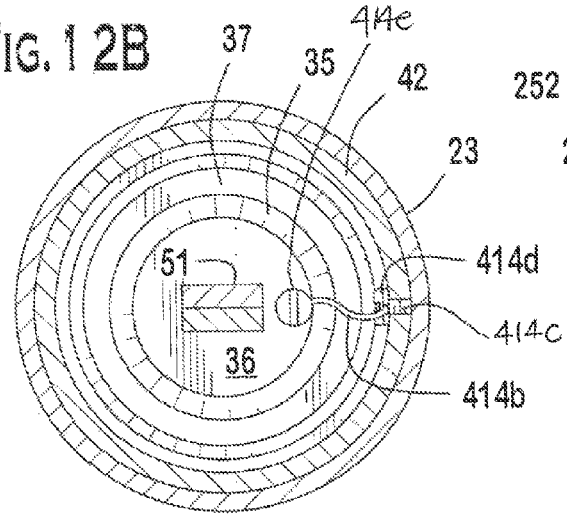

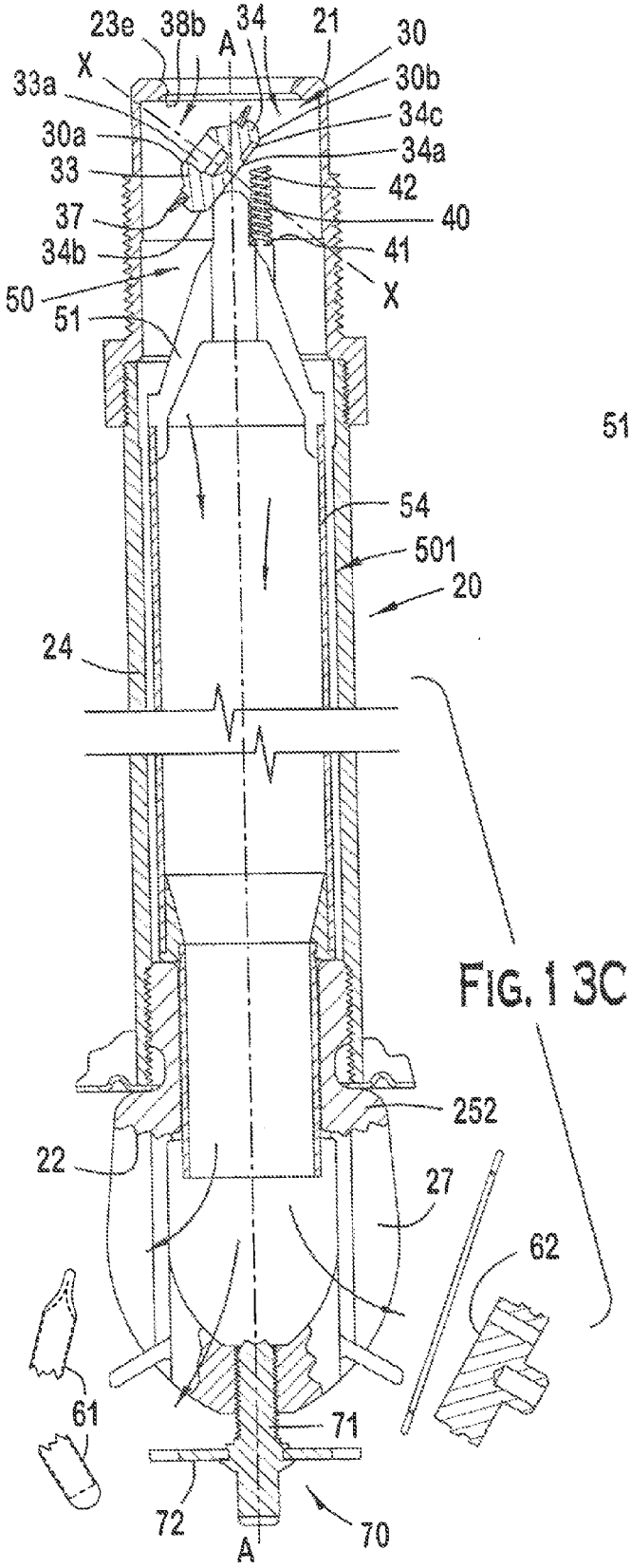
FIG. 13C
FIG. 13D
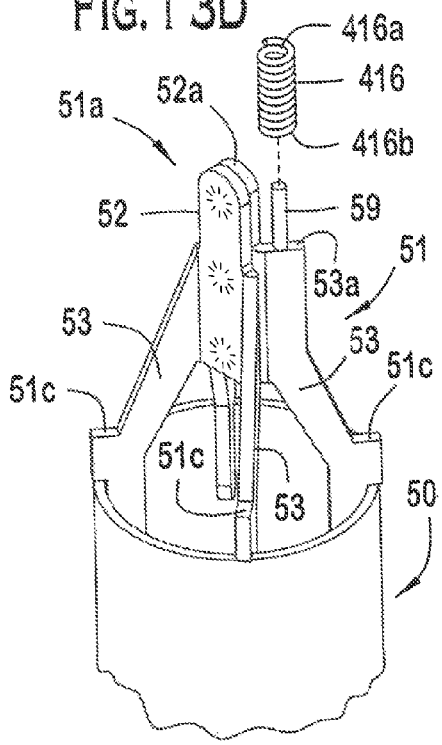
FIG. 13E
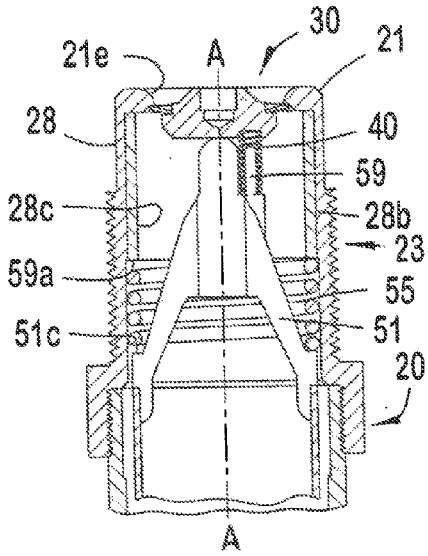

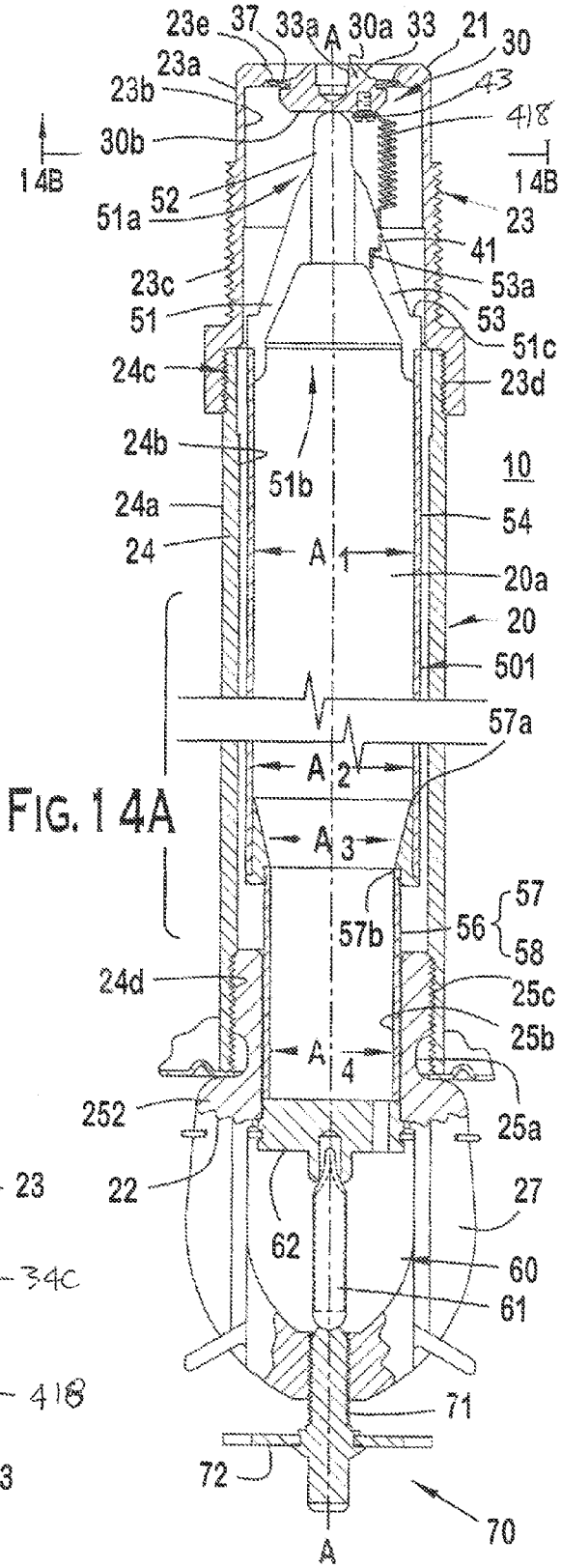
FIG. 14A
FIG. 14B
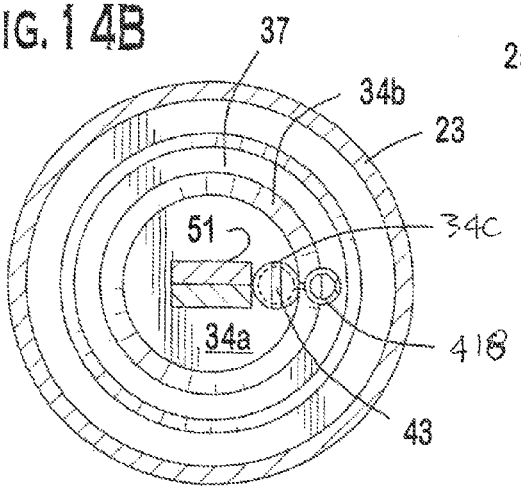

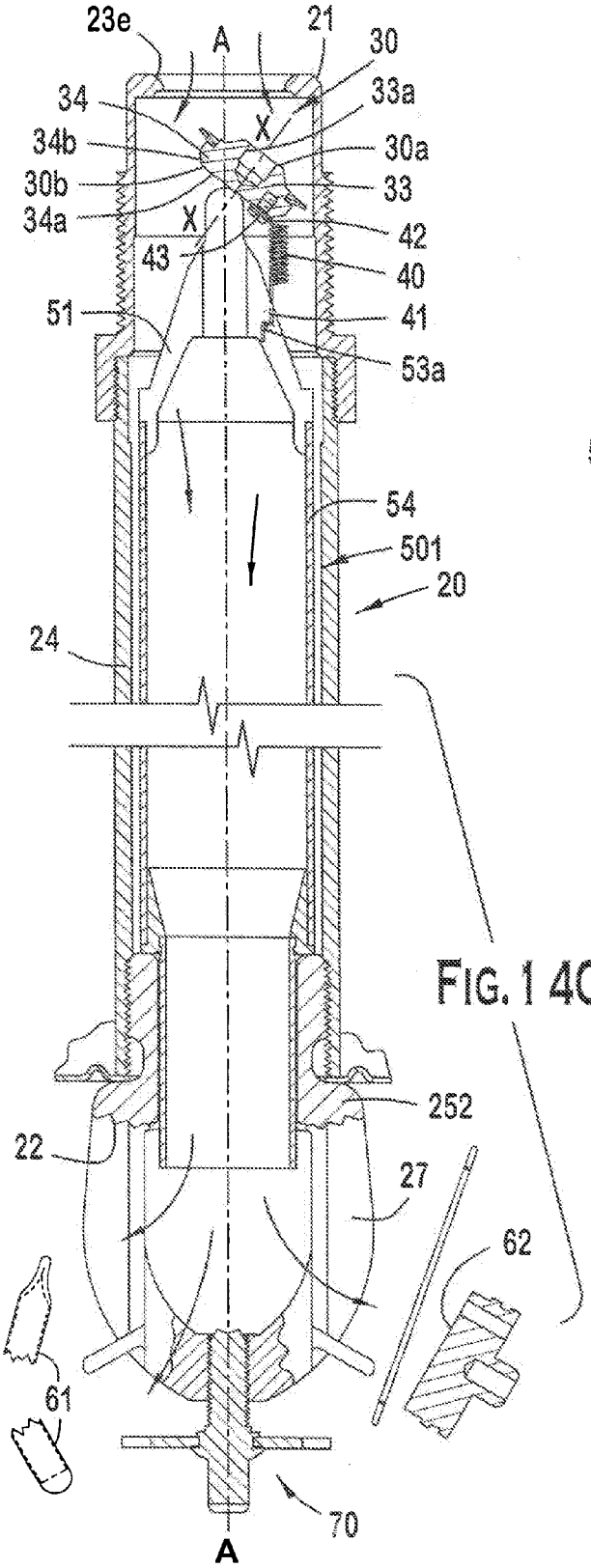
FIG. 14C
FIG. 14D
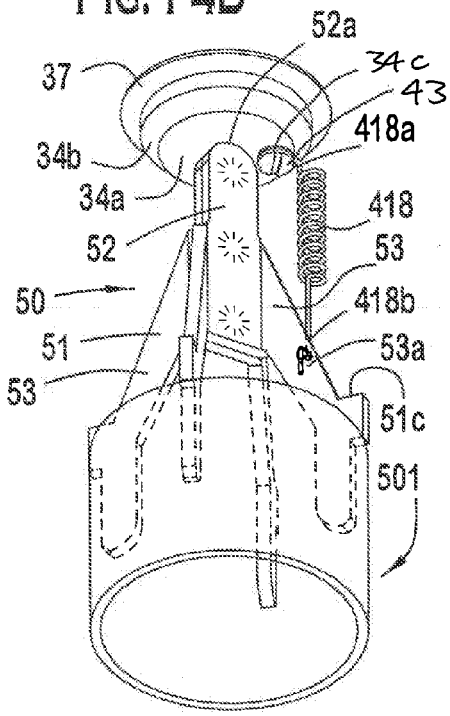
FIG. 14E
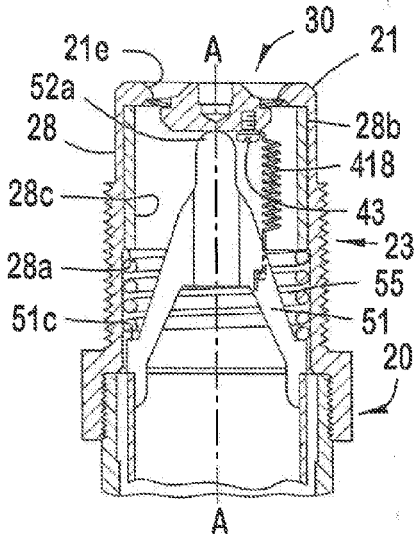

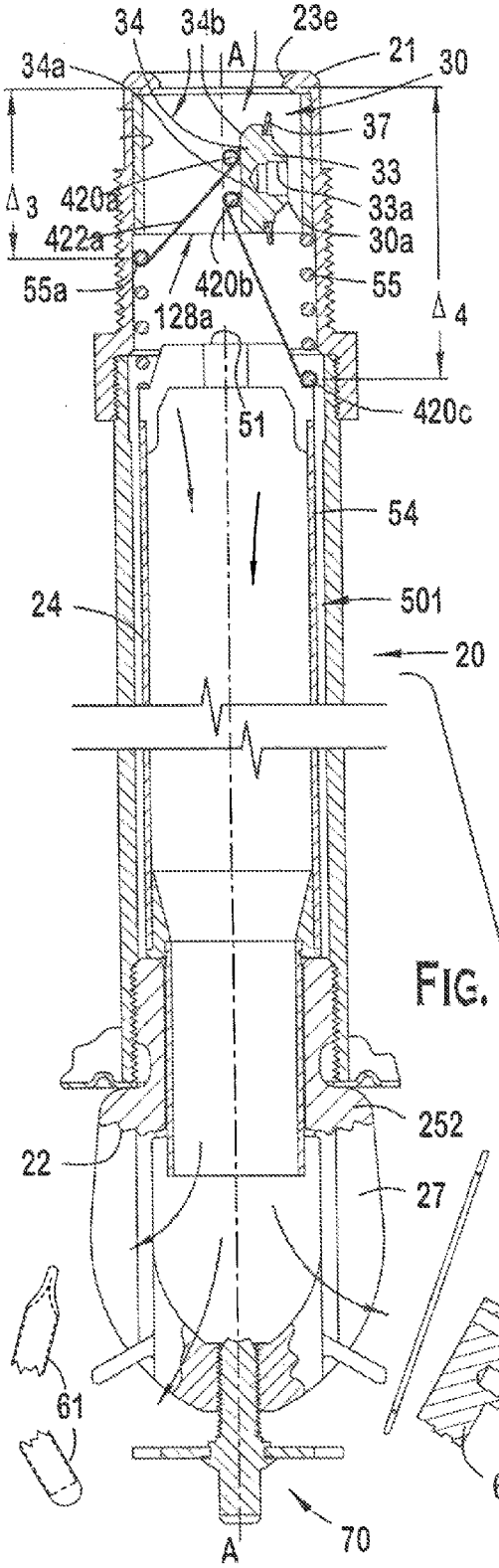
FIG. 15C
FIG. 15D
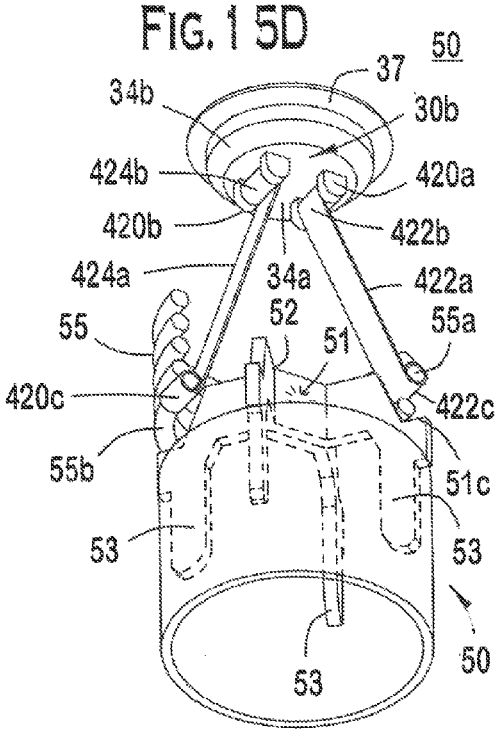
FIG. 15E
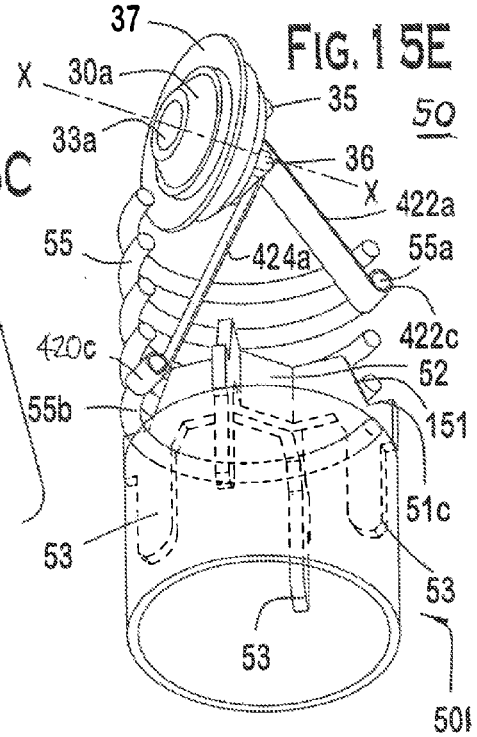

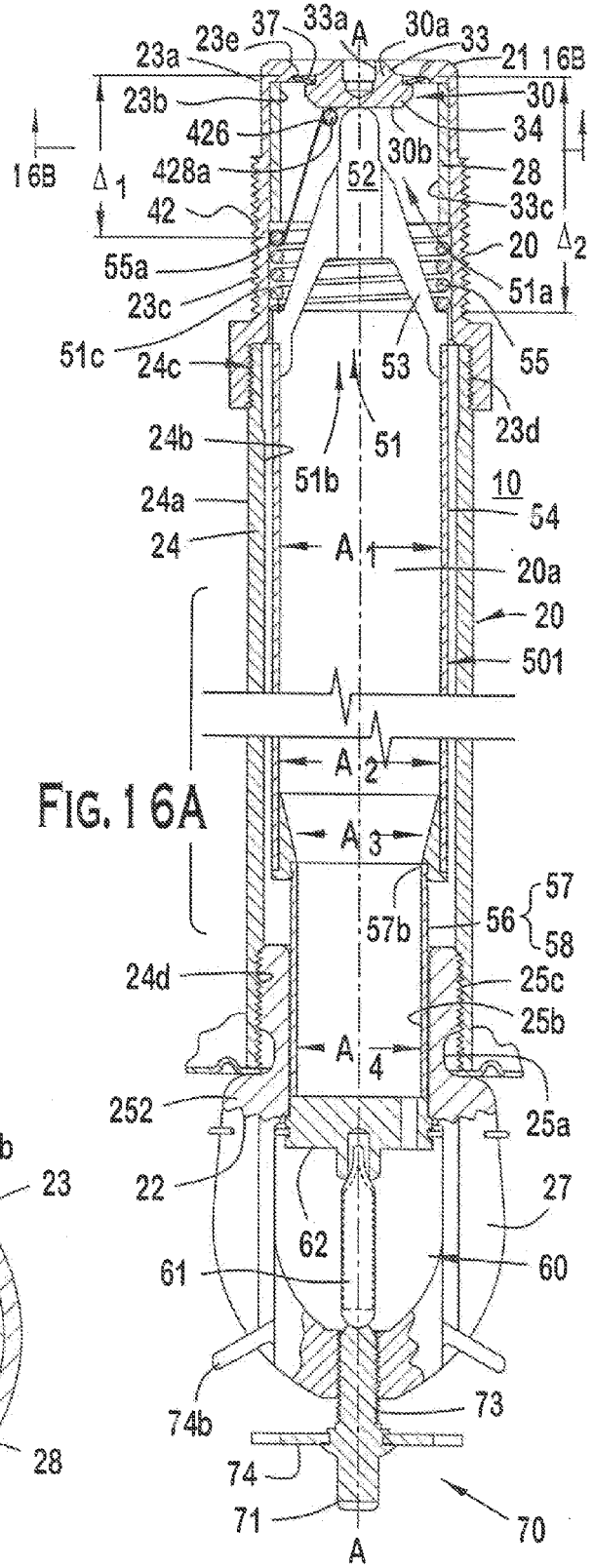
FIG. 16A
FIG. 16B
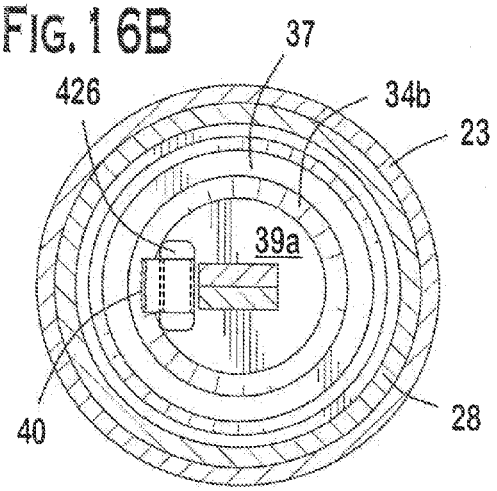

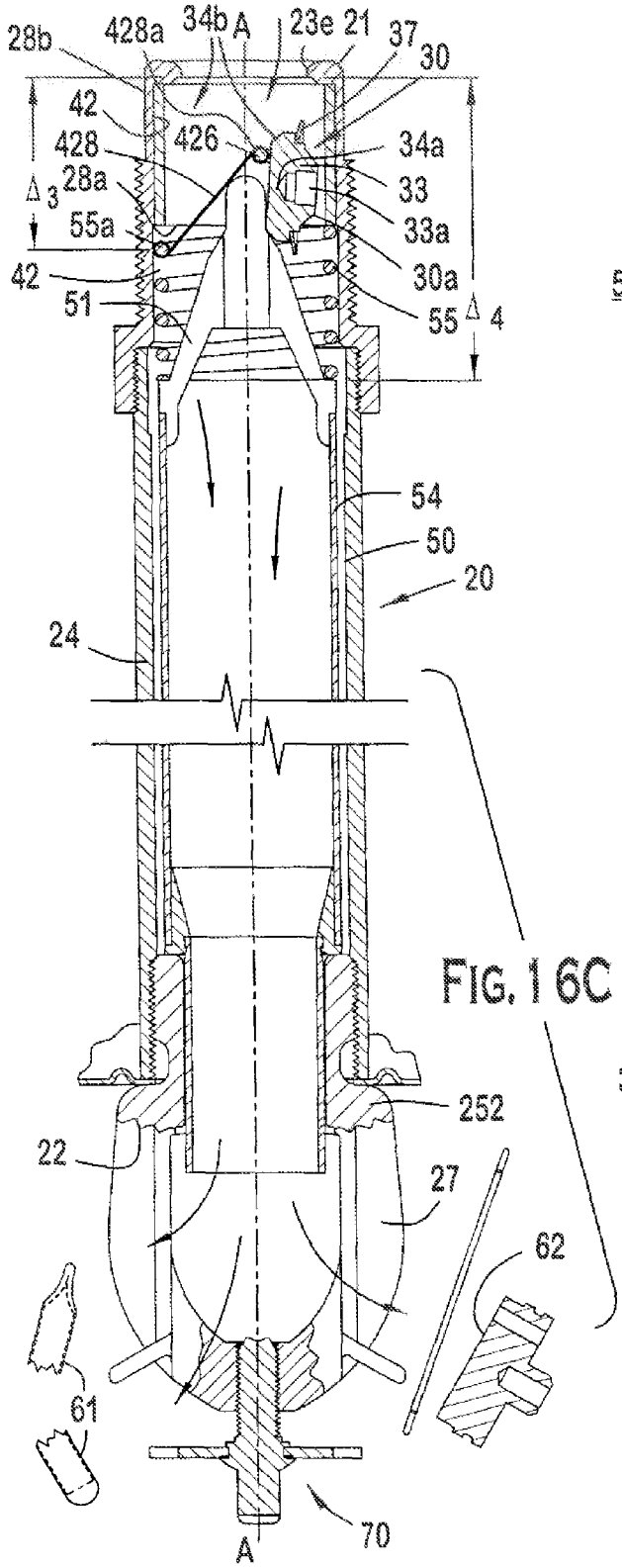
FIG. 16C
FIG. 16D
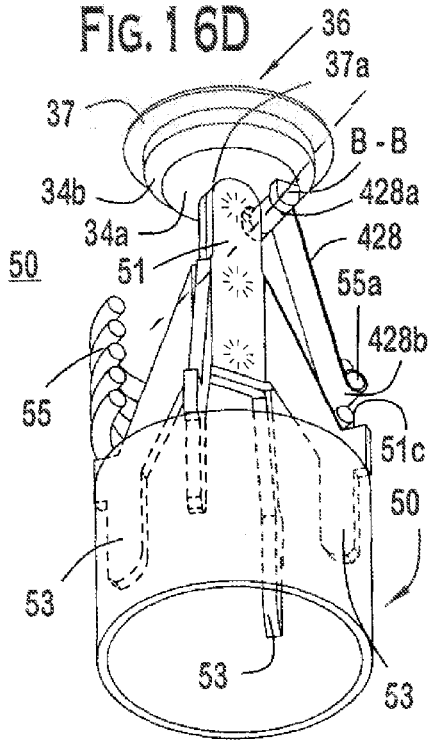
FIG. 16E
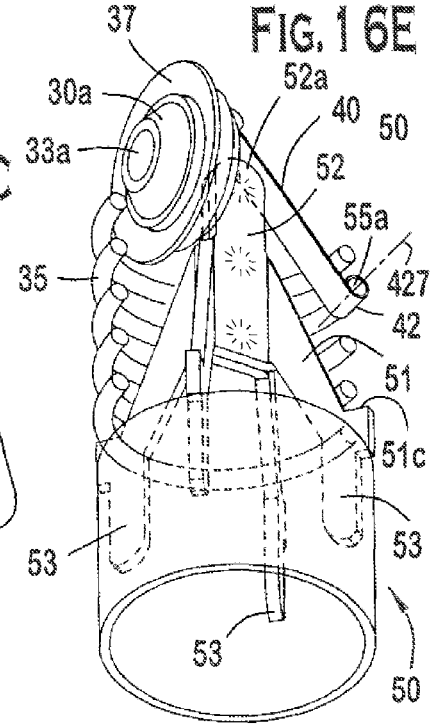

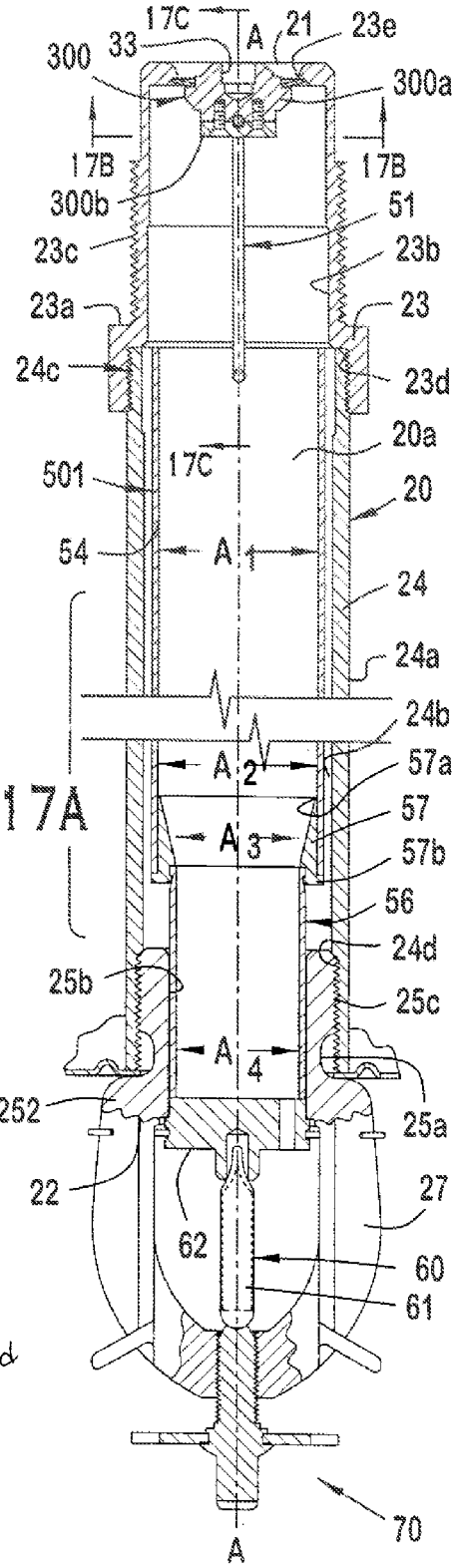
FIG. 17A
FIG. 17B
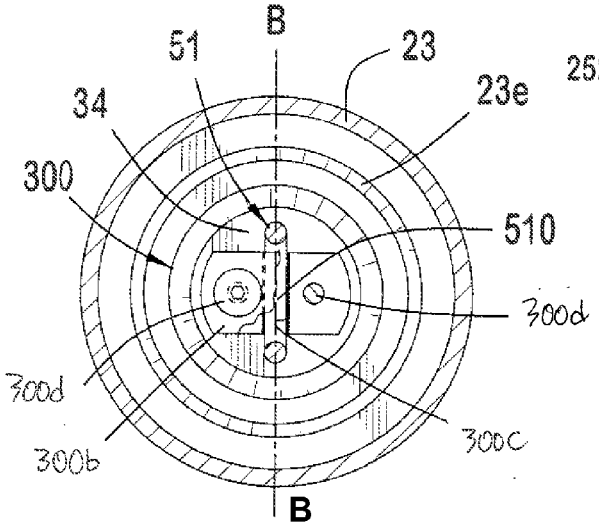

A
300
300c
X
X
37
51
23
54
24
57
56
H
27
61
62
70
A 33
23e
37
A
300
300a
B-B
34
300b
510
300c
23
542
544
512
514
A
24
54

37
300c
300a
50
34
300b
300d
510
51
514
544
542
512
54

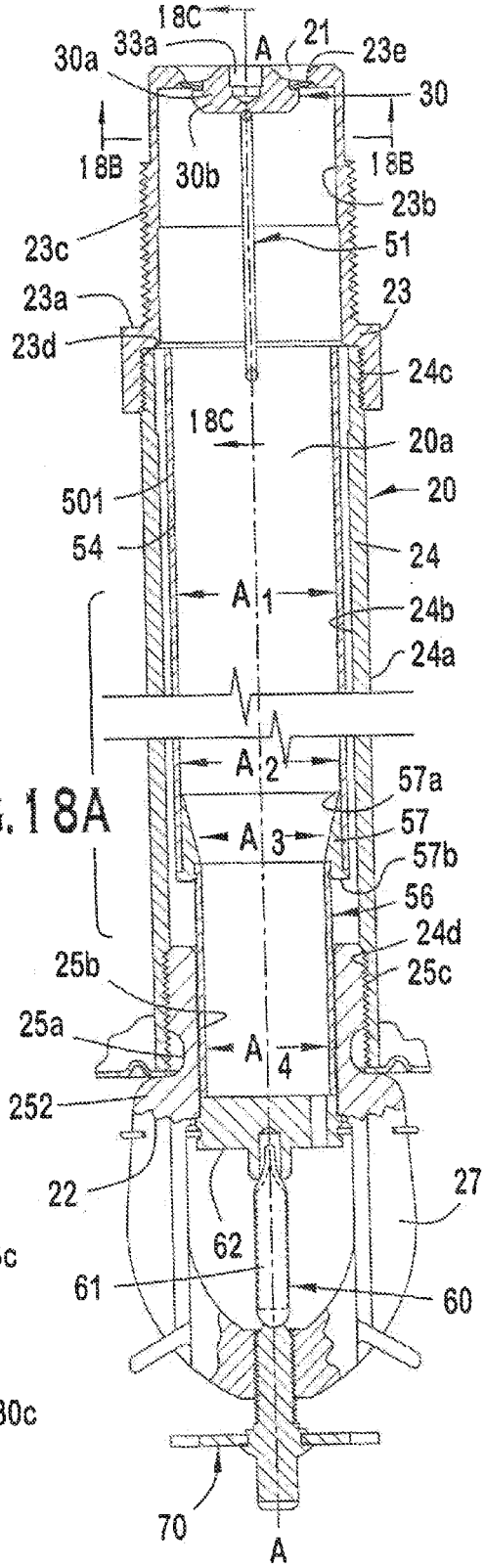
FIG. 18A
FIG. 18B
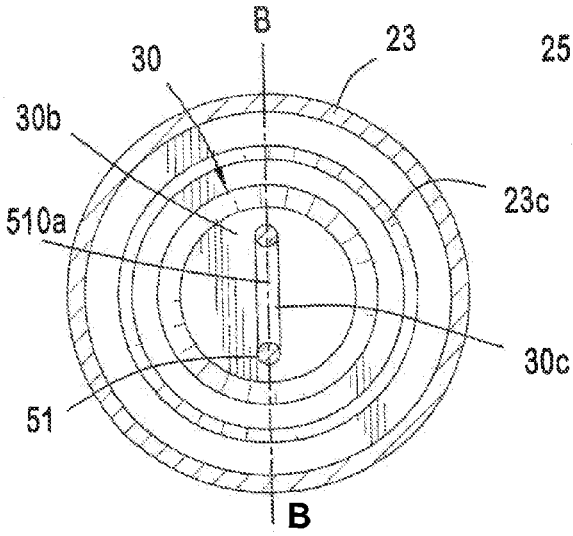

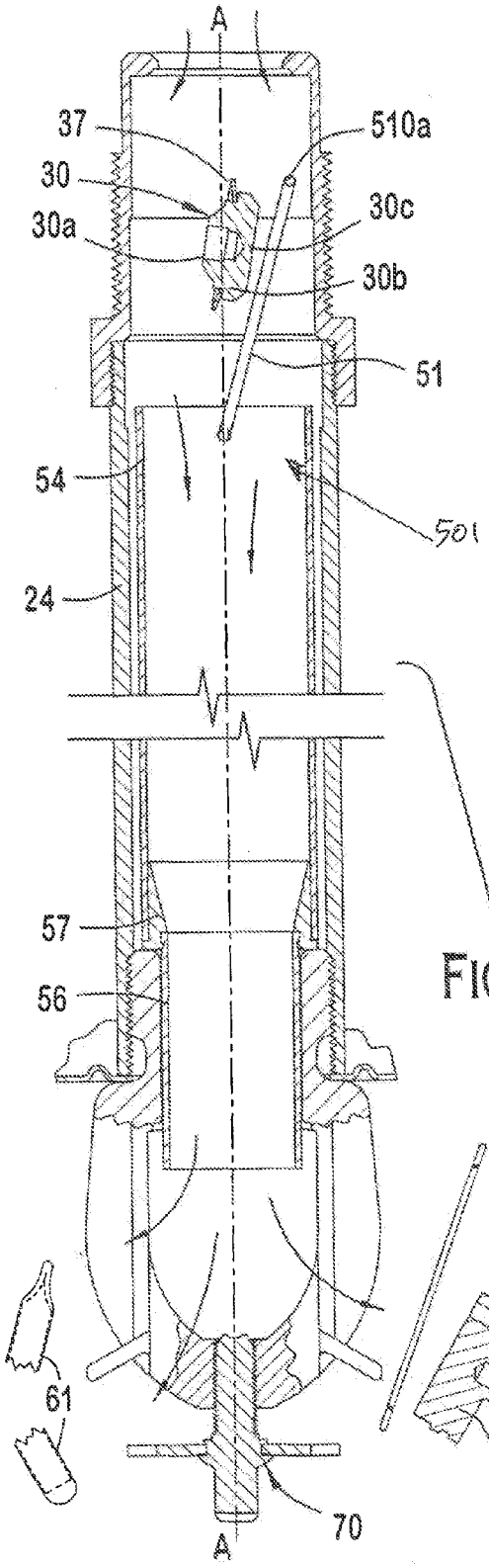
FIG. 18D
FIG. 18C
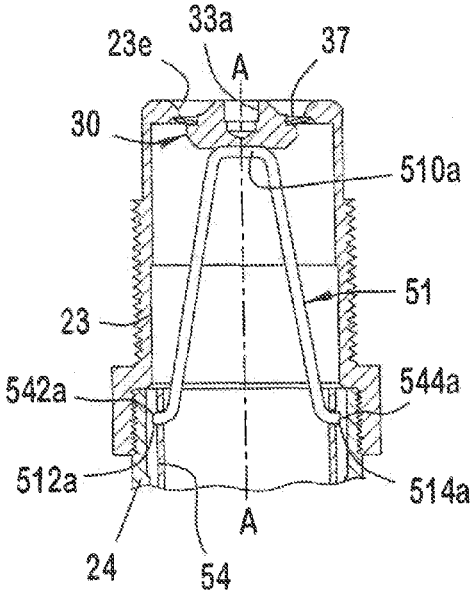
FIG. 18E
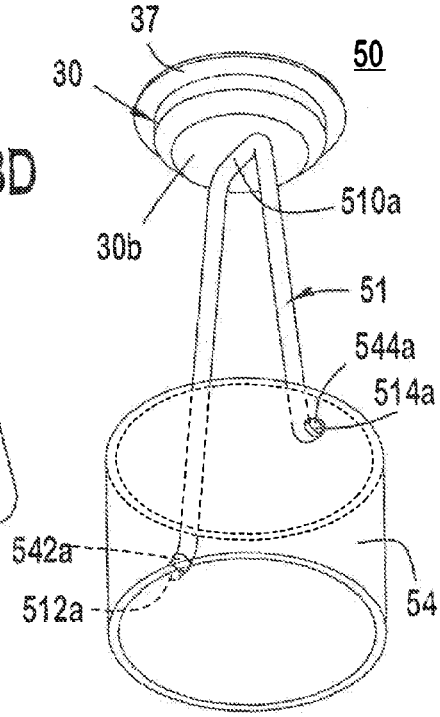

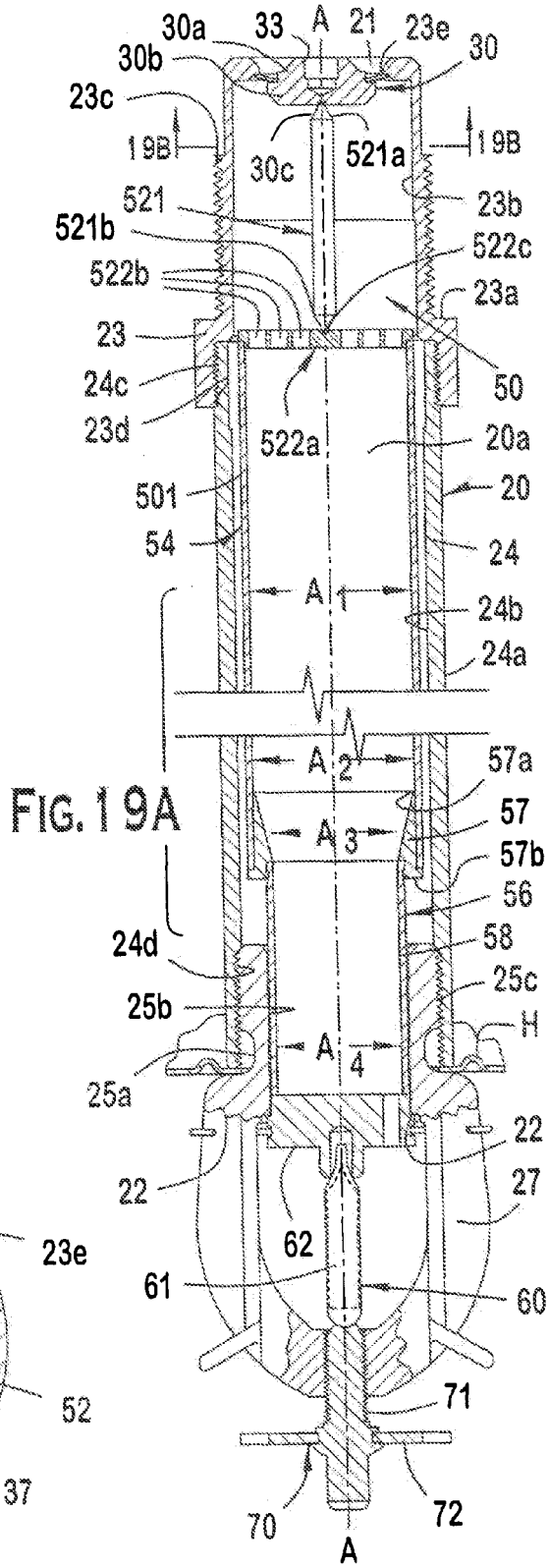
FIG. 19A
FIG. 19B
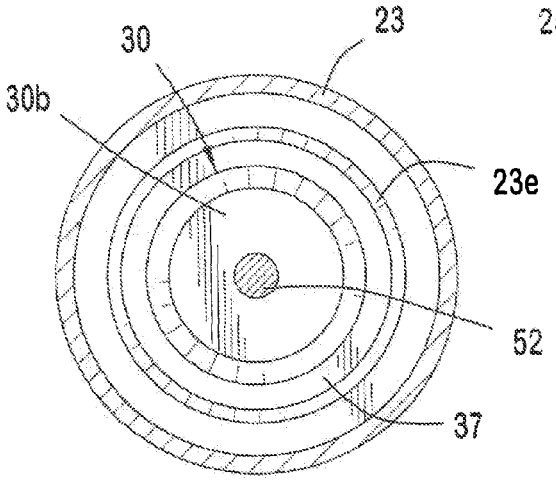

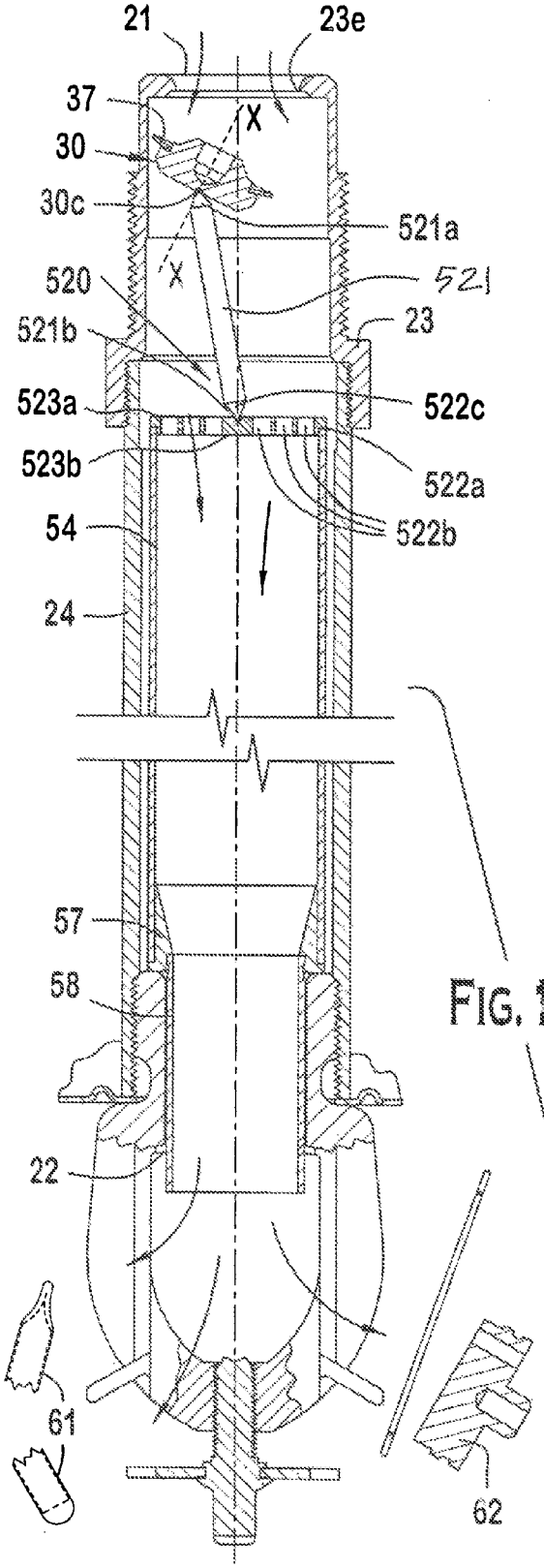
FIG. 19C
FIG. 19D
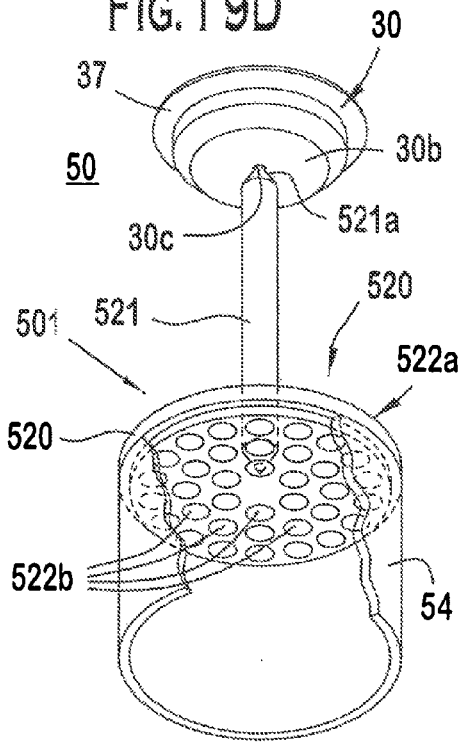
FIG. 19E
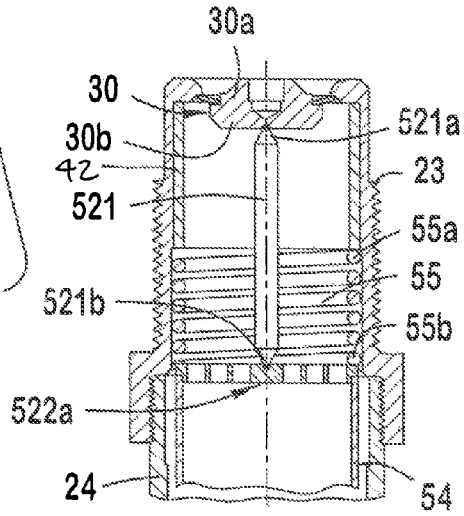

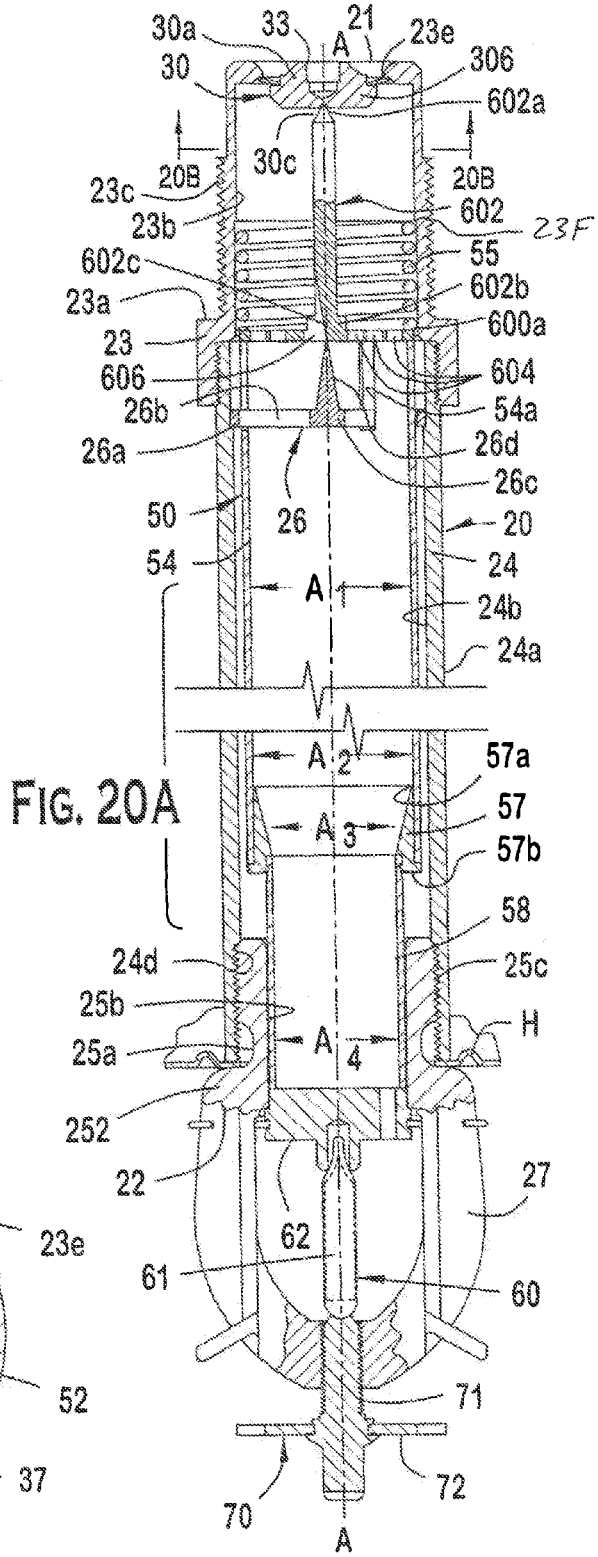
FIG. 20A
FIG. 20B
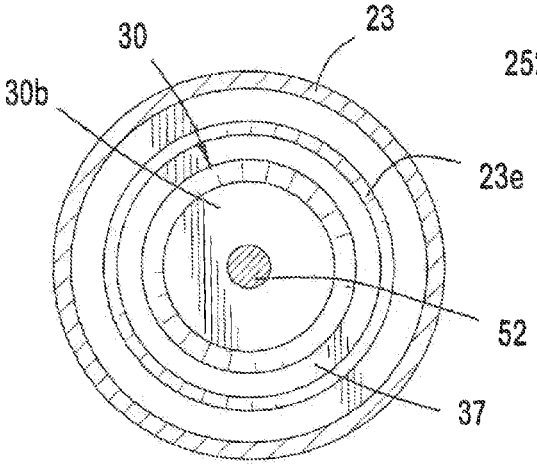

23e
21
30
602a
55
26d
602c
26a
26b
26c
54a
54
24
57
58
22
61
62

600a 606
600
604
600b
26d
26c
37
50
30
30c
30b
602a
602

600
604
606
600b
26a
26c
26b
602c
602a
30
33
602
30a
600a
602b
37
26b
26a
26c
54
54a

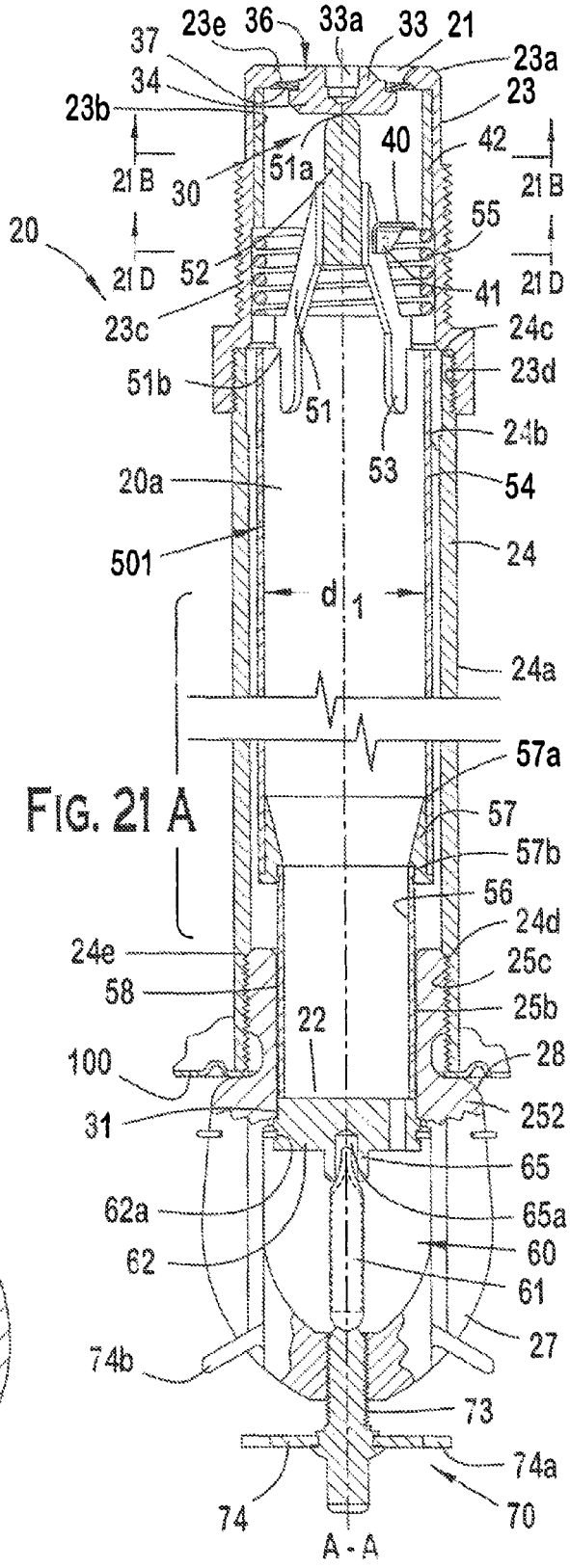
FIG. 21 A
FIG. 21 B
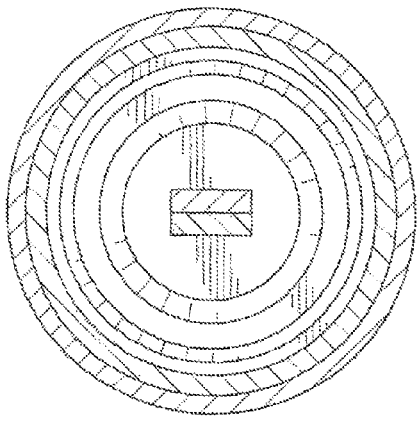

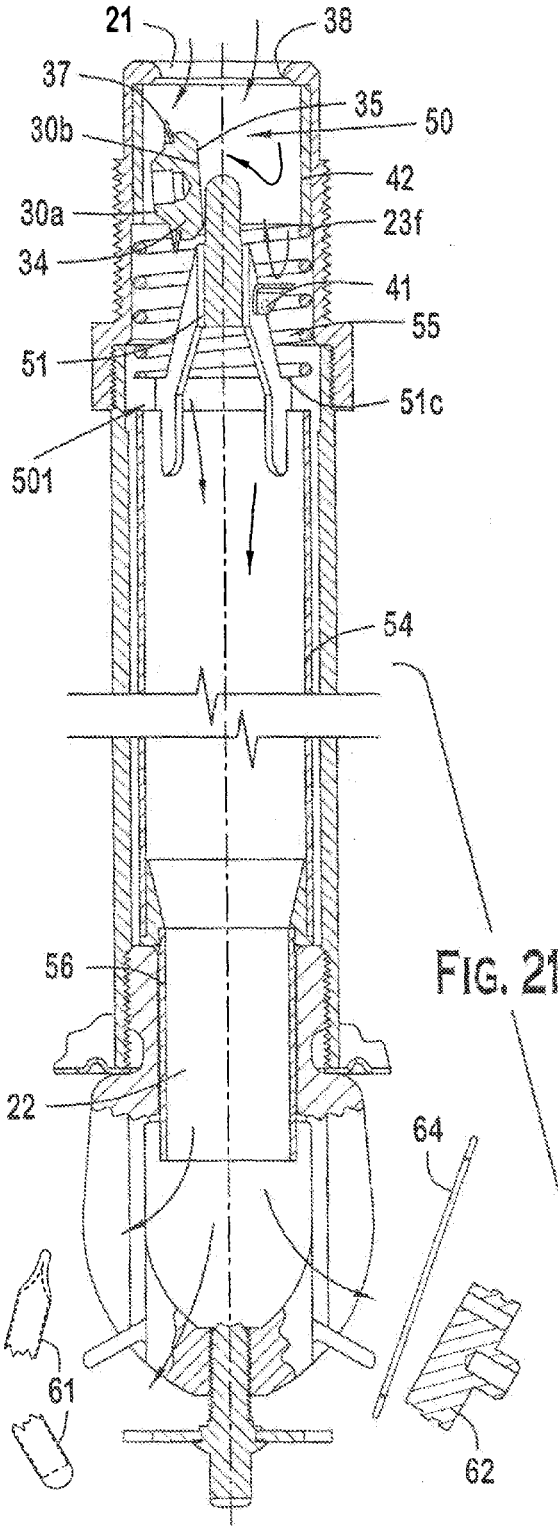
FIG. 21 C
FIG. 21 D
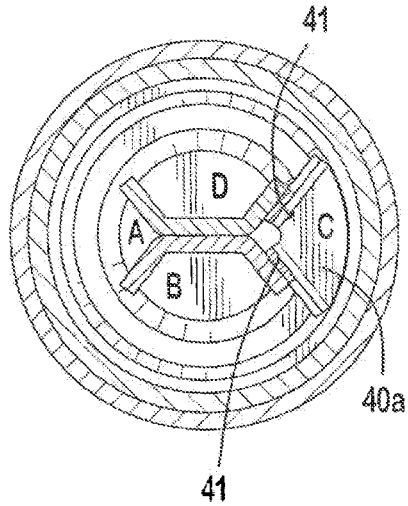
FIG. 21 E
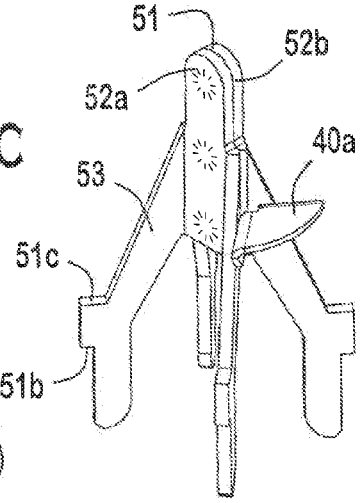

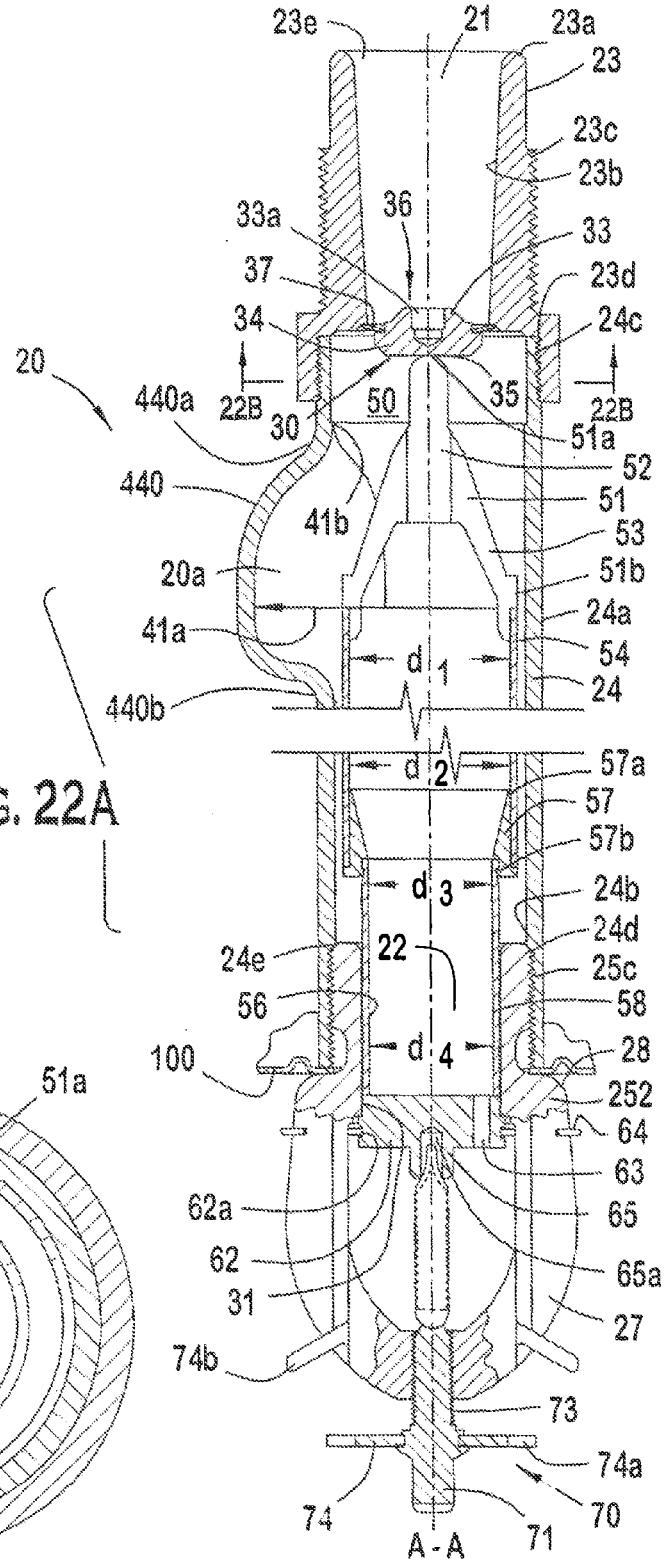
FIG. 22A
FIG. 22B
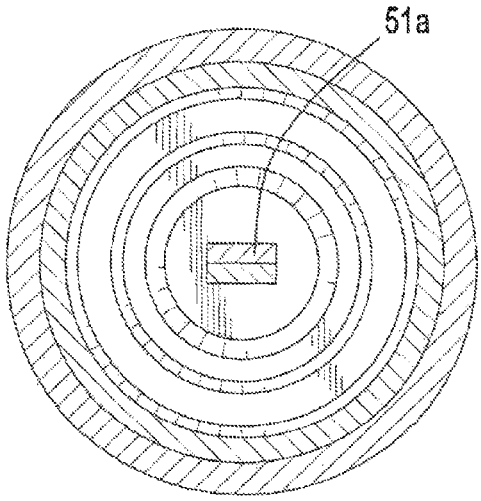

A
38a
38
38b
30b
34
X
X
30a
24e
25d
100
25a
25b
61
A
64
62

F
41MIN
440a
FA1
37
FA2
440
501
X-X
30
24
37
54
440b
41max
A
21
23
23f
24
V
55
51
53
51C
54
A

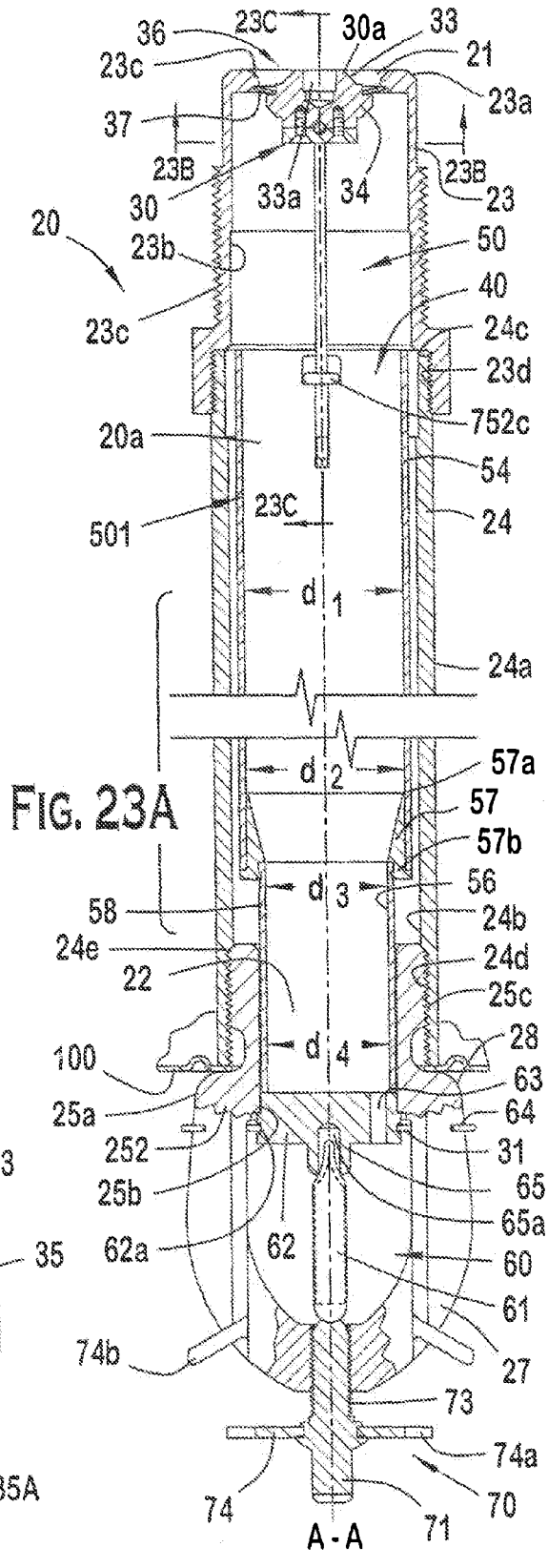
FIG. 23A
FIG. 23B
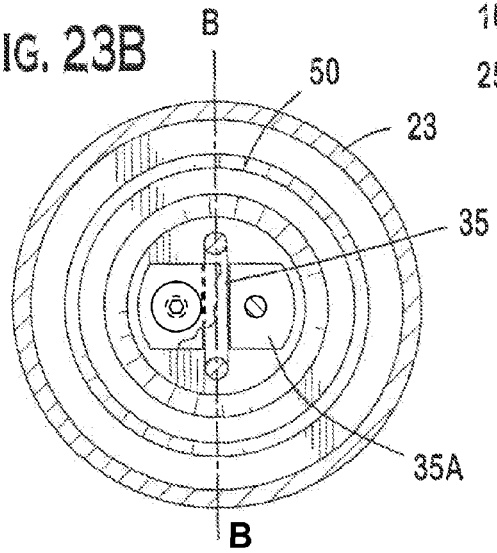

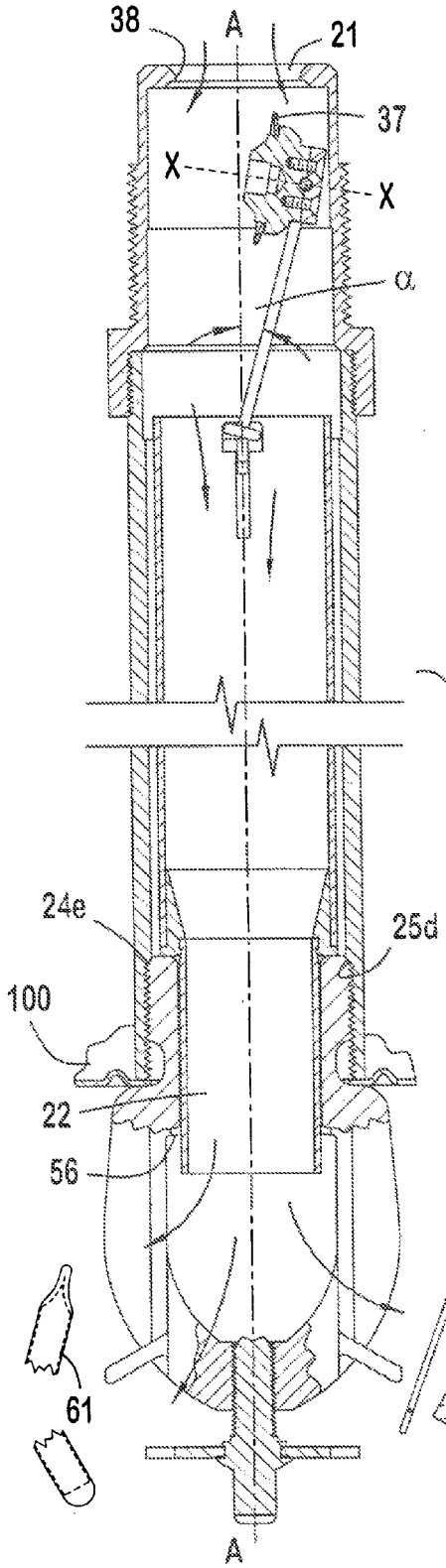
FIG. 23C
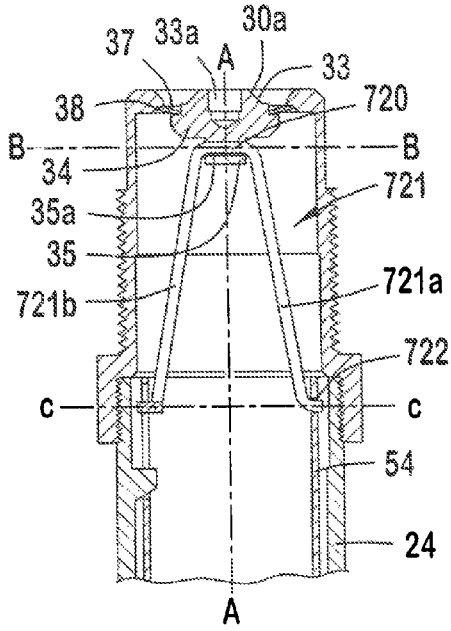
FIG. 23D
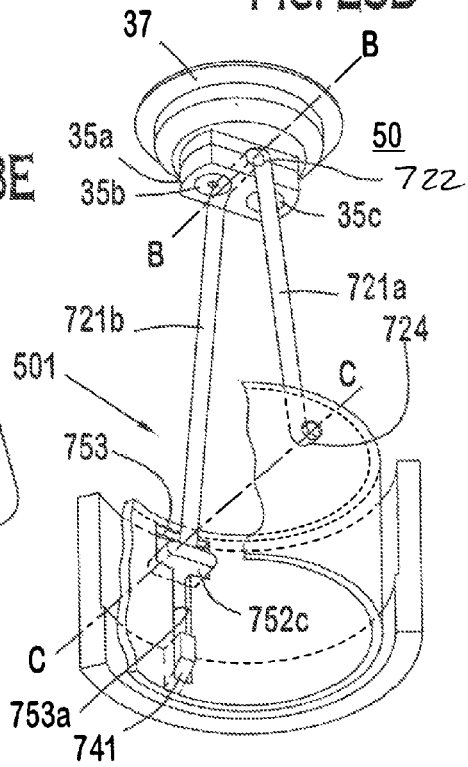
FIG. 23E
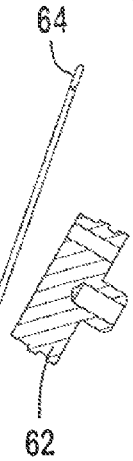

DRY SPRINKLER

PRIORITY

This application is a continuation of U.S. patent application Ser. No. 12/369,716, filed Feb. 11, 2009, which is a continuation of Ser. No. 10/622,631, filed Jul. 21, 2003 (now U.S. Pat. No. 7,516,800), which claims the benefits of priority under 35 U.S.C. §119 of the following United States Provisional patent applications: Provisional Patent application Ser. No. 60/396,727 filed on 19 Jul. 2002, entitled, Dry Sprinkler; Provisional Patent application Ser. No. 60/427,214 filed on 19 Nov. 2002, entitled Dry Sprinkler With a Contact Member to Assist Movement of a Closure Member; Provisional Patent application Ser. No. 60/432,998 filed on 13 Dec. 2002, entitled Dry Sprinkler With a Contact Member to Assist Rotation of a Closure Assembly; Provisional Patent application Ser. No. 60/432,995 filed on 13 Dec. 2002, entitled Dry Sprinkler With a Contact Bar to Assist Rotation of a Closure Assembly; Provisional Patent application Ser. No. 60/432,996 filed on 13 Dec. 2002, entitled Dry Sprinkler with Bearing to Assist Rotation of a Closure Assembly; Provisional Patent application Ser. No. 60/433,611 filed on 16 Dec. 2002, entitled Dry Sprinkler With Resilient C-clip to Assist Rotation of a Closure Assembly; Provisional Patent application Ser. No. 60/432,999 filed on 13 Dec. 2002, entitled Dry Sprinkler With an Offset Contact Edge to Assist Rotation of a Closure Assembly; Provisional Patent application Ser. No. 60/433,582, filed on 16 Dec. 2002, entitled Dry Sprinkler With a Closure Assembly Having a Separable Seal; Provisional Patent application Ser. No. 60/432,997 filed on 13 Dec. 2002, entitled Dry Sprinkler With a Rolling Contact Member to Assist Rotation of a Closure Assembly; Provisional Patent application Ser. No. 60/432,984 filed on 13 Dec. 2002, entitled Dry Sprinkler With a Closure Assembly Having a High Center of Gravity to Assist Rotation of the Closure Assembly; Provisional Patent application Ser. No. 60/432,985 filed on 13 Dec. 2002, entitled Dry Sprinkler With a Closure Assembly Having an Off-Set High Center of Gravity to Assist Rotation of the Closure Assembly; Provisional Patent application Ser. No. 60/432,983 filed on 13 Dec. 2002, entitled Dry Sprinkler With a Cord to Assist Movement of A Closure Assembly; Provisional Patent application Ser. No. 60/432,982 filed on 13 Dec. 2002, entitled Dry Sprinkler With a Compression Spring to Assist Movement of a Closure Assembly; Provisional Patent application Ser. No. 60/433,001 filed on 13 Dec. 2002, entitled Dry Sprinkler With a Tension Spring to Assist Movement of a Closure Assembly; Provisional Patent application Ser. No. 60/433,004 filed on 13 Dec. 2002, entitled Dry Sprinkler With a Strap Assembly to Assist Movement of a Closure Assembly; Provisional Patent application Ser. No. 60/433,002 filed on 13 Dec. 2002, entitled Dry Sprinkler With a Strap to Assist Rotation of a Closure Assembly; Provisional Patent application Ser. No. 60/433,003 filed on 13 Dec. 2002, entitled Dry Sprinkler with a Pivotal Fixed Leg Member to Assist Rotation of a Closure Assembly; Provisional Patent Application Ser. No. 60/432,994 filed on 13 Dec. 2002, entitled A Dry Sprinkler With A Pivotal Non-Fixed Leg Member To Assist Rotation Of A Closure Assembly; Provisional Patent application Ser. No. 60/433,610 filed on 16 Dec. 2002, entitled Dry Sprinkler with a Pivotal Member to Assist Rotation of a Closure Assembly; Provisional Patent application Ser. No. 60/433,599 filed on 16 Dec. 2002, entitled Dry Sprinkler With a Kicker to Assist Rotation of a Closure Assembly; Provisional Patent application Ser. No. 60/433,605 filed on 16 Dec. 2002, entitled Dry Sprinkler with a Flow Obstruction Member to Assist Rotation of the Closure Assembly; Provisional Patent application Ser. No. 60/433,612 filed on 16 Dec. 2002, entitled Dry Sprinkler with an Offset Flow Path to Assist Rotation of the Closure Assembly; and Provisional Patent application Ser. No. 60/433,005 filed on 13 Dec. 2002, entitled Dry Sprinkler with a Movable Seal and Kicker to Assist Rotation of a Closure Assembly, which Provisional patent applications are incorporated by reference in their entireties into this application.

BACKGROUND OF THE INVENTION

An automatic sprinkler system is one of the most widely used devices for fire protection. These systems have sprinklers that are activated once the ambient temperature in an environment, such as a room or building exceeds a predetermined value. Once activated, the sprinklers distribute fire-extinguishing fluid, preferably water, in the room or building. A sprinkler system is considered effective if it extinguishes or prevents growth of a fire. Failures of such systems may occur when the system has been rendered inoperative during building alternation or disuse, or the occupancy hazard has been increased beyond initial system capability.

The water supply for a sprinkler system may be separate from that used by a fire department. An underground main for the sprinkler system enters the building to supply a riser. Connected at the riser are valves, meters, and, preferably, an alarm to sound when water flow within the system exceeds a predetermined minimum. At the top of a vertical riser, a horizontally disposed array of pipes extends throughout the fire compartment in the building. Other risers may feed distribution networks to systems in adjacent fire compartments. Compartmentalization can divide a large building horizontally, on a single floor, and, vertically, floor to floor. Thus, several sprinkler systems may serve one building.

In the piping distribution network, branch lines carry the sprinklers. A sprinkler may extend up from a branch line, placing the sprinkler relatively close to the ceiling, or a sprinkler can be pendant below the branch line. For use with concealed piping, a flush-mounted pendant sprinkler may extend only slightly below the ceiling.

Water for fighting a fire can be provided to the sprinklers in various configurations. In a wet-pipe system, for buildings having heated spaces for piping branch lines, all the system pipes contain water for immediate release through any sprinkler that is activated. In a dry-pipe system, which may include pipes, risers, and feed mains, disposed in unheated open areas, cold rooms, passageways, or other areas exposed to freezing temperatures, such as unheated buildings in freezing climates or cold-storage rooms, branch lines and other distribution pipes may contain a dry gas (air or nitrogen) under pressure. This pressure of gas holds closed a dry pipe valve at the riser. When heat from a fire activates a sprinkler, the gas escapes and the dry-pipe valve trips, water enters branch lines, and fire fighting begins as the sprinkler distributes the water.

Dry sprinklers are used where the sprinklers may be exposed to freezing temperatures. A dry sprinkler may include a threaded inlet containing a closure assembly, some length of tubing connected to the threaded inlet, and a fluid deflecting structure located at the other end of the tubing. There may also be a mechanism that connects the thermally responsive component to the closure assembly. The threaded inlet is preferably secured to a branch line. Depending on the particular installation, the branch line may be filled with fluid (wet pipe system) or be filled with a gas (dry pipe system). In either installation, the medium within the branch line is generally excluded from the tubing of the dry sprinkler via the closure assembly until activation of the thermally responsive component. In some dry sprinklers, when the thermally responsive component releases, the closure assembly or portions of the mechanism may be expelled from the tubing of the dry sprinkler by water pressure and gravity. In other types of dry sprinklers, the closure assembly is pivotally mounted to a movable mechanism that is a tube structure, and the closure assembly is designed to pivot on a pin pivot axis transverse to the longitudinal axis of the dry sprinkler, while the tube structure is maintained within the tubing of the dry sprinkler.

In known dry sprinklers, a metallic disc annulus has been provided as a component of a closure assembly to seal the inlet of the dry sprinkler. The metallic disc annulus has a face disposed about a central axis between an inner perimeter and outer perimeter. When the dry sprinkler is in an unactuated condition, the central axis of the metallic disc annulus is generally parallel and aligned with the longitudinal axis of the tubing. Upon actuation of the dry sprinkler, the metallic disc annulus provides an axial thrust force to assist in the movement of the closure assembly along the longitudinal axis of the tubing.

In order to utilize the metallic disc annulus, an arrangement of components is provided within the known dry sprinklers. This arrangement of components positions the metallic disc annulus within the passageway defined by the tube structure to prohibit and allow fluid flow through the dry sprinkler. The metallic disc annulus is positioned at the inlet to provide a seal of the inlet, and within the passageway to permit flow through the dry sprinkler. When the metallic disc annulus is positioned to occlude the inlet, the arrangement of components orients the central axis of the metallic disc annulus generally parallel to and aligned with the longitudinal axis. When the metallic disc annulus is positioned within the passage to allow flow through the outlet of the dry sprinkler, the arrangement of components translates the metallic disc annulus along the passageway.

Although the known dry sprinklers have employed a metallic disc annulus to utilize the axial thrust that it creates to translate the closure assembly within the passageway, the arrangement of components, including the metallic disc annulus, has been found to be inadequate for the performance of the dry sprinkler. Specifically, the inventors have discovered that the known arrangements of components translate the metallic disc annulus along the passageway, however, these arrangements of components appear to maintain an orientation of the central axis of the metallic disc annulus along the longitudinal axis of the dry sprinkler such that the known dry sprinklers fail to achieve their expected performance.

In particular, the inventors have discovered that the known dry sprinklers fail to provide a flow rate at an expected level of tolerance based on the discharge coefficient for which the known sprinklers purport to provide at various pressures provided to the inlet prior to actuation of the dry sprinkler (i.e., start pressures) between 0 and 175 psig. That is, as these known dry sprinklers are rated for a particular discharge coefficient, which is specified as a rated K-factor, the known dry sprinklers should provide an expected flow rate based on the rated K-factor. Here, the rated K-factor defines the expected flow of fluid in gallons per minute from an outlet of the dry sprinkler divided by the square root of the pressure of the flow of fluid fed into the inlet of the dry sprinkler in pounds per square inch gauge. Based on the rated K-factor, the known dry sprinklers should provide the expected flow rate from an outlet of the known dry sprinklers within an acceptable tolerance level when a specified pressure of fluid flow is applied to the inlet of the known dry sprinklers. The known dry sprinklers, however, provide an actual flow rate from the outlet at less than an acceptable tolerance level. Thus, the known dry sprinklers fail to provide an arrangement of components that allow for the metallic disc annulus to translate along the passageway into an orientation where the central axis of the metallic disc annulus is skewed to the longitudinal axis within the passageway so that a flow of fluid in gallons per minute from the outlet of the structure is at an acceptable level, such as at least 95 percent of the rated K-factor multiplied by the square root of the pressure of the flow of fluid fed into the inlet of the structure in pounds per square inch gauge.

SUMMARY OF INVENTION

The present invention provides a dry sprinkler for a fire protection system. The present invention allows a dry sprinkler to operate over a range of start pressures for a rated K-factor. The present invention provides an operative dry sprinkler by maintaining a positive seal while the dry sprinkler is in a standby, i.e., unactuated mode, and by changing an orientation of a metallic disc annulus when a heat responsive trigger actuates the dry sprinkler.

According to another preferred embodiment, the present invention provides a dry sprinkler that includes a structure, a fluid deflecting structure, a locator and a metallic disc annulus. The structure defines a passageway extending along a longitudinal axis between an inlet and an outlet. The structure has a rated K-factor. The rated K-factor defines an expected flow of fluid in gallons per minute from the outlet divided by the square root of the pressure of the flow of fluid fed into the inlet of the passageway in pounds per square inch gauge. The fluid deflecting assembly is disposed proximate the outlet. The locator is movable along the longitudinal axis between a first position and a second position. The metallic disc annulus has a face disposed about a central axis between an inner perimeter and an outer perimeter. The outer perimeter contacts the structure so that the face occludes a flow of fluid through the passageway when the locator is proximate the first position. The metallic disc annulus is arranged with the central axis of the face being skewed from the longitudinal axis within the passageway when the locator is proximate the second position so that a flow of fluid in gallons per minute from the outlet of the structure is at least 95 percent of the rated K-factor multiplied by the square root of the pressure of the flow of fluid fed into the inlet of the structure in pounds per square inch gauge.

According to another preferred embodiment, the present invention provides a dry sprinkler with a locator. The locator includes a closure body having a base portion connected to a yoke. The yoke has first, second and third wall portions. The first and second wall portions are symmetric to a yoke axis. The third wall portion has a surface with a radius of curvature connecting the first and second wall portions such that the yoke axis is offset to the longitudinal axis when the locator is in the second position to permit fluid flow through the dry sprinkler.

According to another preferred embodiment, the present invention provides a dry sprinkler with a structure having a passageway extending along a longitudinal axis between an inlet and an outlet. The dry sprinkler includes a locator and a member. The member contacts at least one of the locator and a metallic disc annulus to translate a face of the metallic disc annulus to a side of the longitudinal axis when the locator moves from a first position toward a second position in the passageway. The member can be one of a torsion spring, helical coil spring, tension spring, tether, or crank arm.

According to another preferred embodiment, the present invention provides a dry sprinkler with a structure having a passageway extending along a longitudinal axis between an inlet and an outlet. The dry sprinkler includes a locator and a projection extending from the inner surface of the structure. The projection has a free end located in the passageway. The free end contacts at least one of the locator and metallic disc annulus to translate a face of a metallic disc annulus to a side of the longitudinal axis when the locator moves from a first position towards a second position so as to permit a flow of fluid through the passageway between the inlet and outlet.

According to another preferred embodiment, the present invention provides a dry sprinkler with a structure having a passageway extending along a longitudinal axis between an inlet and an outlet. The dry sprinkler includes a locator and a member. The member extends across the passageway and connects to the inner surface of the structure at a plurality of points of the inner surface of the structure. The member contacts at least one of the locator and a metallic disc annulus to translate a face of the annulus to a side of the longitudinal axis when the locator moves from a first position towards a second position in the passageway.

According to another preferred embodiment, the present invention provides a dry sprinkler with a structure having a passageway extending along a longitudinal axis between an inlet and an outlet. The dry sprinkler includes a locator disposed in the passageway. The structure includes a tubular member disposed about the longitudinal axis. The tubular member has an inner surface and an outer surface surrounding the inner surface. The tubular member includes a pair of bearings disposed between spaced points on the tubular member. Each of the bearings has a bearing surface extending along the longitudinal axis between the inner and outer surfaces. The dry sprinkler also has a member extending through a portion of the locator proximate the inlet. The member is movable along the longitudinal axis on the bearing surface of the structure to translate a face of a metallic disc annulus to a side of the longitudinal axis when the locator moves from a first position towards a second position in the passageway.

According to another preferred embodiment, the present invention provides a dry sprinkler with a structure having a passageway extending along a longitudinal axis between an inlet and an outlet. The dry sprinkler includes a locator disposed in the passageway. The structure includes a groove formed in the inner surface of the passageway about the longitudinal axis proximate the inlet. The dry sprinkler also has a resilient arcuate member that connects to the groove to form a pivot so that a face of a metallic disc annulus is movable about the longitudinal axis to permit a flow of fluid through the passageway between the inlet and outlet when the locator moves from a first position towards a second position in the passageway.

According to another preferred embodiment, the present invention provides a dry sprinkler with a locator. The locator includes an elongate member and a closure body configured to support the metallic disc annulus. The elongate member has an edge proximate the inlet. The edge supports the closure body on a line contact offset to the longitudinal axis such that the face of the metallic disc annulus translates to a position on a side of the longitudinal axis when the locator moves between the first and second position.

According to another preferred embodiment, the present invention provides a dry sprinkler with a structure having a passageway extending along a longitudinal axis between an inlet and an outlet. The dry sprinkler includes a locator disposed in the passageway. The locator includes a closure body having a disc support surface supporting the metallic disc annulus. The dry sprinkler has a structure that includes a projection extending from the inner surface of the structure towards the longitudinal axis in a passageway extending between the inlet and outlet. The projection has a free end located in the passageway. The free end contacts the metallic disc annulus to separate the metallic disc annulus from the closure body such that the closure body falls in the passageway proximate the outlet when the locator moves from a first position towards a second position in the passageway.

According to another preferred embodiment, the present invention provides a dry sprinkler with a structure having a passageway extending along a longitudinal axis between an inlet and an outlet. The dry sprinkler includes a locator disposed in the passageway. The locator includes a closure body and an elongate member extending along a longitudinal axis. The closure body has a first surface provided with a first radius of curvature facing the outlet of the dry sprinkler. The elongate member has a second surface providing a second radius of curvature, which faces the inlet of the dry sprinkler and supports the first surface so that the first surface rotates on the second surface when the locator moves from a first position towards a second position in the dry sprinkler.

According to another preferred embodiment, the present invention provides a dry sprinkler with a structure having a passageway extending along a longitudinal axis between an inlet and an outlet. The dry sprinkler includes a locator disposed in the passageway. The inlet includes a sealing surface disposed about the longitudinal axis proximate the inlet. The locator includes a top portion extending toward the inlet past the sealing surface with a center of mass of the locator in a first position relative to the structure of the sprinkler. The center of mass is movable by fluid flowing through the inlet so that a face of a metallic disc annulus is moved to a side of the longitudinal axis when the locator moves from the first position towards a second position within the structure.

According to another preferred embodiment, the present invention provides a dry sprinkler with a structure having a passageway extending along a longitudinal axis between an inlet and an outlet. The dry sprinkler includes a locator disposed in the passageway. The inlet includes a sealing surface disposed about the longitudinal axis proximate the inlet. The locator includes a top portion having a chamber extending toward the inlet past the sealing surface in the first position of the locator within the passageway. The chamber can be filled with fluid flowing through the inlet so that the face is moved to a side of the longitudinal axis when the locator moves from the first position towards the second position.

According to another preferred embodiment, the present invention provides a dry sprinkler with a structure having a passageway extending along a longitudinal axis between an inlet and an outlet. The dry sprinkler includes a locator disposed in the passageway. The structure includes a cord connected to the structure by a first attachment device and connected to the locator by a second attachment device such that the cord tethers the locator to the structure to move a face of a metallic disc annulus to a side of the longitudinal axis in the passageway when the locator moves from the first position towards the second position in the passageway.

According to another preferred embodiment, the present invention provides a dry sprinkler with a structure having a passageway extending along a longitudinal axis between an inlet and an outlet. The dry sprinkler includes a locator disposed in the passageway. The locator includes a compression spring extending between a portion of the locator disposed between the inlet and the outlet. The compression spring moves a face of a metallic disc annulus to a side of the longitudinal axis when the locator moves from the first position towards the second position in the passageway.

According to another preferred embodiment, the present invention provides a dry sprinkler with a structure having a passageway extending along a longitudinal axis between an inlet and an outlet. The dry sprinkler includes a locator disposed in the passageway. The locator includes a tension spring extending between a portion of the locator disposed between the inlet and the outlet. The tension spring moves a face of a metallic disc annulus to a side of the longitudinal axis when the locator moves from the first position towards the second position in the passageway.

According to another preferred embodiment, the present invention provides a dry sprinkler with a structure having a passageway extending along a longitudinal axis between an inlet and an outlet. The dry sprinkler includes a locator disposed in the passageway. The structure includes a spring seat and a compression spring disposed within the passageway proximate the inlet. The spring biases the locator to move along the longitudinal axis relative to the structure. The locator includes a closure body having a first pivot and a second pivot spaced from the first pivot with a first strap and a second strap. The first strap has a first length connected to the first pivot and first end of the spring. The second strap has a second length greater than the first length connected to the second pivot and second end of the spring. The second strap cooperates with the first strap to move the face of the annulus to a side of the longitudinal axis when the locator moves from the first position towards the second position.

According to another preferred embodiment, the present invention provides a dry sprinkler with a structure having a passageway extending along a longitudinal axis between an inlet and outlet. The dry sprinkler includes a locator disposed in the passageway. The structure includes a compression spring disposed in the passageway proximate the inlet. The locator includes at least one elongate member supporting a closure body. The closure body has a pivot with a strap connected to the pivot and a coil of the compression spring. The strap is movable between a first strap position where the strap is spaced from the at least one elongate member and a second strap position where the strap engages the at least one elongate member to move the face of the annulus to a first side of the longitudinal axis when the locator moves from the first position towards the second position.

According to another preferred embodiment, the present invention provides a dry sprinkler with a structure having a passageway extending along a longitudinal axis between an inlet and an outlet. The dry sprinkler includes a locator disposed in the passageway. The locator includes first, second, and third bearings. The first and second bearings are formed on a tubular member of the locator and the third bearing is formed on a portion of the locator proximate the inlet. The portion of the locator includes a throw journal located between first and second main journals. The first main journal is disposed within the first bearing, the second main journal is disposed within the second bearing, and the throw journal is disposed within the third beating. The portion of the locator cooperates with the tubular member and with the metallic disc annulus to move a face of a metallic disc annulus to a side of the longitudinal axis when the locator moves from the first position towards the second position.

According to another preferred embodiment, the present invention provides a dry sprinkler with a structure having a passageway extending along a longitudinal axis between an inlet and an outlet. The dry sprinkler includes a locator disposed in the passageway. The locator includes first, second, and third bearings. The first and second bearings are formed on a tubular member of the locator and the third bearing is formed on a portion of the locator proximate the inlet. The portion includes a throw journal located between first and second main journals. The first main journal is disposed within the first bearing, the second main journal is disposed within the second bearing, and the throw journal is in contiguous engagement with a surface of the portion facing the outlet when the locator is proximate the first position. The portion cooperates with the tubular member to move a face of a metallic disc annulus to a side of the longitudinal axis when the locator moves from the first position towards the second position.

According to another preferred embodiment, the present invention provides a dry sprinkler with a structure having a passageway extending along a longitudinal axis between an inlet and an outlet. The dry sprinkler includes a locator disposed in the passageway. The locator includes a support member having a plurality of apertures and a first contact area generally orthogonal to the longitudinal axis. The plurality of apertures perforates the support member is spaced from the longitudinal axis. The first contact area is coincident with the longitudinal axis. A bar is provided between a first end engaging the first contact area of the support member and a second end engaging a portion of the locator proximate the inlet when the locator is proximate the first position in the passageway.

According to another preferred embodiment, the present invention provides a dry sprinkler with a structure having a passageway extending along a longitudinal axis between an inlet and an outlet. The dry sprinkler includes a locator disposed in the passageway. The locator includes a dislodgment member and a support member generally orthogonal to the longitudinal axis. The support member has a contact surface, a post, and a dislodgment aperture. The support member is spaced from the longitudinal axis and the contact surface being coincident with the longitudinal axis. The support member supports the post and a portion of the locator proximate the inlet. The dislodgment member includes a base and a projection. The base is supported by the inner surface of the structure with a projection extending from the base toward the inlet. The projection is aligned with and spaced from the dislodgment aperture when the locator is proximate the first position. The projection penetrates the dislodgment aperture and displaces the post when the locator moves from the first position towards the second position in the passageway.

According to another preferred embodiment, the present invention provides a dry sprinkler with a structure having a passageway extending along a longitudinal axis between an inlet and an outlet. The dry sprinkler includes a locator disposed in the passageway. The locator includes a projection extending away from the longitudinal axis in the passageway so that the projection obstructs a flow of fluid on one side of the longitudinal axis in the passageway. The obstruction of flow translates a face of a metallic disc annulus to a side of the longitudinal axis via fluid flowing around the projection when the locator is moving from a first position to a second position in the passageway.

According to another preferred embodiment, the present invention provides a dry sprinkler with a structure having a passageway extending along a longitudinal axis between an inlet and an outlet. The structure includes a first fluid flow area symmetrical about the longitudinal axis proximate the inlet and a second fluid flow area asymmetrical about the longitudinal axis spaced between the first flow area and the outlet. The second fluid flow area being greater than the first fluid flow area such that when a pressure differential between the first flow area and the second flow area is provided, a metallic disc annulus is translated proximate the asymmetrical flow area.

According to another preferred embodiment, the present invention provides a dry sprinkler with a structure having a passageway extending along a longitudinal axis between an inlet and an outlet. The dry sprinkler includes a locator disposed in the passageway. The structure includes a tubular outer structure surrounding a tubular member of the locator. The tubular outer structure has a projection extending toward the longitudinal axis. The projection includes a first bearing diametrically spaced apart from an aperture extending through a surface of the tubular member of the locator. The aperture has a groove extending along the longitudinal axis so that the locator is guided by the projection of the tubular outer structure along the longitudinal axis. The locator includes a closure body having a central journal located between a main journal and an impact shoe. The main journal is disposed within the first bearing, the central journal is located in a second bearing of the closure body, and the impact shoe is disposed within the aperture. The impact shoe of the closure body cooperates with the projection to move a portion of a face of a metallic disc annulus to a side of the longitudinal axis when the locator moves from the first position towards the second position in the passageway.

According to another preferred embodiment, the present invention provides a dry sprinkler that includes a structure, fluid deflecting structure, metallic disc annulus, and means for repositioning the metallic disc annulus. The means reposition the metallic disc annulus from a position that prevents flow to another position that prohibits flow therethrough. The structure defines a passageway extending along a longitudinal axis between an inlet and an outlet. The structure has a rated K-factor. The rated K-factor defines an expected flow of fluid in gallons per minute from the outlet divided by the square root of the pressure of the flow of fluid fed into the inlet of the passageway in pounds per square inch gauge. The fluid deflecting assembly is disposed proximate the outlet. The metallic disc annulus has a face disposed about a central axis between an inner perimeter and an outer perimeter. The outer perimeter contacts the structure so that the face occludes a flow of fluid through the passageway when the locator is proximate the first position. The means reposition the central axis of the face to be skewed to the longitudinal axis within the passageway so that a flow of fluid in gallons per minute from the outlet of the structure is at least 95 percent of the rated K-factor multiplied by the square root of the pressure of the flow of fluid fed into the inlet of the structure in pounds per square inch gauge.

A method of operating a dry sprinkler is also provided. The dry sprinkler has a structure extending along a longitudinal axis between an inlet and an outlet. The structure includes a rated K-factor representing a flow of fluid from the outlet of the structure in gallons per minute divided by the square root of the pressure of the fluid fed into the inlet of the structure in pounds per square inch gauge. The method can be achieved by locating a metallic disc annulus so that its central axis is skewed with respect to the longitudinal axis; and verifying that a rate of water flow from the outlet is approximately equal to 95 percent of the rated K-factor of the structure multiplied by the square root of the pressure of water in psig fed to the inlet of the structure for each start pressure provided to the inlet prior to an actuation of the dry sprinkler at between approximately 0 to 175 psig.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

FIGS. 3A-3F illustrate a third preferred embodiment of the dry sprinkler.

FIGS. 4A-4E illustrate a fourth preferred embodiment of the dry sprinkler.

FIGS. 5A-5F illustrate a fifth preferred embodiment of the dry sprinkler.

FIGS. 6A-6F illustrate a sixth preferred embodiment of the dry sprinkler.

FIGS. 7A-7E illustrate a seventh preferred embodiment of the dry sprinkler.

FIGS. 8A-8F illustrate an eighth preferred embodiment of the dry sprinkler.

FIGS. 9A-9E illustrate a ninth preferred embodiment of the dry sprinkler.

FIGS. 10A-10E illustrate a tenth preferred embodiment of the dry sprinkler.

FIGS. 11A-11E illustrate an eleventh preferred embodiment of the dry sprinkler.

FIGS. 12A-12E illustrate a twelfth preferred embodiment of the dry sprinkler.

FIGS. 13A-13E illustrate a thirteenth preferred embodiment of the dry sprinkler.

FIGS. 14A-14E illustrate a fourteenth preferred embodiment of the dry sprinkler.

FIGS. 15A-15E illustrate a fifteenth preferred embodiment of the dry sprinkler.

FIGS. 16A-16E illustrate a sixteenth preferred embodiment of the dry sprinkler.

FIGS. 17A-17I illustrate a seventeenth preferred embodiment of the dry sprinkler.

FIGS. 18A-18I illustrate an eighteenth preferred embodiment of the dry sprinkler.

FIGS. 19A-19E illustrate a nineteenth preferred embodiment of the dry sprinkler.

FIGS. 20A-20F illustrate a twentieth preferred embodiment of the dry sprinkler.

FIGS. 21A-21I illustrate a twenty-first preferred embodiment of the dry sprinkler.

FIGS. 22A-22E illustrate a twenty-second preferred embodiment of the dry sprinkler.

FIGS. 23A-23I illustrate a twenty-third preferred embodiment of the dry sprinkler.

DETAILED DESCRIPTION OF THE PREFERRED EMBODIMENTS

Figure 1A:
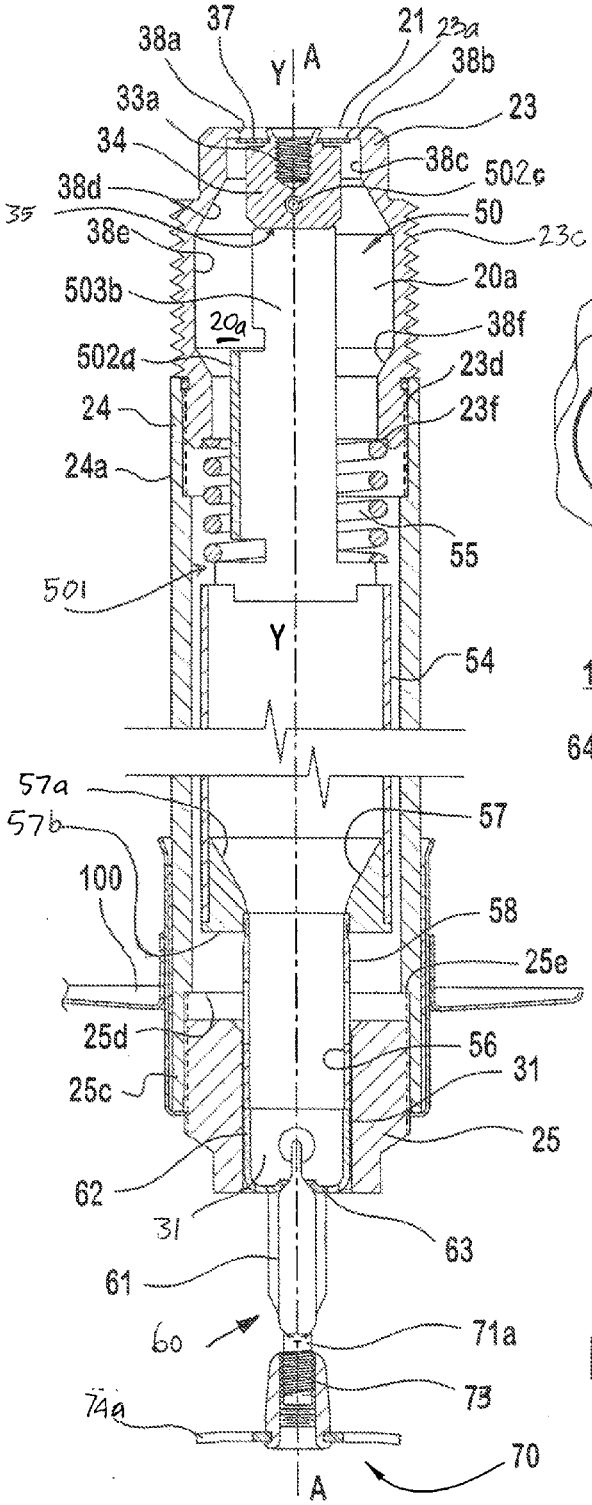
FIGS. 1A-1D illustrate a first preferred embodiment of the dry sprinkler.

As installed, a sprinkler is coupled to a piping network (not shown), which is supplied with a fire fighting fluid, e.g., a water from a pressurized supply source. The preferred embodiments include dry sprinklers that are suitable for use such as, for example, with a dry pipe system (e.g. that is the entire system is exposed to freezing temperatures in an unheated portion of a building) or a wet pipe system (e.g. the sprinkler extends into an unheated portion of a building). Pipe systems may be installed in accordance with National Fire Protection Association Standard for the Installation of Sprinkler Systems, NFPA 13 (2002 edition), which is hereby incorporated by reference herein in its entirety.

FIGS. 1-23 illustrate preferred embodiments of a dry sprinkler 10. Each of the preferred embodiments is described with reference to the corresponding figure number with appropriate alphanumeric identifiers so that a description of one component with the same reference numeral in one preferred embodiment is applicable to another component with the same reference numeral in another preferred embodiment. For example, referring to any one of FIGS. 1-23 with the alphanumeric suffix "A", the dry sprinkler 10 includes an outer structure assembly 20, outlet frame (25,251,252), locator 50, trigger assembly 60, and fluid deflecting structure 70. The locator 50 includes a closure assembly 30 and an inner assembly 501. The sprinkler 10 can be mounted through a holder or escutcheon 100 as shown in a perspective view of FIG. 1D. The outer structure assembly 20 defines a passageway 20*a* that extends along a longitudinal axis A-A between an inlet 21 and an outlet 22. The longitudinal axis A-A can be a central axis of the geometric center of the outer structure with a generally constant cross-sectional area over an axial length along the longitudinal axis of the structure.

The casing tube 24 can be coupled to inlet fitting 23 and outlet frame (25,251,252) by any suitable technique, such as, for example, thread connections, crimping, bonding, welding, or by a pin and groove. The inlet fitting 23 has an outer inlet fitting surface 23*a* and an inner inlet fitting surface 23*b*. The surface 23*a* cinctures part of the passageway 20*a* to define an entrance surface 38*a* and inlet sealing surface 38*b*. In one preferred embodiment, the entrance surface 38*a* can include a convex profile that forms a convergently curved surface intersecting a generally planar surface of the inlet sealing surface 38*b*.

According to one configuration of the inlet, the outer inlet fitting surface 23*a* has fitting threads 23*c* formed near the inlet 21, and the inner inlet fitting surface 23*b* has first coupling threads 23*d* formed proximate the other end of the inlet fitting 23. The fitting threads 23*c* are used for coupling the dry sprinkler to the piping network, and the inlet fitting 23 has an inlet opening 38*a*. The inlet fitting 23*a* can be provided with at least one of ¾ inch, 1 inch, 1.25 inch NPT and 7-1 ISO (Metric) threads formed thereon.

The inlet fitting 23 can have four different internal surface configurations proximate the entrance surface 38*a*, however, any suitable configuration may be employed. Each of the configurations of the inlet can be utilized in each of the preferred embodiments of the dry sprinkler. In the first internal surface configuration, as exemplified in FIG. 1A, the entrance surface 38*a* intersects the sealing surface 38*b*. The entrance surface 38*a* can be a frustoconical surface disposed about the longitudinal axis that has, in a cross-sectional view, a linear profile converging towards the longitudinal axis A-A. Alternatively, the entrance surface 38*a* can be a surface disposed about the longitudinal axis that has, in a cross-sectional view, a curved profile converging towards the longitudinal axis A-A. The sealing surface 38*b* intersects a surface 38*c* extending generally parallel to the longitudinal axis A-A. The surface 38*c* intersects a surface 38*d* diverging away from the longitudinal axis A-A. The diverging surface 38*d* intersects a cylindrical surface 38*e*, which intersects a surface 38*f* converging towards the longitudinal axis. The surface 38*f* intersects surface 38*g* extending generally parallel to the longitudinal axis. In the second internal surface configuration, as exemplified in FIG. 2A, the entrance surface 38*a* forms a bell mouth surface that intersects a sealing surface 38*b*. Sealing surface 38*b* intersects surface 38*c* which, in this configuration, diverges away from the longitudinal axis A-A instead of extending parallel therefrom as is the case for surface 38*c* of FIG. 1A. Diverging surface 38*c* intersects surface 38*d* which, in this configuration, extends generally parallel to the longitudinal axis instead of diverging away therefrom as is the case for surface 38*d* of FIG. 1A.

The outer structure assembly 20 includes the inlet fitting 23 coupled to a casing tube 24, and an outlet frame (25,251,252) coupled to the casing tube 24. As illustrated in a cross-sectional view of FIG. 3A, the entrance surface 38*a* roans a convex profile that intersects a sealing surface 38*b*. Similar to the second internal surface configuration, sealing surface 38*b* intersects surface 38*c*, which, in this configuration, diverges away from the longitudinal axis A-A. Diverging surface 38*c*, however, intersects a generally planar surface 38*d* instead of a diverging or parallel surface 38*d* as in the prior two configurations. In the fourth internal surface configuration, as exemplified in FIG. 3A, the sealing surface 38*b* intersects a diverging surface 38*c* that intersects a generally planar surface 38*d*. Planar surface 38*d* intersects a generally cylindrical inner surface 38*e*.

Three connecting configurations of the inlet fitting 23 can be provided, however, other suitable configurations may be utilized. Each of the connecting configurations can be utilized with any of the preferred embodiments of the dry sprinkler. The first connecting configuration (FIG. 1A) has a coil spring seat 23*f* extending along the longitudinal axis A-A whereas the second configuration (FIG. 1B) or third configuration (FIG. 2A or 3A) provides a coil spring seat 23*f* that encloses the coil spring over a longer axial extension along the longitudinal axis A-A. The first connecting configuration provides for a stop surface being formed by a planar surface on the threaded portion 23*c* whereas the second connecting configuration provides for a stop surface being formed by a boss portion separate from the threaded portion 23*c*. The third configuration can include a stop member formed by an end surface of a sleeve 42 (FIG. 3A).

The casing tube 24 has an outer casing tube surface 24*a* and an inner casing tube surface 24*b*, both of which cincture part of the passageway 20*a*. According to the first preferred embodiment, the outer casing tube surface 24*a* has second coupling threads 24*c* formed at one end that cooperatively engage the first coupling threads 23*d* of the inlet fitting 23. The inner casing tube surface 24*b* has third coupling threads 24*d* formed proximate the other end of the casing tube 24. The threads 24*d* terminate at an interior portion 24*e* of the casing tube 24.

According to another configuration of the inlet fitting 23, the casing tube 24, and the outlet frame (25,251,252), at least one of the inlet fitting 23 and the outlet frame (25,251,252) may include a radially projecting boss portion 28. The boss portion 28 provides a stop that limits relative threaded engagement between, for example, the inlet fitting 23 and the piping network, the inlet fitting 23 and the casing tube 24, or the outlet frame (25,251,252) and the casing tube 24.

According to yet another configuration of the inlet fitting 23, the casing tube 24, and the outlet frame (25,251,252), the outer casing tube surface 24*a* of the casing tube 24 has external threads that can be coupled to the piping network, and the inner casing tube surface 24*b* of the casing tube 24 has internal threads. The external threads on the outer casing tube surface 24*a* may be coupled to the piping network, and the internal threads on the inner casing tube surface 24*b* coupled to inlet fitting 23, which provides the inlet opening 38*a*. Alternatively, the inlet fitting 23 and the casing tube can be formed as a unitary member such that thread portion 24*d* is not utilized. For example, the casing tube 24 can extend as a single tube from the inlet 21 to the outlet 22.

Alternatives to the threaded connection to secure the inlet to the casing can also be utilized such as other mechanical coupling techniques, which can include crimping or bonding. Additionally, either of the respective inner and outer surfaces of the inlet fitting 23, casing tube 24, and outlet frame (25, 251,252) may be threaded so long as the mating part is cooperatively threaded on the opposite surface, i.e., threads on an inner surface cooperate with threads on an outer surface.

Figure 1D:
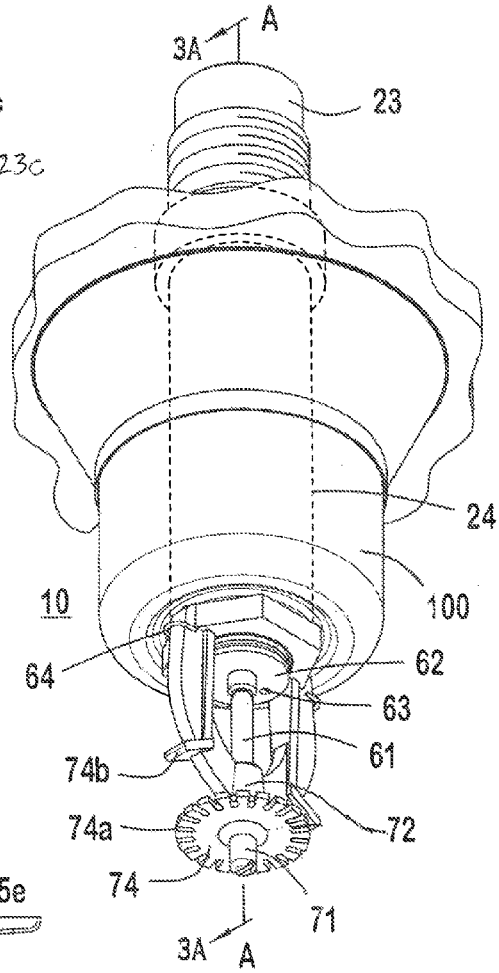
Figures 1B, 1C:
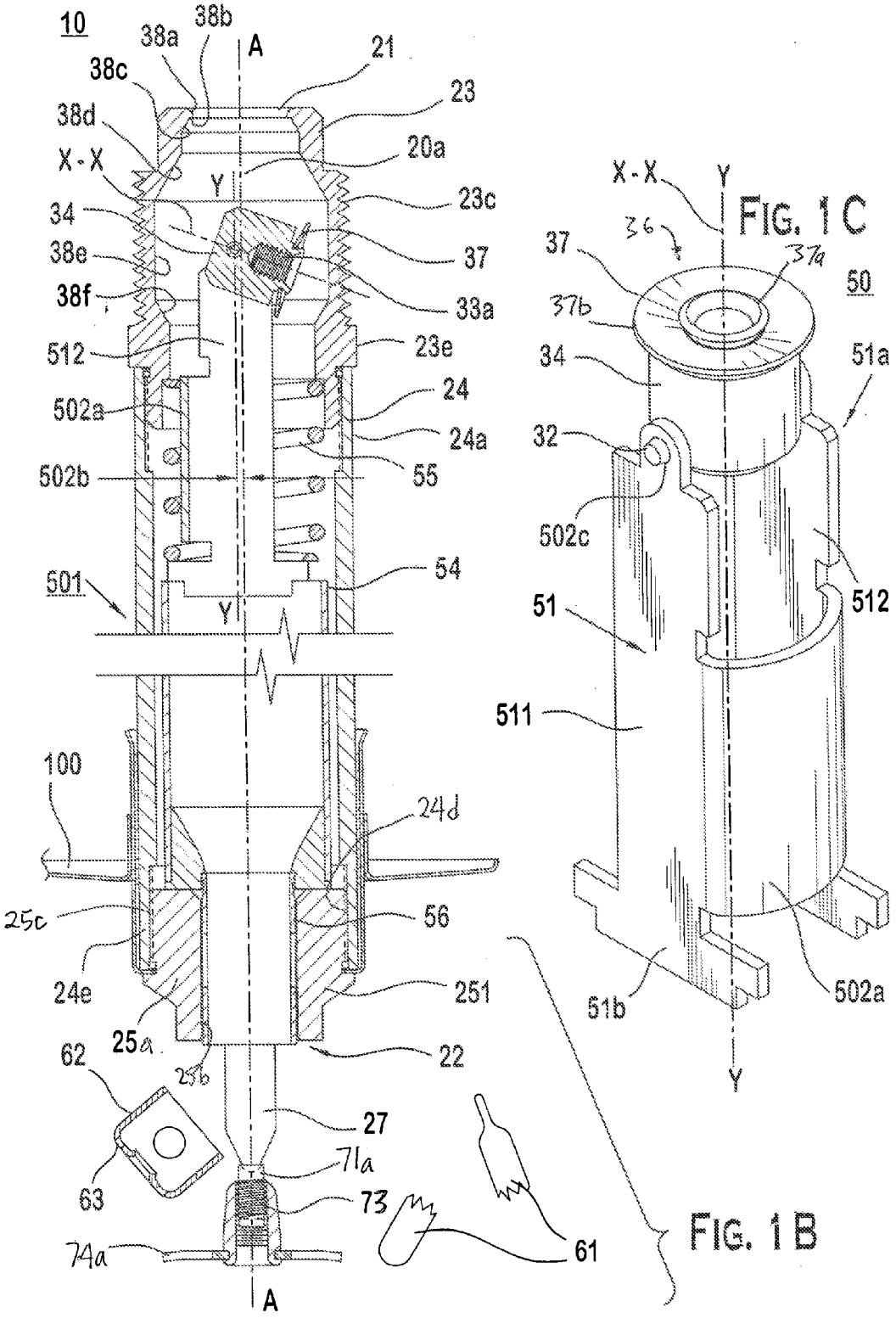
Figure 2A:
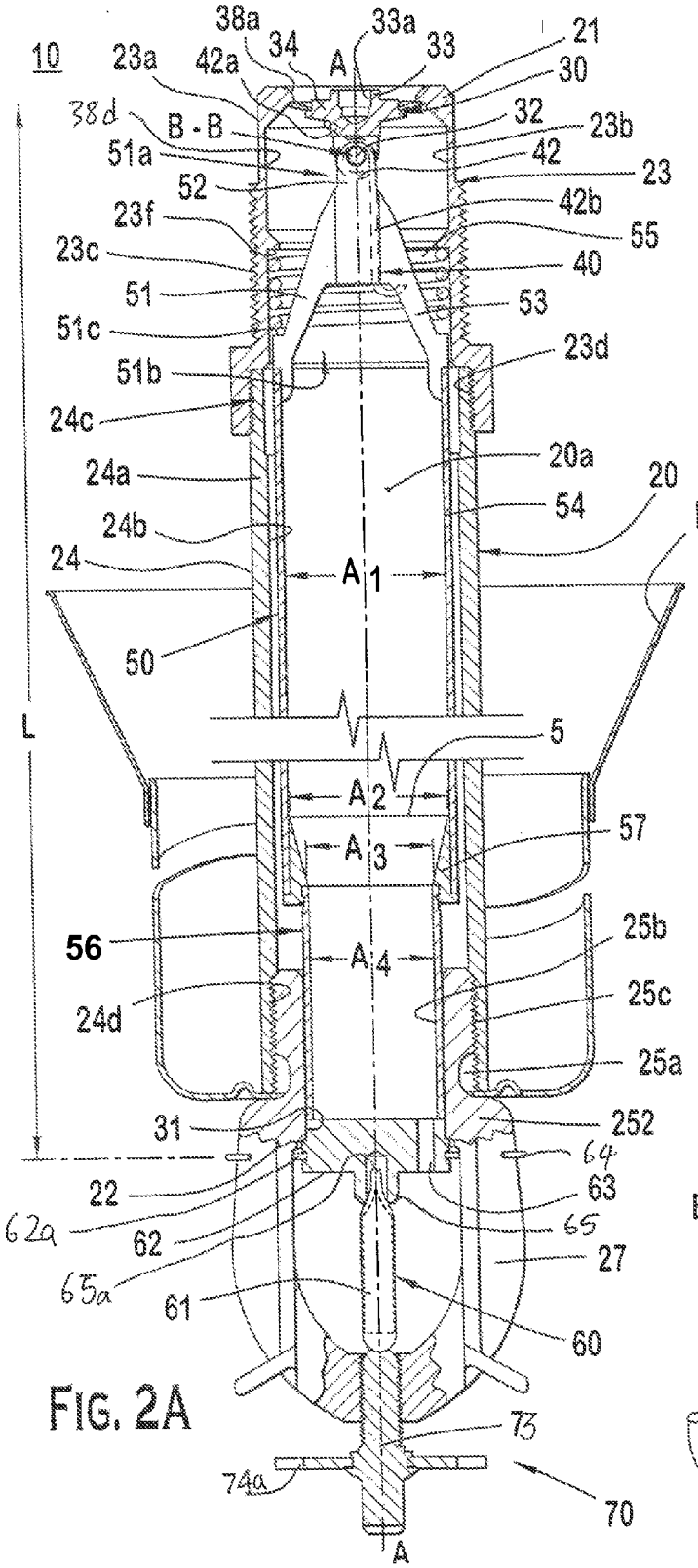
FIGS. 2A-2D illustrate a second preferred embodiment of the dry sprinkler.

Three different configuration of the outlet frame can be used with the dry sprinklers of the preferred embodiments. Any suitable outlet frame, however, may be used so long as the outlet frame positions a fluid deflecting structure proximate the outlet of the dry sprinkler. A first outlet frame 25 is shown in FIG. 1A. A second outlet frame 251 is shown in FIG. 1B. A third outlet frame 252 is shown in FIG. 2A. The outlet frame (25,251,252) has an outer outlet frame surface 25*a* and an inner outlet frame surface 25*b*, which surfaces cincture part of the passageway 20*a*. The outer outlet frame surface 25*a* has fourth coupling threads 25*c* formed proximate one end of the outlet frame (25,251,252) that cooperatively engage the third coupling threads 24*d*. Proximate the threads 25*c* is a terminal end 25*d* that abuts a complementary surface formed on the interior of the casing 24 at interior portion 24*e*. The outlet frame (25,251,252) has an opening 31 so that an annular member, such as a trigger seat 62, can be mounted therein.

The other end of the outlet frame (25,251,252) can include at least two frame arms 27 that are coupled to the fluid deflecting structure 70. Preferably, the outlet frame (25,251,252) and frame arms 27 are formed as a unitary member. The outlet frame (25,251,252), frame arms 27, and fluid deflecting structure 70 can be made from rough or fine casting, and, if desired, machined.

The thermal trigger assembly 60 is disposed proximate to the outlet 22 of the sprinkler 10. The thermal trigger assembly 60 includes a heat/temperature responsive assembly 61. Preferably, the trigger is a frangible bulb 61 that is interposed between a trigger seat 62 and the fluid deflecting structure 70. Alternatively, the trigger itself can be a solder link, or any other suitable heat responsive arrangement instead of a frangible bulb. Instead of a frangible bulb or a solder link, the heat responsive trigger may be any suitable arrangement of components that reacts to the appropriate condition(s) by actuating the dry sprinkler.

The trigger assembly 60 operates to: (1) maintain the inner tubular assembly proximate the first position over the first range of temperatures between about minus 60 degrees Fahrenheit to about just below a temperature rating of the trigger; and (2) permit the inner tubular assembly to move along the longitudinal axis to the second position over a second range of temperatures at or greater than the temperature rating of the trigger. The temperature rating can be a suitable temperature such as, for example, about 135, 155, 175, 200, or 286 degrees Fahrenheit and plus-or-minus (±) 20% of each of the stated values.

The trigger seat 62 can be an annular member with a nub portion 65 formed at one end of the trigger seat 62. The trigger seat 62 may also include a drain port 63. The nub portion 65 has an interior cavity 65*a* configured to receive a terminal end of the frangible bulb 61. The trigger seat 62 has a biasing spring 64 located in a groove 62*a*. The spring 64 is connected to the frame arms 27 of the fluid deflecting structure 70. A spacer (not shown) can be located between the second guide tube portion 58 and the trigger seat 62. The longitudinal thickness of the spacer would be selected to increase the travel of the locator 50 as it moves from the first position to the second position. In particular, the longitudinal thickness of the spacer would be selected to establish a predetermined travel of the locator 50 before the second end 57*b* of the first guide tube portion 57 comes to rest on the outlet frame 25.

The fluid deflecting structure 70 may include an adjustment screw 71 and a planar surface 74 coupled to the frame arms 27 of the outlet frame (25,251,252). The adjustment screw 71 is provided with external threads 73 that can be used to adjust an axial spacing between the trigger seat 62 and the frangible glass bulb 61. The adjustment screw 71 also has a portion screw seat 71*a* that engages the frangible bulb 61. Although the adjustment screw 71 and the planar surface member 74*a* have been described as separate parts, they can be formed as a unitary member.

A generally planar surface member 74 can be coupled to the adjustment screw 71. The planar surface member 74 can be provided with a plurality of tines 74*a* and a plurality of slots, which are disposed in a predetermined periodic pattern about the longitudinal axis A-A so as to deflect the water flow to form an appropriate spray pattern. Instead of a planar surface 74, other configurations could be employed to provide the desired water deflection pattern. Preferably, the member 74 includes a plurality of tines 74*a* disposed equiangularly about the longitudinal axis A-A that cooperates with deflecting arms 74*b* formed on the frame arm 27 to deflect water over a desired coverage area.

Although all of the preferred embodiments of the dry sprinkler 10 are shown in a pendant configuration, other configurations can be used. For example, the dry sprinkler of the preferred embodiments can be configured as an upright or sidewall dry sprinkler. The dry sprinkler 10 can extend for a predetermined length L from, for example, a ceiling, a wall, or a floor of an enclosed area. The length L can be any value, and preferably, between two to fifty inches depending on the application of the sprinkler 10.

To form a seal with the sealing surface 38*b* of the inlet fitting 23, a metallic disc annulus 36 can be used. The metallic disc annulus 36 is a single monolithic member that has a face 37 with an inner perimeter 37*a* and an outer perimeter 37*b* disposed about a central axis X-X. The central axis X-X defines an axis of the metallic disc annulus 36, and more particularly, an axis of the face 37. The face 37 extends continuously between the inner and outer perimeters over different positions along the central axis X-X. Alternatively, the face 37 may have a radius of curvature about the central axis X-X between the inner and outer perimeters. Preferably, the metallic disc annulus 36 is a resilient metallic member that, in its uncompressed state, may have a frustoconical configuration with a base of the frustum facing the inlet, and in a compressed state, has a generally planar configuration with respect to its central axis X-X. The metallic disc annulus can be formed by a suitable resilient material that provides for an appropriate axial force as the metallic disc annulus changes from a compressed to an uncompressed state. The resilient material for the metallic disc annulus can be, for example, stainless steel or beryllium. A coating may be provided on the metallic disc annulus such as, for example, synthetic rubber, Teflon™, or nylon.

The face 37 of the metallic disc annulus 36, in conjunction with the sealing surface 38*b*, can form a seal against fluid pressure proximate the inlet face 38*b* at any start pressure from approximately zero to approximately 175 psig so that the other side of the metallic disc annulus 36 facing the outlet is generally free of fluid. In particular, a start pressure, i.e., an initial pressure present at the inlet when the dry sprinkler is actuated, can be at various start pressures. Preferably, the start pressure is at least 20 pounds per square inch (psig), and, more particular, greater than 100 psig.

Each of the preferred embodiments has a rated discharge coefficient, or rated K-factor, that is at least 5.6, and, can be 8.0, 11.2, 14.0, 16.8, 22.4 or 25.5. However, any suitable value for the K-factor could be provided for the dry sprinkler of the preferred embodiments. As used herein, the discharge coefficient or K-factor is quantified as a flow of fluid, preferably water, from the outlet 22 of the outer structure assembly 20, e.g., in gallons per minute (GPM), divided by the square root of the pressure of the fluid fed into the outer structure assembly 20, e.g., in pounds per square inch gauge (psig). The rated K-factor, or rated discharge coefficient is a mean value. The rated K-factors are expressed in standard sizes, which have an acceptable range, which is approximately five percent or less deviation from the standard value over the range of pressures. For example, a "rated" K-factor of 11.2 encompasses all measured K-factors between 11.0 and 11.5. The K-factors of the preferred embodiment may decrease as the sprinkler length L increases. For example, when L is 48 inches, the K-factor of the dry sprinkler 10 can be reduced from 11.2 to approximately 10.2.

The K-factor allows for an approximation of flow rate to be expected from the outlet of a sprinkler based on the square root of the pressure of fluid fed into the inlet of the sprinkler. In relation to the preferred embodiments, the dry sprinkler of each of the preferred embodiments has a rated K-factor of at least 5.6. Based on the rated K-factor of the dry sprinkler of the preferred embodiments, each dry sprinkler has an arrangement of components that allows for an actual minimum flow rate in gallons per minute (GPM) through the outlet as a product of the rated K-factor and the square root of the pressure in pounds per square inch gauge (psig) of the fluid fed into an inlet of the dry sprinkler of each preferred embodiment. Specifically, each of the preferred embodiments has an actual minimum flow rate approximately equal to 95% of the magnitude of a rated K-factor times the square root of the pressure of the flow of fluid fed into the inlet of each embodiment. In order to provide the actual flow rate when the dry sprinkler is actuated, different arrangements of components—as exemplified in each of the at least twenty three preferred embodiments—are provided that position the face 37 such that the central axis X-X of the face 37 is skewed with respect to the longitudinal axis A-A and the expected flow rate is achieved from the dry sprinkler. The arrangements provide various means for repositioning—from a first position that prevents flow to a second position that permits flow the inlet—the face 37 of the metallic disc annulus 36 to be skewed to the longitudinal axis A-A so that the actual minimum flow rate approximately equal to 95% of the magnitude of a rated K-factor times the square root of the pressure of the flow of fluid fed into the inlet of each embodiment can be achieved.

In a first preferred embodiment of the dry sprinkler, as shown in FIGS. 1A-1C, an arrangement of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. Locator 50 includes a closure assembly 30. The closure assembly 30 has a body 34 with a first end 30*a* and second end 30*b*. The first end 30*a* includes a top portion 33 that, preferably, is in the shape of a cone or preferably a truncated cone. The first end 30*a* preferably extends toward the second end 30*b*. A top portion 33 is spaced along the longitudinal axis A-A to the body portion 34. The body portion 34 can be formed with a support surface 35 that, in a preferred embodiment, is generally planar. An opening 33*a* can be formed proximate the top portion 33, which is preferably cylindrical, to allow a tool to engage the closure assembly 30 while assembling the dry sprinkler 10. The face 37 of the metallic disc annulus 36 can be mounted proximate the top portion 33 on an annular seating surface of the closure assembly 30 so as to prevent fluid flow through the passageway 20*a* in a non-actuated or closed position of the dry sprinkler 10.

To minimize the restriction upon the water flowing through outer structure assembly 20 of the dry sprinkler 10, the closure assembly 30 can include a suitable shape that presents as small a frontal area and as small a coefficient of drag as suitable when the closure assembly 30 is rotated to the open position. Preferably, a large frontal surface area is provided by portion 33 and metallic disc annulus 36. And preferably, by virtue of the shape of portions 33 and 34, the body of closure assembly 30 presents a relatively smaller frontal area to the flow of water in an open position as compared to the frontal area of portion 33 and metallic disc annulus 36 of the closure assembly 30 with respect to the water flow in the closed position.

The closure assembly 30 is supported by contacting the support surface 35 against an inner assembly 501 of the locator 50 so that the face 37 of the metallic disc annulus 36, in an unactuated position, engages a sealing surface 38*b* of the inlet 21. During engagement with the sealing surface 38*b*, the face 37 of the metallic disc annulus 36 is preferably compressed against the sealing surface 38*b* such that the central axis X-X of the face is generally coaxial with the longitudinal axis A-A.

The inner assembly 501 of locator 50 can include a solid member of a predetermined cross-section such that fluid flow surrounds the inner assembly 501. The inner assembly 501, preferably, is disposed within the tubular outer structure assembly 20, which includes the casing tube 24. The terms "tube" or "tubular," as they are used herein, denote an elongate member with a suitable cross-sectional shape transverse to the longitudinal axis A-A, such as, for example, circular, oval, or polygonal. Moreover, the cross-sectional profiles of the inner and outer surfaces of a tube may be different The inner assembly 501 can include a multi-legged yoke 51, a fluid tube 54, a guide tube 56, and the trigger assembly 60. In the non-actuated configuration, the yoke 51 is coupled to the fluid tube 54, and the fluid tube 54 is coupled to the guide tube 56, and the guide tube 56 is coupled to the trigger seat 62 of the trigger assembly. The multi-legged yoke 51 can locate the closure assembly 30 with respect to the longitudinal axis A-A. The multi-legged yoke 51 has a first yoke support end 51*a* contacting the closure assembly 36 and a second yoke support end 51*b* coupled to the fluid tube 54. The yoke 51 may optionally include a biasing member that in a preferred embodiment includes an assist spring 55 to assist movement of the yoke 51 from its unactuated position (FIG. 1A) to an actuated position (FIG. 1B).

The fluid tube 54 can be formed with a first cross-sectional area $A_1=\pi(d_1/2)^2$ transverse to the longitudinal axis A-A. Preferably, the fluid tube 54 has a generally constant diameter $d_1$ along its length, which is believed to minimize friction loss effects over its length. The guide tube 56 can be formed by two or more portions. Preferably, a first guide tube portion 57 can be a conical portion with a first end 57*a* having a second cross-sectional area $A_2=\pi(d_2/2)^2$ generally equal to the first cross-sectional area $A_1$ and a second end 57*b* having a third cross-sectional area $A_3=\pi(d_3/2)^2$ generally less than the first cross-sectional area $A_1$. A second guide tube portion 58 has a fourth cross-sectional area $A_4=\pi(d_4/2)^2$ generally equal to the third cross-sectional area $A_3$.

Referring to FIG. 1C, the yoke 51 has a central axis Y-Y extending along longitudinal axis A-A. Yoke 51 has two main portions 511 and 512 symmetric about the central axis Y-Y.

Each of the main portions has a first end and a second end 51*a* and 51*b*. A connecting portion 502*a* connects the main portions 511 and 512 between a first end 51*a* and a second end 51*b* of each of the main portions 511 and 512. The main portions 511 and 512 are each provided with a pivot connection 502*c* so that the pivot connection 502*c* forms a pivot axis P-P transversely intersecting the yoke axis Y-Y. The closure assembly 30 is mounted by a pivot pin 32 to pivot connection 502*c* of the yoke 51. The pivot pin 32 allows for rotation of the closure assembly 32 about the pivot axis P-P in the actuated or activated configuration of the dry sprinkler.

As shown in FIG. 1C, the connecting portion 502*a* can be a single arcuate member connecting the main portions 511 and 512 on one side of the yoke axis Y-Y to form an elongate member having an arcuate channel extending between the ends of the main portions 511 and 512. Yoke 51 has some freedom of movement relative to the fluid tube 54 such that the yoke axis Y-Y is movable relative to the longitudinal axis A-A.

By connecting a closure assembly 30 to the pivot connection 502*c*, the closure assembly 30 can pivot about the pivot axis P-P in an actuated (i.e., open) position of the dry sprinkler. Moreover, the pivot connection 502*c* allows for the compression of the face 37 into a generally planar surface against the sealing surface 38*b* so that the dry sprinkler of the preferred embodiment can be assembled. In lieu of the pivot pin 32 of the preferred embodiment, the closure assembly 30 can be pivoted by a bolt and nut, screw, two pins, a protrusion cooperating with a recess, or any suitable arrangement that allows the closure assembly 30 to pivot about pivot axis P-P and also allows for compression of the face 37 against the sealing surface 38*b* in a closed position of the dry sprinkler.

Due to the alignment of the closure assembly 30 with the sealing surface 38*b* of the inlet fitting 23 in the closed position (FIG. 1A), yoke 51 can have its axis Y-Y generally coaxial with the longitudinal axis A-A in the closed position. Due to the assist spring 55 acting against the asymmetric connecting portion 502*a*, yoke 51 can have its axis Y-Y offset over an offset distance 502*b* relative to the longitudinal axis A-A in the open position of the dry sprinkler (FIG. 1B). The offset 502*b* can be at least 0.016 inches so that, when the dry sprinkler is actuated to an open position, the closure assembly 30 has its pivot axis P-P offset to the longitudinal axis A-A. Because the pivot axis P-P is offset to the longitudinal axis A-A, a portion of the closure assembly 30 is offset to the longitudinal axis A-A, which is believed to allow a moment force to be generated as a function of the pressure of the flowing water acting over the offset distance. This moment force is believed to assist in rotating the closure assembly 30 so that the sealing surface is located on one side of the longitudinal axis A-A when the yoke 51 is traveling towards or at the second position to permit fluid to flow through the inlet to the outlet.

The dry sprinkler 10 can be assembled in the following manner. The body 34 of the closure assembly and the metallic disc annulus 36, including the face 37, are placed in the inlet fitting 23 so that the outer perimeter or a portion of the face 37 contacts a sealing surface 38*b* of the inlet fitting 23. Depending on whether an assist spring is desired, a biasing member in the form of a assist spring 55 is placed into the interior surface 23*b* of the inlet fitting 23, as shown in FIG. 1A.

The second support end 51*d* of the multi-legged yoke 51 is inserted into the fluid tube 54 so that the multi-legged yoke is coupled to the fluid tube 54. The fluid tube 54 is coupled to the guide tube 56 to form an inner assembly 501. The casing tube 24 is coupled by threads to the inlet fitting 23 and the inner assembly 501 can be inserted through the casing tube 24. As the inner assembly 501 is inserted through the casing tube 24, the first yoke support end 51*a* positions the face 37 of the metallic disc annulus 36 against the sealing surface 38*b* of the inlet fitting 23 so that the components described above form a partially assembled dry sprinkler.

The trigger assembly 60 can be assembled separately by mounting the trigger seat 62 to the frame arm opening 31, placing a terminal end of the frangible bulb 61 into the interior cavity 65*a* of the nub portion 65, threading the adjustment screw 71 to the frame arms 27 so that the screw seat 71*a* engages another end of the frangible bulb 61. The ejection spring 64 is placed in the groove 62*a* of the trigger seat 62 and connected to both frame arms (FIG. 1D).

The trigger assembly 60 is coupled to the partially assembled dry sprinkler by preferably threading the frame (25,251,252) to the casing tube 24 until the boss portion 28 and the casing tube 24 capture the holder or escutcheon 100 between these two components. The frame (25,251,252) is preferably threaded at a desired torque until a terminal end 25*d* of the frame (25,251,252) engages a complementary terminal surface 24*e* of the casing tube 24. Next, the adjustment screw 71 is adjusted to a sufficiently high torque value that in the final assembled position, the screw 71 in conjunction with the frame (25,251,252) will cause the outer perimeter or a portion of the face 37 to be compressed against the sealing surface 38*b* and maintain all components at their intended position without damaging the frangible bulb 61. This provides the locator 50 for the dry sprinkler 10.

In operation, the face 37 separates from the sealing surface 38*b* as the closure assembly 30 translates along with the inner assembly 501 during an actuation of the sprinkler 10. The axial force provided by the metallic disc annulus 36 assists in translating the closure assembly 30 from the inlet fitting 23. The translating of the face 37 can also include moving the face 37 or a portion of the face 37 to a side of the longitudinal axis A-A such that a central axis X-X of the face 37 is skewed with respect to the longitudinal axis A-A. That is, in the second position of the inner assembly 501, the central axis X-X of the sealing member is arranged so that the central axis is skewed, i.e., not co-planar with the longitudinal axis A-A. And, the translating of the sealing surface can also include moving the locator 50 for a predetermined distance within outer structure assembly 20 while retaining a portion of the locator 50 within outer structure assembly 20, between the fluid deflecting structure 70 and the inlet 21, which movement can be assisted by using the assist spring 55.

Figure 2C:
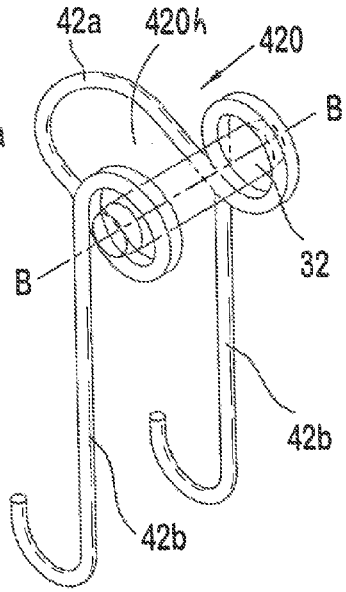
Figure 2B:
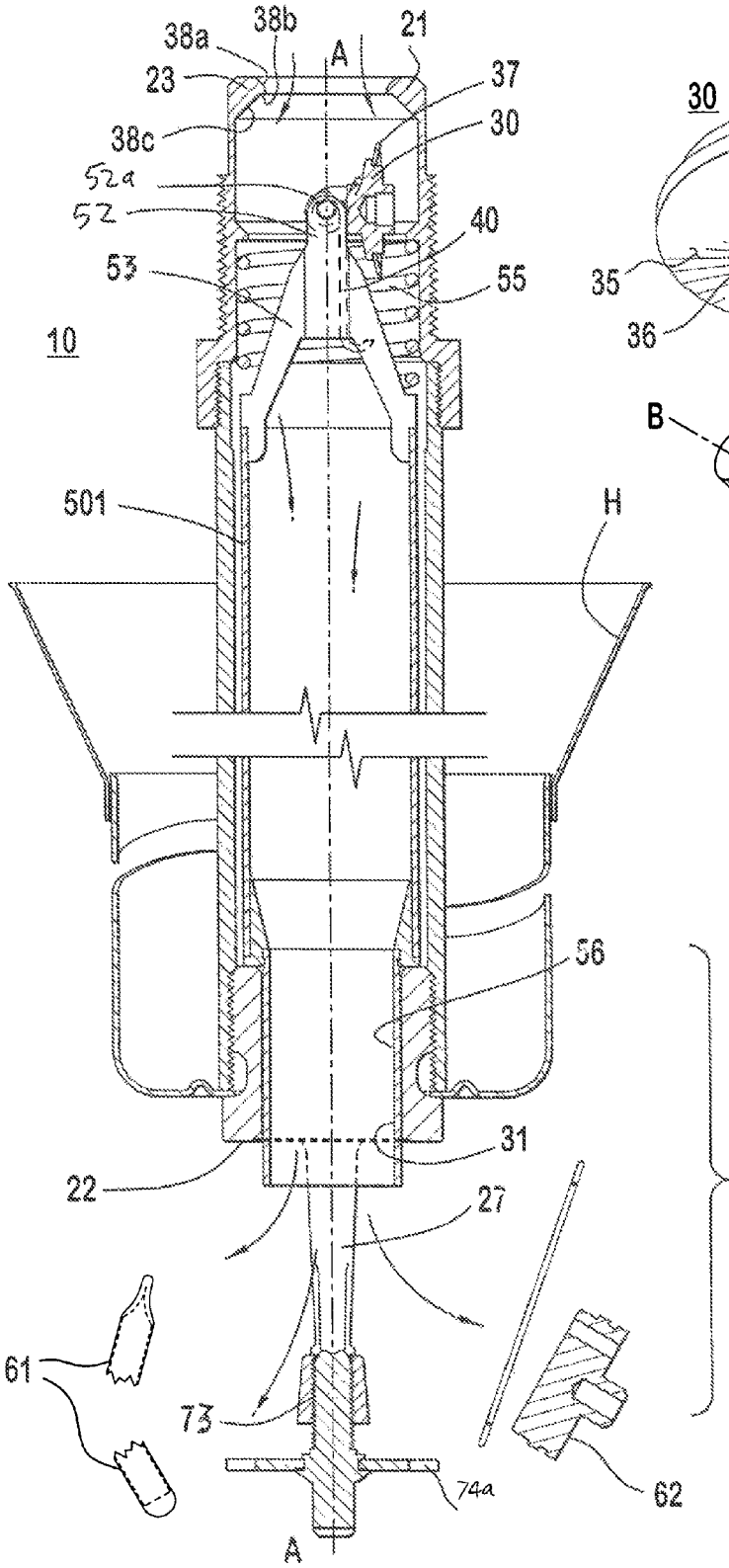
Figure 2D:
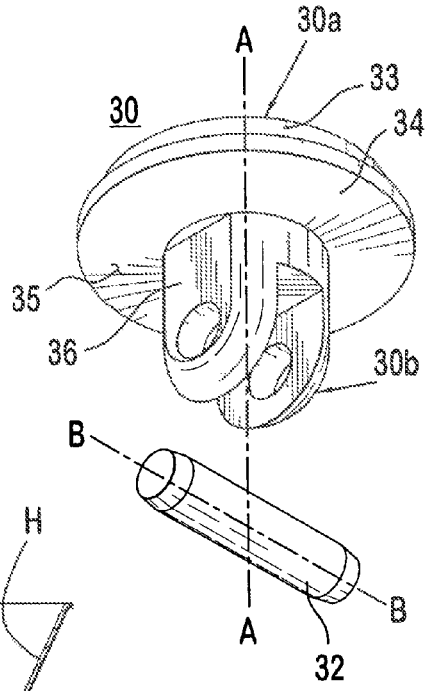

In a second preferred embodiment of the dry sprinkler, as shown in FIGS. 2A-2D, a second arrangement of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, while the closure assembly 30 is similar to that of the first embodiment, the inner assembly 501 includes a multi-legged yoke 51 that extends along a yoke axis Y-Y and coupled to a fluid tube 54 and guide tube 56. The yoke 51 provides a mounting point for pin 32 to intersect generally transverse to the longitudinal axis A-A so that the closure assembly 30 can be mounted to the yoke 51 via legs 36 (FIG. 2D). The yoke 51 has a first support end 51*a* coupled to the closure assembly 30 through pin 32 and a second support end 51*b* coupled to the fluid tube 54. The first yoke support end 51*a* has at least one elongate member 52 from which extends at least two and preferably four support legs to form the second yoke support end 51*b*. The first yoke support end 51*a* is provided with eyelets 52*a* formed so that the pin 32 can be inserted there-through to mount the closure assembly 30. The yoke 51 can be formed as a cast, machined or stamped piece. Preferably, the yoke 51 is formed by mating two stamped sheet metal members via a plurality of tack welds. Each of the stamped sheet metal members has a central portion extending along the longitudinal axis A-A and two projections diverging away from the longitudinal axis A-A at a suitable angle. When the central portion of each of the two members is joined together, four projections are formed to define four legs 53, e.g., a quad-pod. Legs 53 of the quad-pod are coupled to the fluid tube 54 and can include a boss portion 51*c* that can be used as a seat for an assist spring 55.

The assist spring 55 acts along the longitudinal axis A-A to assist the locator 50 in translating to a second or open position of the dry sprinkler. Preferably, the helper 55 is a coil spring with a first end contiguous to inner boss portion 23*f* and a second end contiguous to seat surface 51*c* of the yoke 51.

A suitable contact member 40 can be a resilient member that provides a moment force. For example, a torsion spring, helical spring, or a leaf spring can be used to generate a moment force on the closure assembly 30. Alternatively, the contact member 40 can be a suitable mechanism that provides a moment force to the closure body 30. For example, a motion interference projection, linkage or lost motion mechanism can provide a moment force about pin 32 to rotate the closure assembly 30 about pivot axis P-P.

Preferably, as illustrated in FIG. 2C, the contact member 40 is a torsion spring 420 with a first end 42*a*, main body 420*h* and second end 42*b*. The main body 420*h* can be entwined to pin 32. One end 42*a* can be in engagement with a portion of the closure assembly 30. The other end 42*b* can be coupled, e.g., fixed with a hooked end to the yoke 51 such that the two ends describe an obtuse angle of about 120 degrees in a non-actuated condition of the dry sprinkler and describe an obtuse angle of greater than 120 degrees in an actuated condition of the dry sprinkler 10.

In this preferred embodiment, the torsion spring 420 is a single wire spring wound to form main section 420*h* with at least two coils spaced apart along the pin axis P-P, and legs (forming the second end 42*b*) extending from a main section 420*h*. Also preferably, the torsion spring has a spring force of about 0.15 pound-force per degree of rotation, which is believed to be the minimum spring force needed to rotate closure assembly 30 about pivot axis P-P when a dry sprinkler of the preferred embodiments is provided with a rated K-factor of about 8.0.

The dry sprinkler 10 can be assembled in the following manner. The face 37 and closure body 30 are mounted to yoke 51 with the torsion spring 420 and pin 32 extending through the respective eyelets of the closure body and yoke. A biasing member in the form of an assist spring 55 is placed into the interior surface 23*b* of the inlet fitting 23, as shown in FIG. 2A.

The second support end 51*b* of the multi-legged yoke 51 is pressed into the fluid tube 54 so that the multi-legged yoke is coupled to the fluid tube 54. The fluid tube 54 is coupled to the guide tube 56 to form an inner assembly 501. The casing tube 24 is coupled by threads to the inlet fitting 23 and the inner assembly 501 can be inserted through the casing tube 24. This subassembly is placed in the inlet fitting 23 so that the outer perimeter or a portion of the face 37 contacts a sealing surface 38*b* of the inlet fitting 23 so that the components described above form a partially assembled dry sprinkler.

The trigger assembly 60 can be assembled separately by mounting the trigger seat 62 to the frame arm opening 31, placing a terminal end of the frangible bulb 61 into the interior cavity 65*a* of the nub portion 65, threading the adjustment screw 71 to the frame arms 27 so that the screw seat 71*a* engages another end of the frangible bulb 61. The ejection spring 64 is placed in the groove 62*a* of the trigger seat 62 and connected to both frame arms (FIG. 2A).

As described above with respect to the first embodiment, the trigger assembly 60 can be assembled together with the partially assembled dry sprinkler to form a dry sprinkler of the preferred embodiment.

In operation, when the dry sprinkler is actuated so that the locator 50 is translated from the first position to the second position, it is believed that this spring force of the contact member, along with the inflowing force of water, rotates the closure assembly 30 about pivot axis P-P so that the central axis X-X of the face 37 is skewed with respect to the longitudinal axis A-A and the expected flow rate is achieved from the dry sprinkler.

In a third preferred embodiment of the dry sprinkler, as shown in FIGS. 3A-3F, an arrangement of the locator is provided for repositioning of the face 37 so that the central axis X-X of the face 37 is skewed to the longitudinal axis A-A in an actuated condition of the dry sprinkler 10 and the expected flow rate is provided from the dry sprinkler. In particular, it is noted that the closure assembly 30 is different from the previous embodiments in that the closure assembly 30 is no longer pinned to a yoke. Referring to FIGS. 3A and 3B, the contact member 40 is a projection 410 having a free end 410*a* that extends generally orthogonal to the longitudinal axis A-A. The projection 410 can be coupled to the inner inlet fitting surface 23*b*. Further, the projection 410 can be a separate member coupled to a sleeve 42 press-fitted within the inlet fitting 23. The projection 410 can be coupled to the sleeve 42 through a projection opening 43. The sleeve 42 can be press-fitted in the surface 23*b* to form the contact assembly 40. In an alternative configuration, the projection 410 is a unitary member 410*b* of the sleeve 42 that can be formed by cutting a portion of the wall surface of the sleeve 42 and bending that portion towards the longitudinal axis A-A to form a free end 410*c* (FIG. 3E).

The dry sprinkler 10 of this preferred embodiment can be assembled in the following manner. The metallic disc annulus 36 is placed in the inlet fitting 23 so that the outer perimeter or a portion of the face 37 contacts a sealing surface 38*b* of the inlet 21 The sleeve 42 is press-fitted in the interior surface 23*b* of the inlet fitting 23. Depending on whether an assist spring is desired, a biasing member in the form of a assist spring 55 is placed into the interior surface 23*b* of the inlet fitting 23, as shown in FIG. 3F.

The second support end 51*b* of the multi-legged yoke 51 is pressed into the fluid tube 54 so that the multi-legged yoke is coupled to the fluid tube 54. The fluid tube 54 is coupled to the guide tube 56 to form an inner assembly 501. The casing tube 24 is coupled by threads to the inlet fitting 23 and the inner assembly 501 can be inserted through the casing tube 24. As the inner assembly 501 is inserted through the casing tube 24, the first yoke support end 51*a* contacts the closure assembly 30 via contact with the generally planar support surface 35 to place the face 37 of the metallic disc annulus 36 against the sealing surface 38*b* of the inlet fitting 23 so that the components described above form a partially assembled dry sprinkler.

As described above with respect to the first embodiment, the trigger assembly 60 can be assembled together with the partially assembled dry sprinkler to form a dry sprinkler of the preferred embodiment.

In operation, when the dry sprinkler is actuated, the inner assembly 501 is translated along the longitudinal axis A-A, thereby causing the closure assembly 30 to also translate along axis A-A. The closure assembly 30, along with the pressure of the water thereon, a rotating moment about an axis, which is coupled with contact of the support surface 35 against a free end of the projection 41, causes the closure assembly to pivot about the free end of the projection 41. Thus, closure assembly 30 is generally moved or flipped to one side of and along the longitudinal axis A-A such that the central axis X-X of the face 37 is skewed with respect to the longitudinal axis A-A and the expected flow rate is achieved from the dry sprinkler.

Referring to the fourth preferred embodiment, as shown in FIGS. 4A-4E, yet another arrangement of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, referring to FIGS. 4B and 4D, the contact member 40 is a tubular bar 411 having a contact surface 411*a* that extends generally orthogonal to the longitudinal axis A-A (FIG. 4A). The tubular bar 411 can be coupled to the inner inlet fitting surface 23*b*. Further, the tubular bar 411 is a separate generally linear member coupled to a sleeve 42 such that the tubular bar 411 is offset relative to the longitudinal axis A-A. The tubular bar 411 can be coupled to the sleeve 42 through two projection openings 413 disposed on the inner surface 42*a* of the sleeve 42. The sleeve 42 can be press-fitted in the surface 23*b* to form the contact assembly 40. Alternatively, the openings 413 can be formed by drilling through the sleeve starting at one position on the exterior surface 42*b* through the interior surface 420*e* at the one position and through a second position on the interior surface 420*e* to the exterior surface 42*b*. A tubular stock can be inserted through the openings 413 with its ends projecting from the exterior surface 42*b* can be sheared or grinded flush with the exterior surface 42*b*.

The fourth preferred embodiment can be assembled in a similar manner as described above in relation to the third embodiment.

In operation, when the dry sprinkler is actuated so that the locator 50 is translated from the first position to the second position, the closure assembly 30 is generally moved or flipped to one side of and along the longitudinal axis A-A to permit water to flow through the inlet and from the outlet at the expected flow rate.

Figure 5C:
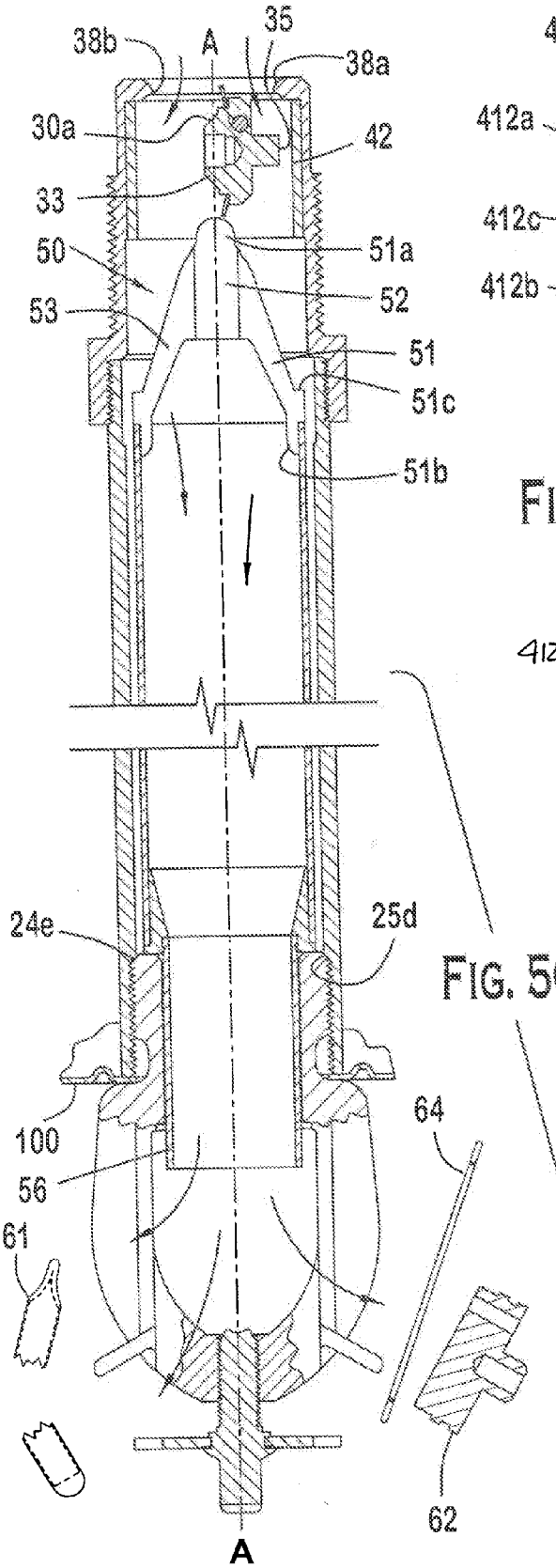
Figure 5D:
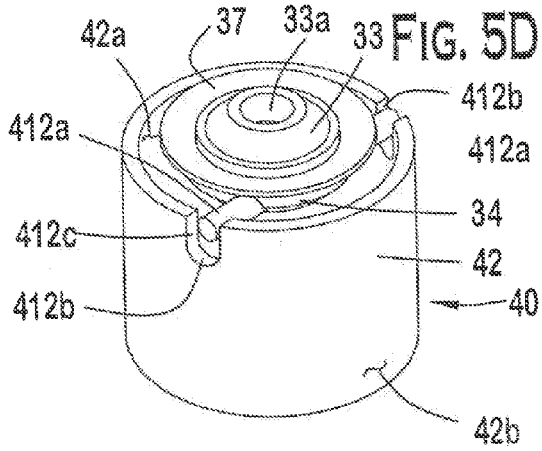
Figure 5E:
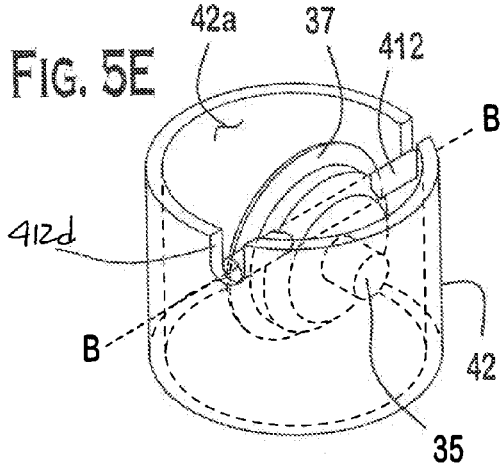
Figure 5F:
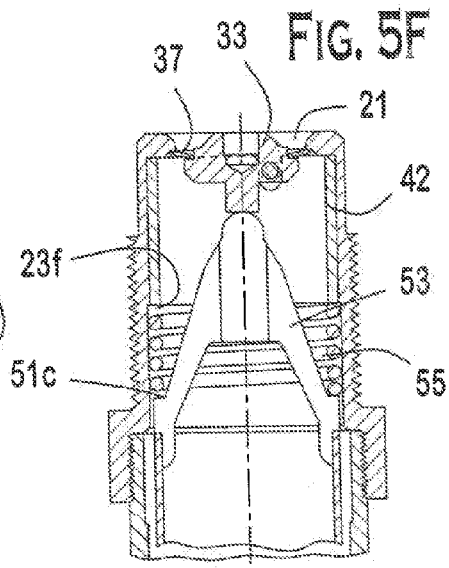

Referring to the fifth preferred embodiment, as shown in FIGS. 5A-5F, yet another arrangement of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. With reference to FIGS. 5B and 5D, the contact member 40 is a tubular bar 412 offset relative to the longitudinal axis A-A, and the tubular bar has a contact surface 412*a* that extends generally orthogonal to the longitudinal axis A-A. The tubular bar 412 can be supported by the inner inlet fitting surface 23*b* via bearings 412*b* that permit the tubular bar 412 to translate the closure assembly 30 about 90 degrees. This permits the closure assembly 30 to be moved to a side of the longitudinal axis A-A when the inner tube assembly moves from the first position towards the second position so as to permit a minimally restricted flow through the passageway between the inlet 21 and outlet 22. Each bearings 412*b* has two surfaces aligned proximate the longitudinal axis A-A, and a third surface connects the two parallel surfaces. The connecting surface can be of a suitable surface that permits the tubular bar 412 to rotate, such as, for example, flat, arcuate, V-shaped or diagonal. In a preferred embodiment, the connecting surface is arcuate. Preferably, the bearings 412*b* Are U-shaped openings formed on a sleeve 42. The bearings 412*b* are positioned offset relative to the longitudinal axis A-A. In particular, the bearings 412*b* are configured such that each bearing is larger than the diameter of the tubular bar 412. Each of the bearings 412*b* has a radiused surface 412*c* that extends towards the inlet 21 so as to provide for an open gap 412*d*. The open gaps 412*d* allow the tubular bar 412 to drop into the bearings 43 while the radiused surfaces 412*c* allow the tubular bar 412 to rotate about its axis B-B. Preferably, the sleeve 42 can be press-fitted in the surface 23*b* such that the tubular bar 412 and bearings 412*b* form the contact assembly 40.

The dry sprinkler of this preferred embodiment can be assembled by placing the closure body 30 into the inlet fitting 23 so that the outer perimeter or a portion of the face 37 contacts the sealing surface 38*b*. The length of the each bearing surface along the longitudinal axis A-A allows relative freedom of movement so that the outer perimeter or a portion of the face 37 can be compressed against the sealing surface 37 and a suitable seal can be provided therein. The sleeve 42 is pressed in with the bearings surface 412*c* aligned with the ends of the bar 412. Thereafter, the assist spring 55 is inserted, if desired, along with yoke 51, fluid tube 54, guide tube 56, flame (25,251,252) and trigger assembly 60 in a similar manner of assembly as described with reference to the second preferred embodiment.

In operation, when the dry sprinkler is actuated so that the locator 50 is translated from the first position to the second position, the closure assembly 30 is initially dropped into bearings 412*b*. As the shaft 412 impacts the bearings 412*b*, closure assembly 30 is rotated so that the central axis X-X of the face 37 is skewed with respect to the longitudinal axis A-A to permit water to flow through the inlet and from the outlet at the expected flow rate.

Figure 6C:
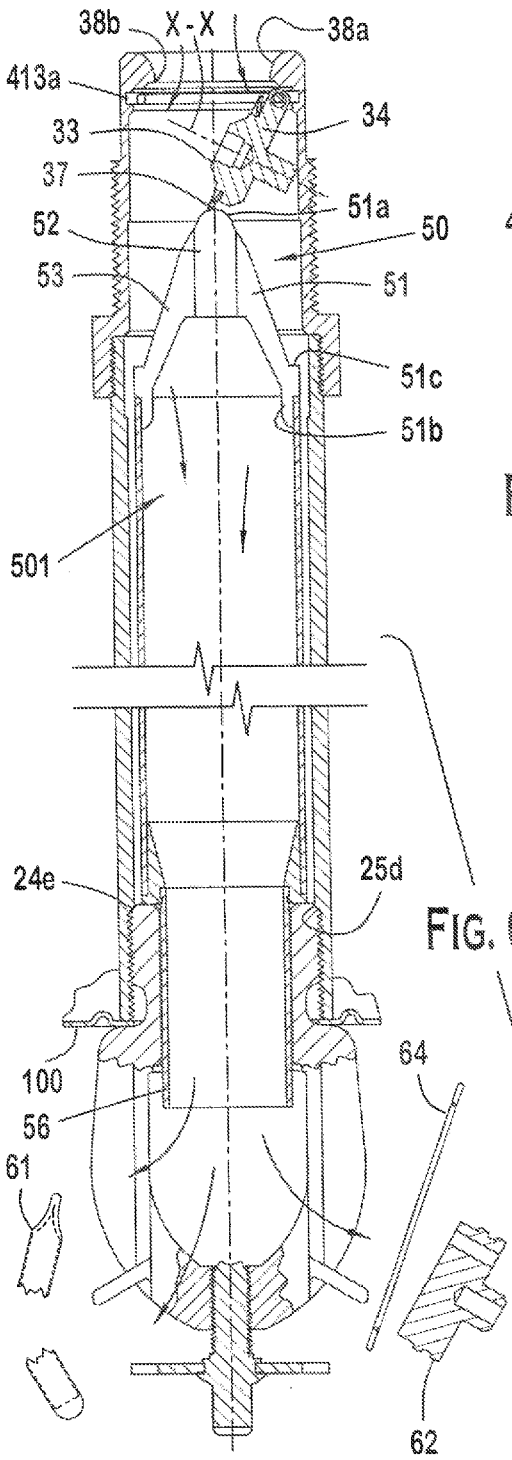
Figure 6D:
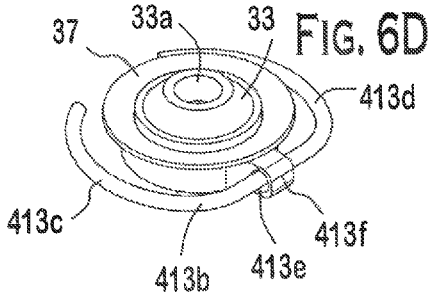

Referring to the sixth preferred embodiment, as shown in FIGS. 6A-6F, a different configuration of the components of the locator 50 is provided for repositioning of the face 37 so that the central axis X-X of the face 37 is skewed to the longitudinal axis A-A in an actuated condition of the dry sprinkler, 10 and the expected flow rate is provided from the dry sprinkler. The closure assembly 30 in this embodiment has first portion 33, second portion 34 with a support surface 35 that, in a preferred embodiment, is generally planar. A boss 413*f* can be formed at a circumferential portion of the second portion 34. The boss 413*f* is provided with an opening 413*e* that extends through the boss 413*f* along an axis generally orthogonal to the longitudinal axis A-A. With reference to FIGS. 6B and 6D, the contact member 40 includes a circumferential groove 413*a* formed on an inner surface of the inlet fitting 23. The groove 413*a* allows a C-clip 413*b* to be retained in the groove 413*a*. The C-clip 413*b* preferably has two legs 413*c* and 413*d* extending in an arcuate fashion about the longitudinal axis A-A so that the terminal ends of the legs face each other, as shown in FIG. 3. The clip 413*b* is retained in the groove 413*a* via the legs 413*c* and 413*d*. The C-clip 413*b* allows the closure assembly 30 to be loosely connected to the C-clip 413*b* via opening 413*e* formed through boss 413*f* of the closure assembly 30 so as to provide two degrees of freedom to the closure assembly 30 (i.e., sliding and rotating about the clip) so that the face 37 can be aligned and the outer perimeter or a portion of the face 37 is compressed against sealing surface 38*b*. The opening 413*e* has an internal diameter greater than the outer dimension of the C-clip 413*b* so that the opening 413*e* preferably does not contact the outer surface of the C-clip 413*b* when the closure assembly 30 is installed in the dry sprinkler 10.

The dry sprinkler 10 of this embodiment can be assembled as described above in relation to the second preferred embodiment and further in the following manner with regard to the C-clip 413*b*. The C-clip 413*b* is inserted through the opening 413*e* of the closure assembly 30, which opening 413*e* has a larger inner diameter than the outer diameter of the C-clip to allow relative movement (i.e., two-degrees of freedom) therebetween so that the outer perimeter or a portion of the face 37 can be compressed against sealing surface 38*b*. The C-clip 413*b* is compressed radially with respect the longitudinal axis A-A so that each leg 413*c*, 413*d* can be mounted in the groove 413*a*. Depending on whether an assist spring is desired, a biasing member in the form of a assist spring 55 is thereafter placed into the interior surface 23*b* of the inlet fitting 23, as shown in FIG. 6F. Thus, a partially assembled dry sprinkler is provided at this point. Thereafter, the assist spring 55 is inserted, if desired, along with yoke 51, fluid tube 54, guide tube 56, frame (25,251,252) and trigger assembly 60 in a similar manner of assembly as described with reference to the second preferred embodiment.

Figure 6E:
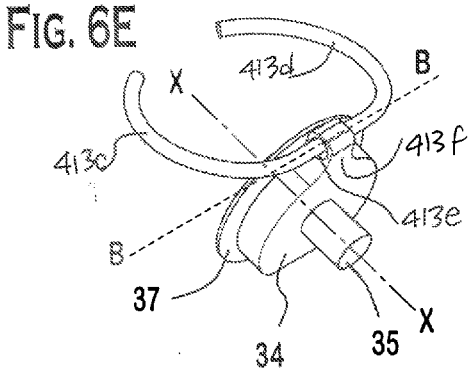
Figure 6F:
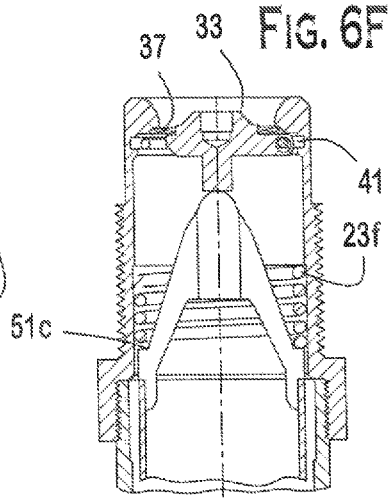

In operation, when the dry sprinkler is actuated so that the locator 50 is translated from the first position to the second position, the clip 413*b* provides a pivot axis B-B offset from the longitudinal axis A-A for the boss 413*f* so that the closure assembly 30 can generally rotate about this pivot axis B-B (FIG. 6E). By virtue of the pivot axis B-B, the face 37 is skewed with respect to the longitudinal axis A-A and the expected flow rate is achieved from the dry sprinkler to permit water to flow through, the inlet and from the outlet at the expected flow rate.

Referring to the seventh preferred embodiment, as shown in FIGS. 7A-7E, another configuration of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, as shown in FIG. 7D, the first yoke support end 51*a* of yoke 51 (of the inner assembly 501) has a generally planar surface 51*c* extending preferably in an oblique direction relative to the longitudinal axis A-A such that the planar surface 51*c* intersects another generally planar surface 49*b* to form a generally linear edge 51*e*. The linear edge 51*e* extends preferably along an axis B-B generally orthogonal and offset to the longitudinal, axis A-A. The linear edge 51*e* contiguously engages a generally planar surface 35 of the closure assembly 30. Preferably, the linear edge 51*e* is formed by two co-extensive planar surfaces 51*c* and 49*b*. Each of the members 52*a* and 52*b* has central portion and two projections at appropriate angles that diverge from the longitudinal axis A-A.

In this preferred embodiment, the liner edge 51*e* should contact the support surface 35 of the closure assembly 30 at a location of about 0.05 inches radially offset relative to the longitudinal axis A-A. A ratio of the distance of the outer perimeter of the face 37 relative to the radially offset distance can be established so that the proportion of the offset should be maintained with various rated K-factors of the preferred embodiments. Preferably, the ratio of the diameter of the face 37 relative to the offset distance is about 15:1 such that a proportional offset distance is maintained should the dry sprinkler be enlarged in size. The engagement of the linear edge 51*e* places the outer perimeter or a portion of the face 37 against the inlet sealing surface 38*b* of the inlet fitting 23. Because the face 37 is essentially fixed with respect to the inlet sealing surface 38*b*, any side loading being imposed by the linear edge 51*e* is negligible when the face 37 is compressed against inlet sealing surface 38*b* in a fully assembled state. As mounted in the first position of the inner assembly 501 in the dry sprinkler 10, the linear edge 51*e* forms a line contact support with the generally planar surface 35 of the closure assembly 30.

The dry sprinkler of this preferred embodiment can be assembled by placing the closure body 30 into the inlet fitting 23 so that the outer perimeter or a portion of the face 37 contacts the sealing surface 38*b*. Thereafter, the assist spring 55 is inserted, if desired, along with yoke 51, fluid tube 54, guide tube 56, frame (25,251,252) and trigger assembly 60 in a similar manner of assembly as described with reference to the second preferred embodiment.

In operation, when the dry sprinkler is actuated so that the locator 50 is translated from the first position to the second position, the closure assembly 30 is forced to translate due to and the flow of water impacting against the closure assembly 30 on the linear edge 51*e*. That is, due to water flowing against the surface of the closure assembly, the closure assembly 30 is unbalanced the linear edge 51*e*. Thus, the central axis X-X of the face 37 is skewed with respect to the longitudinal axis A-A and the expected flow rate is achieved from the dry sprinkler as the locator 50 is moved from proximate the first position (FIG. 7A) to the second position (FIG. 7C).

Figure 8C:
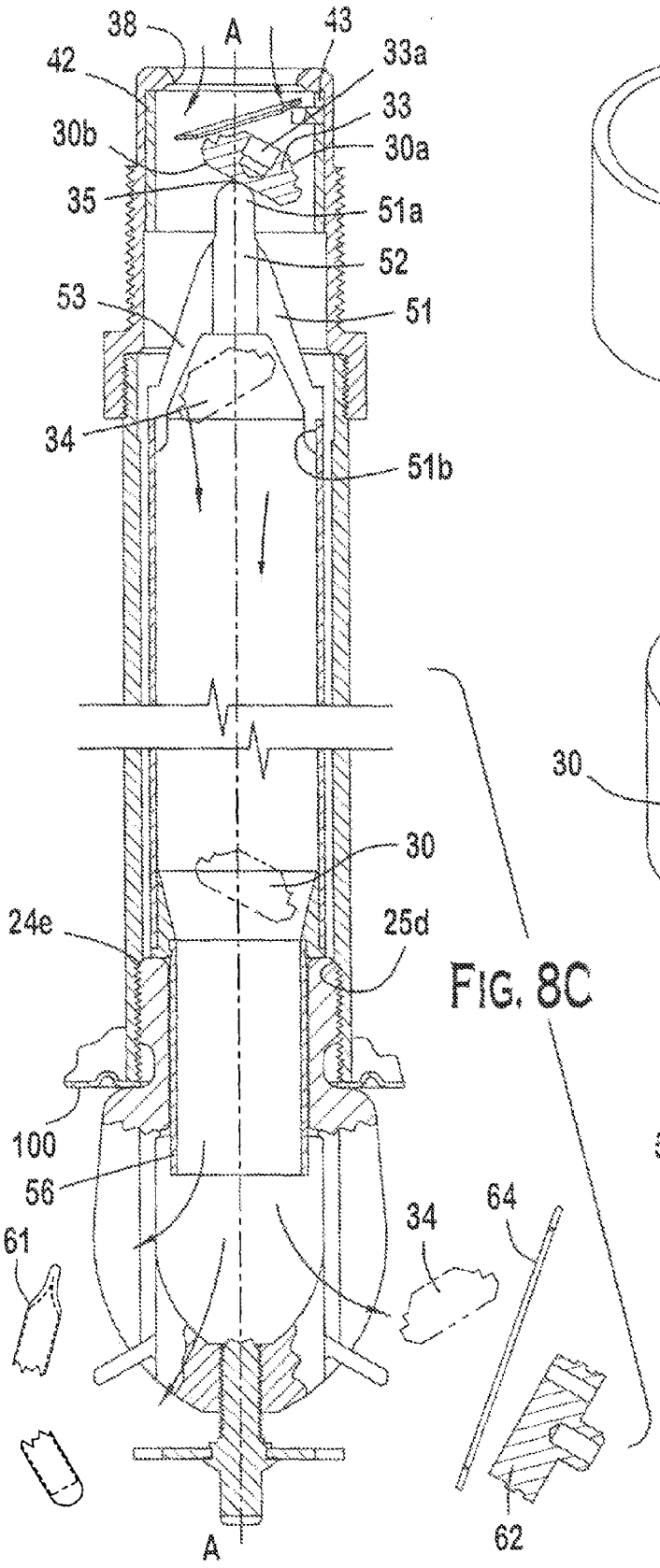
Figure 8D:
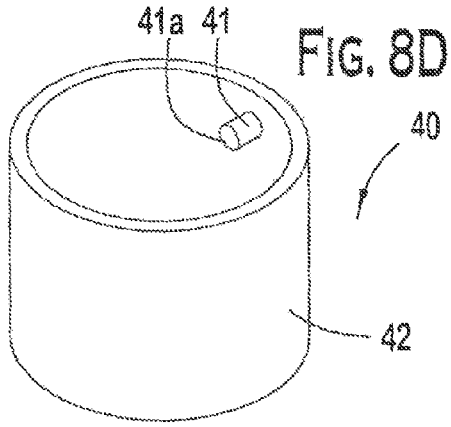

Referring to the eighth preferred embodiment, as shown in FIGS. 8A-8F, another arrangement of components of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, referring to FIGS. 8A and 8C, the closure assembly 30 includes a body 34 with a top portion 33. The face 37 is preferably fitted to the top portion 33 in a slide-fitted—as opposed to a press-fitted—configuration so that the face 37 is separable from the top portion 33, and in contrast to previous preferred embodiments, the closure assembly 30 is not pinned to the inner assembly 501 in this embodiment. A suitable contact member, such as, for example, a boss portion, projection or pin can be provided in the passageway 20*a* so that the contact member can contact the closure assembly 30 during actuation of the dry sprinkler 10. Preferably, as illustrated in FIG. 8D, the contact member is a projection 41 having a free end 41*a* that extends generally orthogonal to the longitudinal axis A-A. The projection 41 can be coupled to the inner inlet fitting surface 23*b*. In a preferred embodiment, the projection 41 is a separate member coupled to the sleeve 42.

Figure 8E:
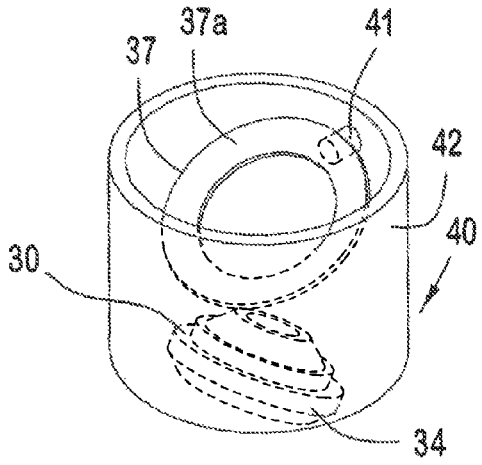
Figure 8F:
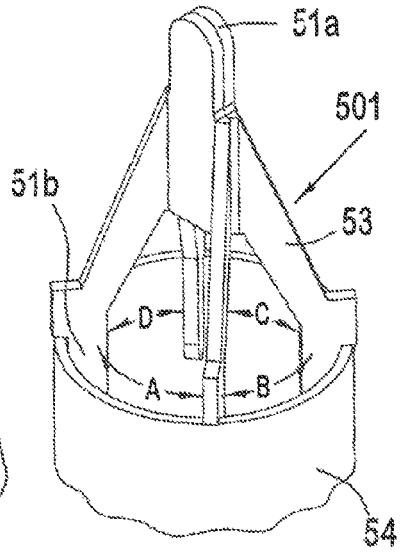
Figure 10C:
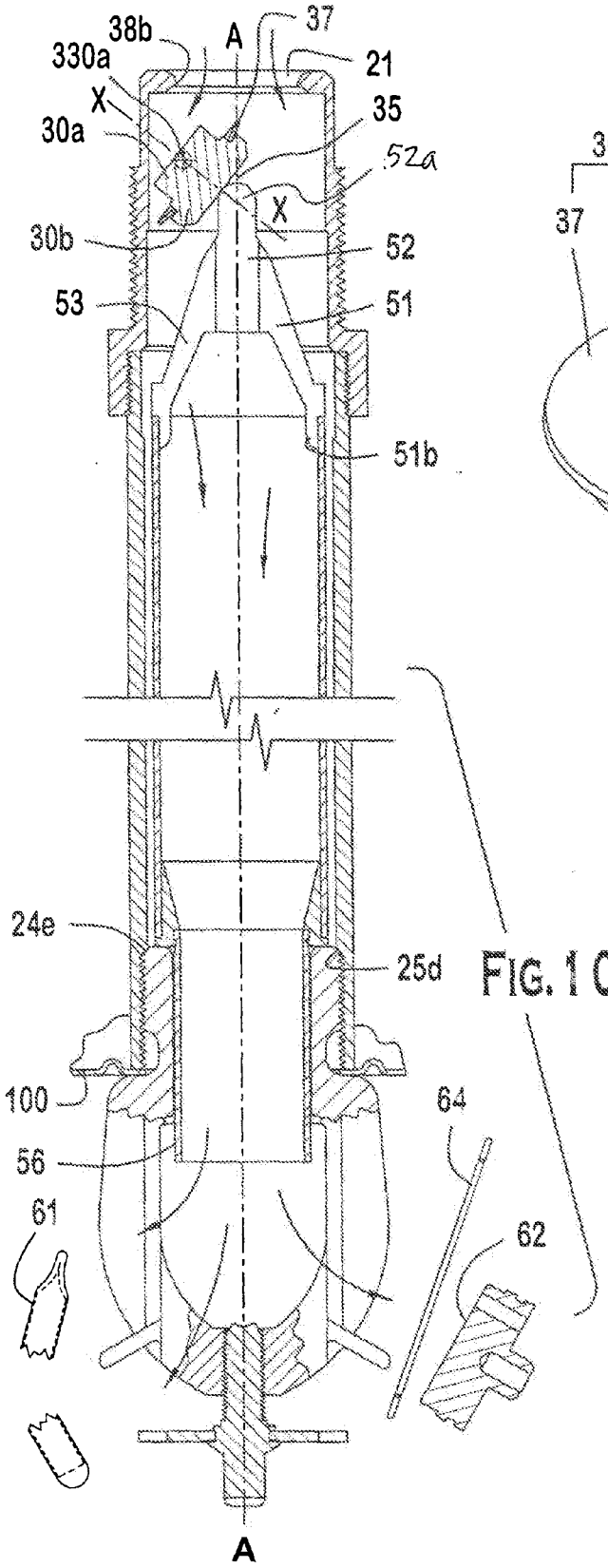
Figure 10D:
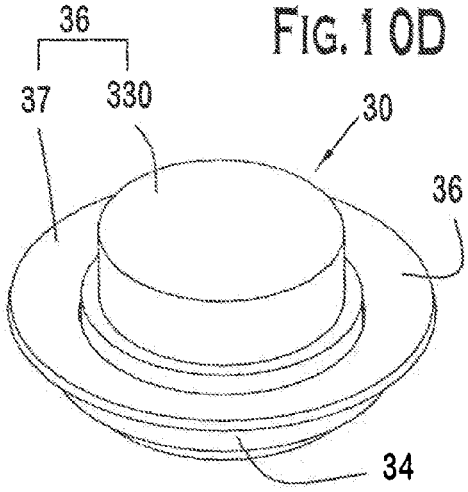
Figure 10E:
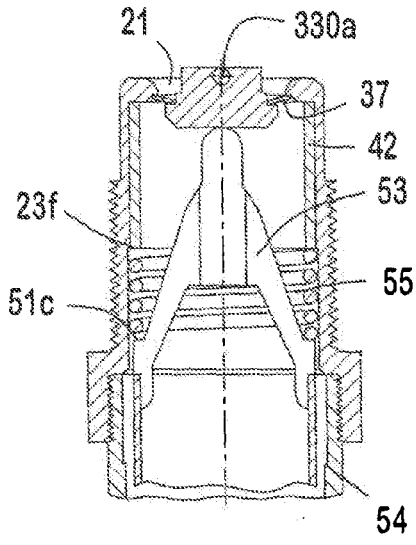
Figure 11C:
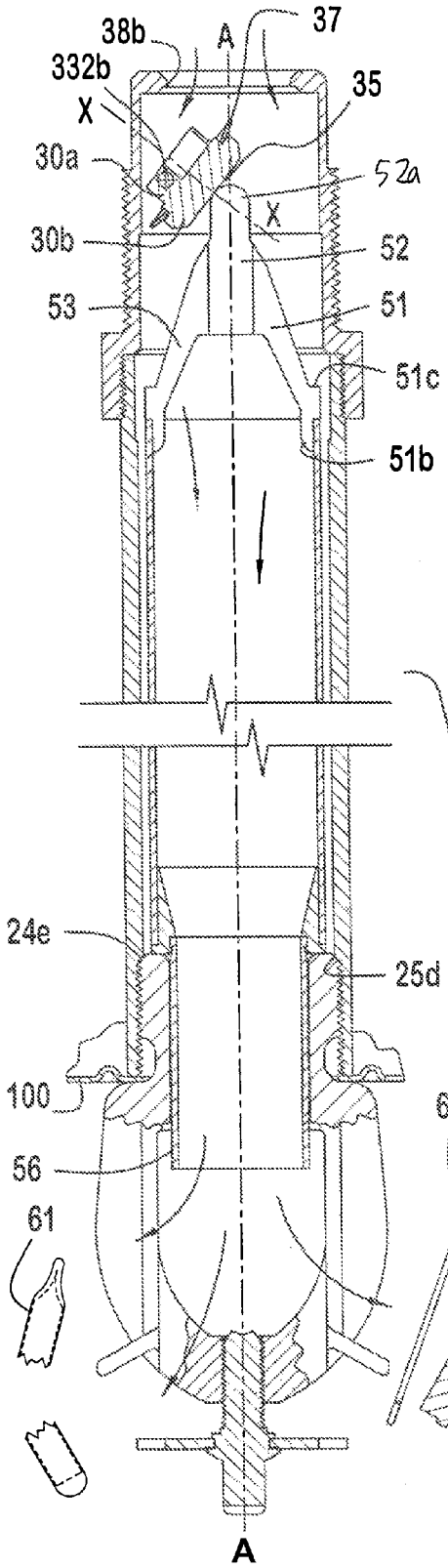
Figure 11D:
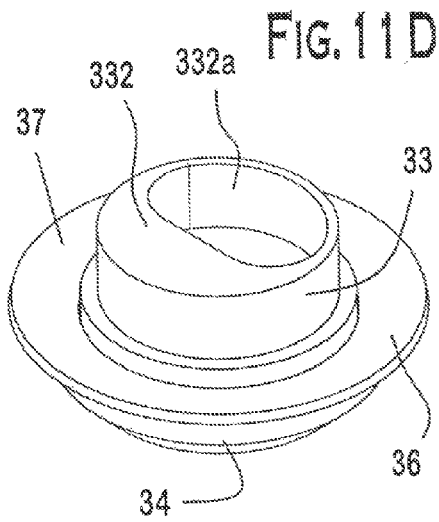
Figure 11E:
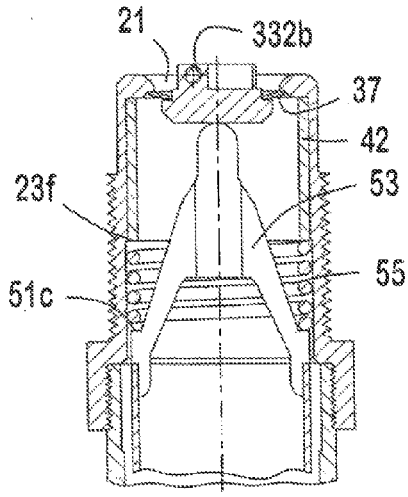

Although the yoke 51 was described above, an explanation of the additional details of the yoke 51 is appropriate here. With respect to this embodiment, the first yoke support end 51*a* has a generally arcuate surface and has at least one elongate member 52 that is coupled to at least two support legs 53 that provide the second yoke support end 51*b*. The first yoke end 51*a* can contact the generally planar surface 35 of the closure assembly 30. The second yoke end 51*b* can be coupled to a portion of the inner assembly 501, and, preferably, the water tube 24. Each of the members 52*a* and 52*b* has central portion and two projections at appropriate angles that diverge from the longitudinal axis A-A. Preferably, a projection of one stamped metal member is adjacent the projection of another sheet member such that an obtuse angle is formed there between as viewed from the inlet 21. The projections of respective stamped metal members 52*a* and 52*b* are configured such that they form four sectors about the longitudinal axis A-A, where a pair of diametrical sectors of generally equal first arcuate distance is interposed by a pair of diametrical sectors of generally equal second arcuate distance, and where the first arcuate distance is greater than the second. For example, as shown in FIG. 8F, a first arcuate sector A has an arcuate distance greater than the second arcuate section B, a third arcuate section C diametrically opposite the first arcuate sector A has generally the same arcuate distance as the first arcuate sector A, and a fourth arcuate sector D diametrically opposite the second arcuate sector B has generally the same arcuate distance as the second arcuate sector B. This arrangement of arcuate sectors may be sized to permit the closure body 30 to fall through the yoke 51 and out of the dry sprinkler such that substantially all other components of the locator remain with the dry sprinkler.

The dry sprinkler of this preferred embodiment can be assembled by placing the closure body 30 into the inlet fitting 23 so that the outer perimeter or a portion of the face 37 contacts the sealing surface 38*b*. Thereafter, the assist spring 55 is inserted, if desired, along with yoke 51, fluid tube 54, guide tube 56, frame (25,251,252) and trigger assembly 60 in a similar manner of assembly as described with reference to the second preferred embodiment.

In operation, when the dry sprinkler is actuated so that the locator 50 is translated along axis A-A, the outer perimeter or a portion of the face 37 contacts the free end 41*a* of projection 41. This contact between the outer perimeter or a portion of the face 37 and the projection 41 causes the face 37 to separate from the body portion 34 of the closure assembly 30, as shown in FIG. 8E so that the central axis X-X of the face 37 is skewed from the longitudinal axis A-A. Due to the position of the projection member 41 over one of the larger arcuate sectors A and C defined by the multi-legged yoke 51, shown in FIG. 8F, the body portion 34 of the closure assembly may fall through one of the two arcuate sectors A and C, and through the inner assembly 501 as the locator 50 is moved from proximate the first position (FIG. 8A) to the second position (FIG. 8C). It is noted that the inner assembly 501 is moved for a predetermined distance within the structure 20, and substantially all portions of the inner assembly 501 are retained within the outer perimeter of the structure 20.

Referring to the ninth preferred embodiment, as shown in FIGS. 9A-9E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, with reference to FIG. 9D, a closure assembly 30 with an extension 400 is provided. The extension 400 has a radius of curvature that can be formed on the support surface 35 and positioned anywhere on the support surface 35. In a preferred embodiment, the extension 400 in the form of a spheroidal member 400 can be formed on the support surface 35 proximate the longitudinal axis A-A. The closure assembly 30 is supported by engagement of the extension 400 against a generally planar or arcuate surface 551*a* (FIG. 9C) or 551*b* (FIG. 9D) of yoke 51 so that the face 37, in an unactuated position, is preferably compressed against the inlet sealing surface 38*b*. Preferably, the spheroidal member 400 has a diameter that is about ¼ of the outer perimeter of the face 37 in its fully compressed form.

The dry sprinkler of this preferred embodiment can be assembled by placing the closure body 30 into the inlet fitting 23 so that the outer perimeter or a portion of the face 37 contacts the sealing surface 38*b*. Thereafter, the assist spring 55 is inserted, if desired, along with yoke 51, fluid tube 54, guide tube 56, frame (25,251,252) and trigger assembly 60 in a similar manner of assembly as described with reference to the second preferred embodiment.

In operation, when the dry sprinkler is actuated so that the locator 50 is translated along axis A-A, the face 37 separates from the sealing surface 38*b*. Once the outer perimeter or a portion of the face 37 is no longer in contact with inlet sealing surface 38*b*, the closure assembly 30 is free to roll on either surface 551*a* or 551*b* of yoke support 51*a* about a moving center of rotation such that the closure assembly 30 may fall off the yoke support 51*a* into, for example, arcuate sector A or C (FIG. 9D). Due to the preferred configuration of extension 400, the extension 400 allows the face 37 to be skewed with respect to the longitudinal axis A-A and the expected flow rate is provided by the dry sprinkler.

Referring to the tenth preferred embodiment as shown in FIGS. 10A-10E, another configuration of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, a closure assembly 30 with an extended top portion 330 is provided. The top portion 330 can be in the shape of a cone or preferably right angle cylinder. The first end 30*a* preferably extends toward the second end 30*b*. The body portion 34 can be formed with a support surface 35 that, in a preferred embodiment, is generally planar. The body portion 34 can also support a metallic disc annulus 36 such that the outer perimeter or a portion of the face 37 of the metallic disc annulus can form a seal with the inlet 21. The body portion 34 of closure assembly 30 is formed such that a majority of the mass of the closure assembly 30 is preferably located proximate top portion 330 proximate the first end 30*a* between the sealing surface 38*b* and the inlet 21. This allows for the center of gravity 330*a* of the closure assembly 30 to be spaced at a predetermined distance from the yoke 51 and generally coincident along the longitudinal axis A-A.

The dry sprinkler of this preferred embodiment can be assembled by placing the closure body 30 into the inlet fitting 23 so that the outer perimeter or a portion of the face 37 contacts the sealing surface 38*b*. Thereafter, the assist spring 55 is inserted, if desired, along with yoke 51, fluid tube 54, guide tube 56, frame (25,251,252) and trigger assembly 60 a similar manner of assembly as described with reference to the second preferred embodiment.

In operation, when the dry sprinkler is actuated so that the locator 50 is translated from the first position to the second position, the face 37 separates from the sealing surface 38*b*. Because the center of gravity 331 located proximate the top portion 330, the center of gravity is believed to cause the closure assembly to roll on the generally arcuate surface of the elongate member 52 such that the closure assembly falls off the yoke support 51*a*. Thus, closure assembly 30 is generally moved to one side of and along the longitudinal axis A-A as the locator 50 is moved from proximate the first position (FIG. 10A) to the second position (FIG. 10C) so that the central axis X-X of the face 37 is skewed with respect to the longitudinal axis and the expected flow rate is provided by the dry sprinkler.

Referring to the eleventh preferred embodiment as shown in FIGS. 11A-11E, another arrangement of components of the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the locator 50 includes a closure assembly 30 with an extended top portion 332 and a recessed chamber 332*a*. The closure assembly 30 includes a body 34 with a first end 30*a* and second end 30*b*. The first end 30*a* includes a top portion 332 that can be in the shape of a cone or, preferably, a right angle cylinder. The first end 30*a* preferably extends toward the second end 30*b*. The body portion 34 can be formed with a support surface 35 that, in a preferred embodiment, is generally planar. A recessed chamber 332*a* can be formed proximate the top portion 332. The recessed chamber 332*a* can be disposed symmetric to the longitudinal axis A-A. The chamber 332*a*, however, is disposed in an offset manner relative to the longitudinal axis A-A. The metallic disc annulus 36 is disposed on the closure assembly 30 so that the outer perimeter or a portion of the face 37 forms a seal with respect to the inlet 21. The face 37 is configured so as to surround the top portion 332. The body of closure assembly 30 is formed such that a majority of the mass of the closure assembly 30 is preferably located proximate top portion 332 proximate the first end 30*a* between the sealing surface 38*b* and the inlet 21 and offset to the longitudinal axis A-A. This allows for the center of gravity 332*b* of the closure assembly 30 to be spaced at a predetermined distance from the yoke 51 and offset along the longitudinal axis A-A.

The dry sprinkler of the preferred embodiment can be assembled in a similar manner as the previous embodiment.

In operation, when the dry sprinkler is actuated so that the locator 50 is translated from the first position to the second position, the face 37 separates from the sealing surface 38*b*. Because the center of gravity 332*b* located proximate the top portion 332, the center of gravity 332*b* is believed to cause the closure assembly 30 to roll on the generally arcuate surface 51*a* of yoke 51 such that the closure assembly may fall off the yoke surface 51*a*. Thus, closure assembly 30 is generally moved to one side of and along the longitudinal axis A-A as the locator 50 is moved from proximate the first position (FIG. 11A.) for the second position (FIG. 11C) 37 so that the central axis X-X of the face 37 is skewed to the longitudinal axis A-A and the expected flow rate is provided from the dry spindler.

Referring to the twelfth preferred embodiment, as shown in FIGS. 12A-12E, another arrangement of components of a locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, a closure assembly 30 with a tether is provided with a suitable tether assembly 414*a*, such as, for example, a cord, a wire, a chain, or a link. The tether assembly 414*a* can provide a restraining force that locates the closure assembly 30 on one side of the longitudinal axis A-A.

Preferably, as illustrated in FIGS. 12A-12D, the tether assembly 414*a* includes a cord 414*b* connected to a tether mount 414*c* by a first attachment device 414*d*. The cord 414*b* is also connected to the closure assembly 30 by a second attachment device 414*e*. The second attachment device 414*e* is located proximate the peripheral edge of the outlet facing surface 34*a* of the closure assembly 30 so that the second attachment device 414*e* is offset from the longitudinal axis A-A. The attachment devices 414*d*, 414*e* can be solder joints, rivets, or, preferably, screws. The tether mount 414*d* or 414*e* can be secured to the respective component by a press fit, an adhesive, a tack weld, or other suitable securement.

Figure 12C:
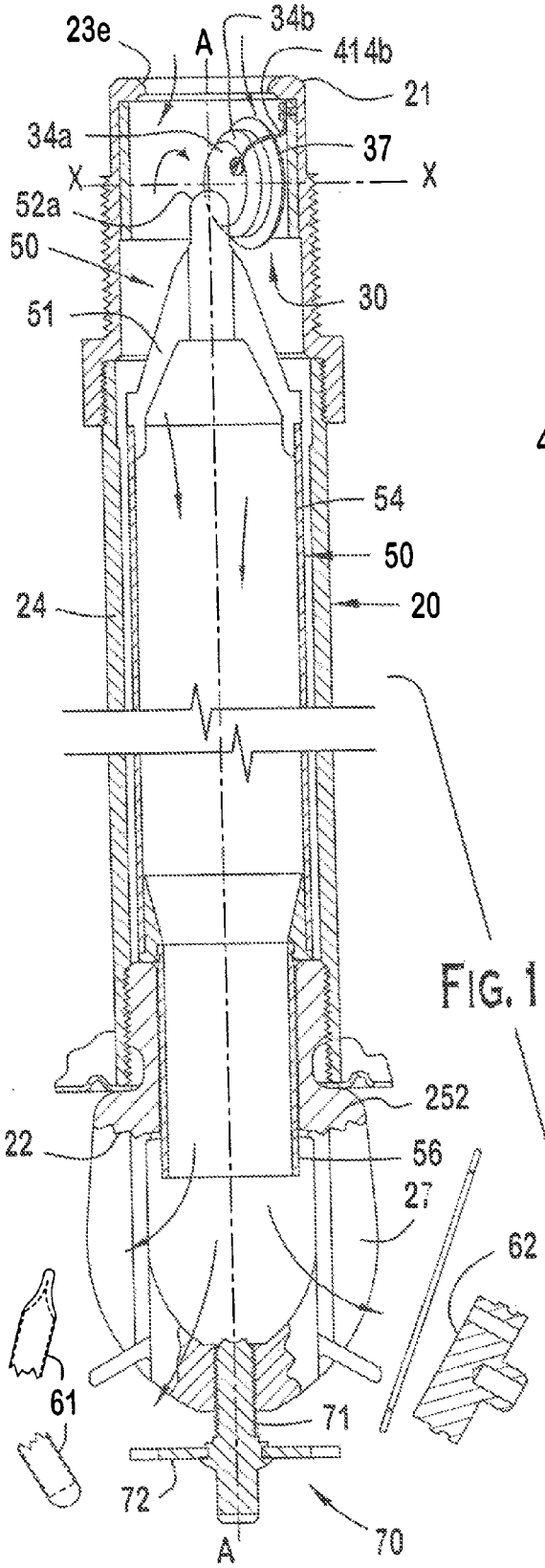
Figure 12D:
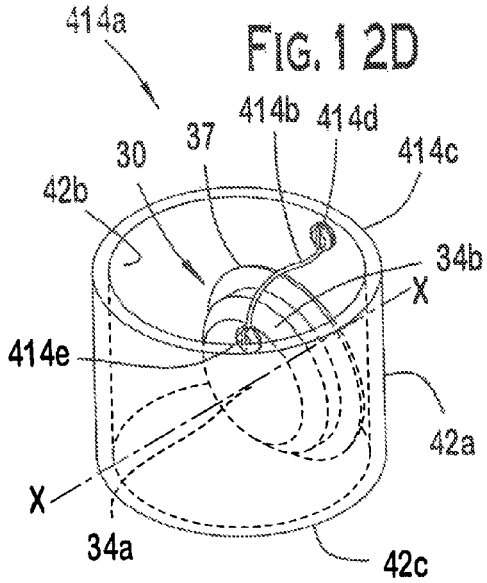
Figure 12E:
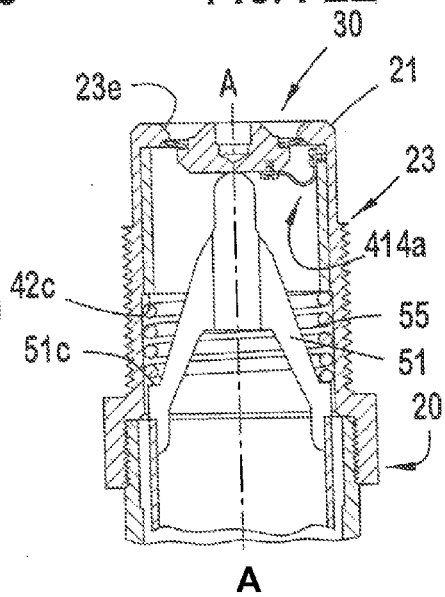

The dry sprinkler 10 of this embodiment can be assembled as described above in relation to the third preferred embodiment of the dry sprinkler and further in the following manner with regard to the tether assembly 414*a*. The closure assembly 30 is placed in the inlet 21 so that the outer perimeter or a portion of the face 37 contacts a sealing surface 38*b* of the inlet 21. A tether mount 414*d* is then connected to the inlet. The cord 414*b* is then coupled to closure assembly 30 at surface 34*a* by the second attachment device 414*e*. If an assist spring is desired, a biasing member 55, in the form of a coil spring, is thereafter placed into the interior surface 23*b* of the inlet fitting 23, as shown in FIG. 12E. Thus, a partially assembled dry sprinkler is provided 51 and trigger assembly 60 can be mounted to the partially assembled dry sprinkler to provide a complete dry sprinkler as described earlier.

In operation, when the dry sprinkler is actuated so that the locator 50 is translated from the first position to the second position, the face 37 separates from the sealing surface 38*b* and the closure assembly 30 begins to fall towards the outlet. However, the length of the cord 414*b* is less than the distance between the first position and the second position of the inner assembly 501 along the longitudinal axis A-A. As the closure assembly 30 moves along axis A-A, any slack in the cord 414*b* is taken up and the closure assembly 30 also begins to move along the arcuate surface 52*a* of the elongate member 52. Due in part to the restraining force of the cord 414*a* on the closure assembly 30 and the relative movement between the closure assembly 30 and the elongate member 52, the closure assembly 30 is sufficiently tipped to cause the center of mass of the closure assembly 30 to be offset relative to the longitudinal axis A-A, as shown in FIG. 4. Thus, closure assembly 30 is generally moved to be on one side of and along the longitudinal axis A-A as the inner assembly 501 is moved from proximate the first position (FIG. 12A) to the second position (FIG. 12C) so that the central axis X-X of the face 37 is skewed from the longitudinal axis A-A and the expected flow rated is provided by the dry sprinkler.

Figures 13A, 13B:
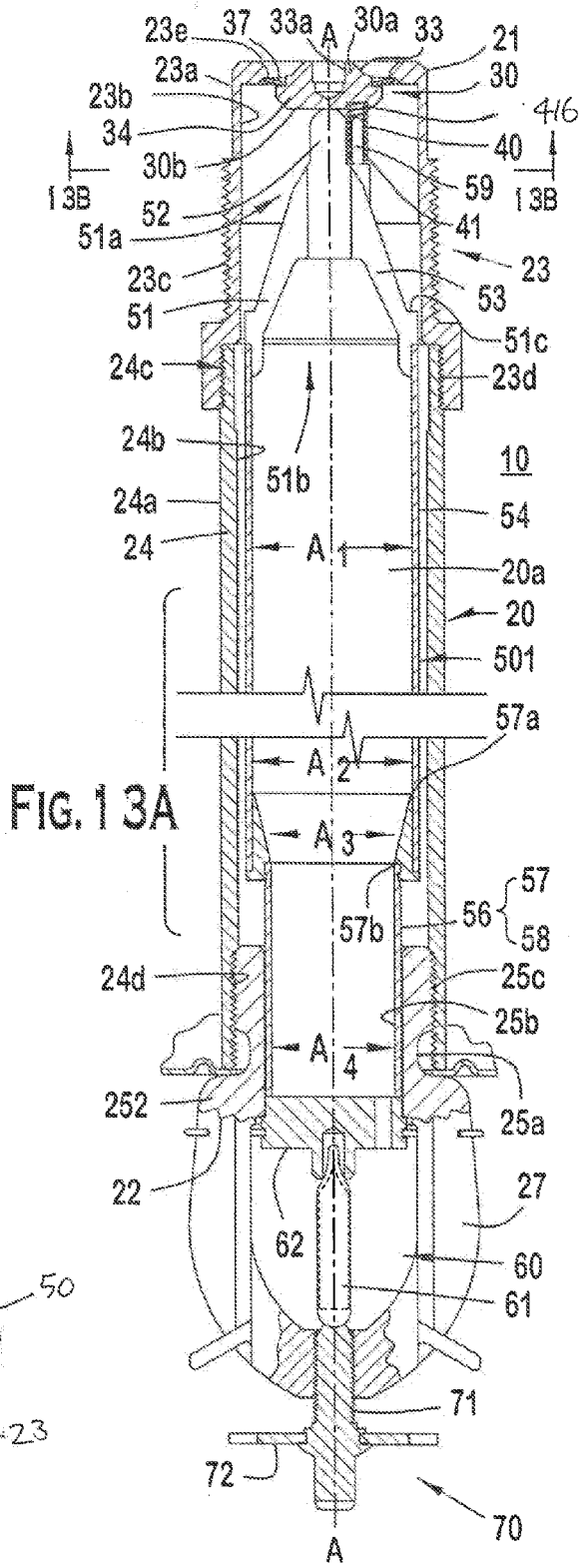

Referring to the thirteenth preferred embodiment, as shown in FIGS. 13A-13E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, as shown in FIGS. 13A, 13C, and 13D, closure assembly 30 has a first end 30*a* and second end 30*b*. A first portion 33 is adjacent a second portion 34. The second portion 34 is formed with a surface 34*a* facing the outlet end 22 and a beveled surface 34*b* abutting the peripheral edge of the outlet facing surface 34*a*. A spring retainer 34*c* is located proximate the peripheral edge of the outlet facing surface 34*a* so that the spring retainer 34*c* is offset from the longitudinal axis A-A. The spring retainer 34*c* can be a recess, as shown in the preferred embodiment of FIGS. 13A-13E. The spring retainer 34*c* allows one end 416*a* of a compression spring 416 to be disposed therein. Preferably, the compression spring 416 is a coil spring. A first end 416*a* of the compression spring 416 is supported on a yoke 51 of the inner assembly 501 via a post 59. A first end 416*a* of the compression spring 416 is in releasable engagement with the spring retainer 34*c* provided on the body of the closure assembly 30. Also preferably, the compression spring 416 has a spring force of approximately 5 to 8 pounds force.

The dry sprinkler 10 of this embodiment can be assembled as described above in relation to the third preferred embodiment of the dry sprinkler and further in the following manner with regard to the compression spring 416. The surface 36, which includes the first portion 33 and the face 37, is placed in the inlet 21 so that the outer perimeter or a portion of the face 37 contacts a sealing surface 38*b* of the inlet 21. Depending on whether an assist spring is desired, a spring spacer or sleeve 42 is inserted in the inlet fitting 23 and a biasing member 55, in the form of a coil spring, is thereafter placed into the interior surface 23*b* of the inlet fitting 23, as shown in FIG. 13E.

The second support end 51*b* of the multi-legged yoke 51 is pressed into the fluid tube 54 so that the multi-legged yoke 51 is coupled to the fluid tube 54. The second end 418*b* of compression spring 416 is then coupled to the multi-legged yoke 51 on post 59 so that the compression spring 416 rests on boss 53*a*. The fluid tube 54 is coupled to the guide tube 56 to form an inner assembly 501. The casing tube 24 is coupled by threads to the inlet fitting 23 and the inner assembly 501 can be inserted through the casing tube 24. As the inner assembly 501 is inserted through the casing tube 24, the first yoke support end 51*a* supports the closure assembly 30 to place the resilient face 37 of the metallic disc annulus 36 against the sealing surface 38*b* of the inlet fitting 23. The first end 416*a* of compression spring 416 contacts the closure assembly 30 at spring retainer 34*c*. Thus, a partially assembled dry sprinkler is provided at this point Thereafter, the yoke 51 and trigger assembly 60 can be mounted to the partially assembled dry sprinkler to provide a complete dry sprinkler.

In operation, when the dry sprinkler is actuated so that the locator 50 is translated from the first position to the second position, the compression spring 416 expands along the post 59 and the first end 416*a* of the compression spring 416 pushes on the body of the closure assembly 30 along the longitudinal axis A-A. The closure assembly 30 is therefore sufficiently tipped to one side of the longitudinal axis A-A to cause the center of mass of the closure assembly 30 to be offset relative to the longitudinal axis A-A, as shown in FIG. 13C, due in part by the spring force provided by the compression spring 416. Thus, closure assembly 30 is generally pushed by the compression spring 416 so that the central axis X-X of the face 37 is skewed to the longitudinal axis A-A and the expected flow rate is provided by the dry sprinkler.

Referring to the fourteenth preferred embodiment, as shown in FIGS. 14A-14E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, as shown in FIGS. 14A, 14C, and 14D, closure assembly 30 includes a body with a first end 30*a* and second end 30*b*. A first portion 33 is adjacent a second portion 34. The second portion 34 is formed with a surface 34*a* facing the outlet end 22 and a beveled surface 34*b* abutting the peripheral edge of the outlet facing surface 34*a*. A spring retainer 34*c* is located proximate the peripheral edge of the outlet facing surface 34*a* so that the spring retainer 34*c* is offset from the longitudinal axis A-A. The tension spring 418 is a coil spring. A second end 418*b* of the tension spring 418 is connected to a yoke 51 of the inner assembly 501. A first end 418*a* of the tension spring 418 is connected to the body of the closure assembly 30. Also preferably, the tension spring 418 has a spring force of approximately 5 to 8 pounds force, which is believed to be the minimum spring force required for operation of the preferred embodiment.

The tension spring 418 can be connected to the closure member 30 and the yoke 51 by screws, rivets, hook ends, or other suitable securement. Preferably, the second end 418*b* of the tension spring 418 includes a hook that passes through a hole 53*a* provided in the yoke and a screw 43 can connect the first end 418*a* of the tension spring 418 to the body of the closure assembly 30. The spring retainer 34*c* can be a screw that extends through a loop provided at the second end 418*b* of the tension spring 418 and is fastened to the body of the closure assembly 30 proximate the peripheral edge of the outlet facing surface 34*a*, FIG. 14D.

The dry sprinkler 10 of this embodiment can be assembled as described above in relation to the thirteenth preferred embodiment of the dry sprinkler and further in the following manner with regard to the tension spring 418. The surface 36, which includes the first portion 33 and the face 37, is placed in the inlet 21 so that the resilient sealing member contacts a sealing surface 38*b* of the inlet 21. Depending on whether an assist spring is desired, a spring spacer 28 is inserted in the inlet fitting 23 and a biasing member 55, in the form of a coil spring, is thereafter placed into the interior surface 23*b* of the inlet fitting 23.

The second support end 51*b* of the multi-legged yoke 51 is pressed into the fluid tube 54 so that the multi-legged yoke 51 is coupled to the fluid tube 54. The second end 418*b* of tension spring 418 is then coupled to the multi-legged yoke 51. The fluid tube 54 is coupled to the guide tube 56 to form the inner assembly 501. The casing tube 24 can be coupled by threads to the inlet fitting 23 and the inner assembly 501 can be inserted through the casing tube 24. As the inner assembly 501 is inserted through the casing tube 24, the first yoke support end 51*a* supports the closure assembly 30 to place the resilient face 37 of the metallic disc annulus 36 against the sealing surface 38*b* of the inlet fitting 23. The first end 418*a* of tension spring 418 is then attached to surface 34*a*, at spring retainer 34*c*, preferably with a screw 53. Thus, a partially assembled dry sprinkler is provided at this point. Thereafter, the yoke 51 and trigger assembly 60 can be mounted to the partially assembled dry sprinkler to provide a complete dry sprinkler as described earlier.

Figures 15A, 15B:
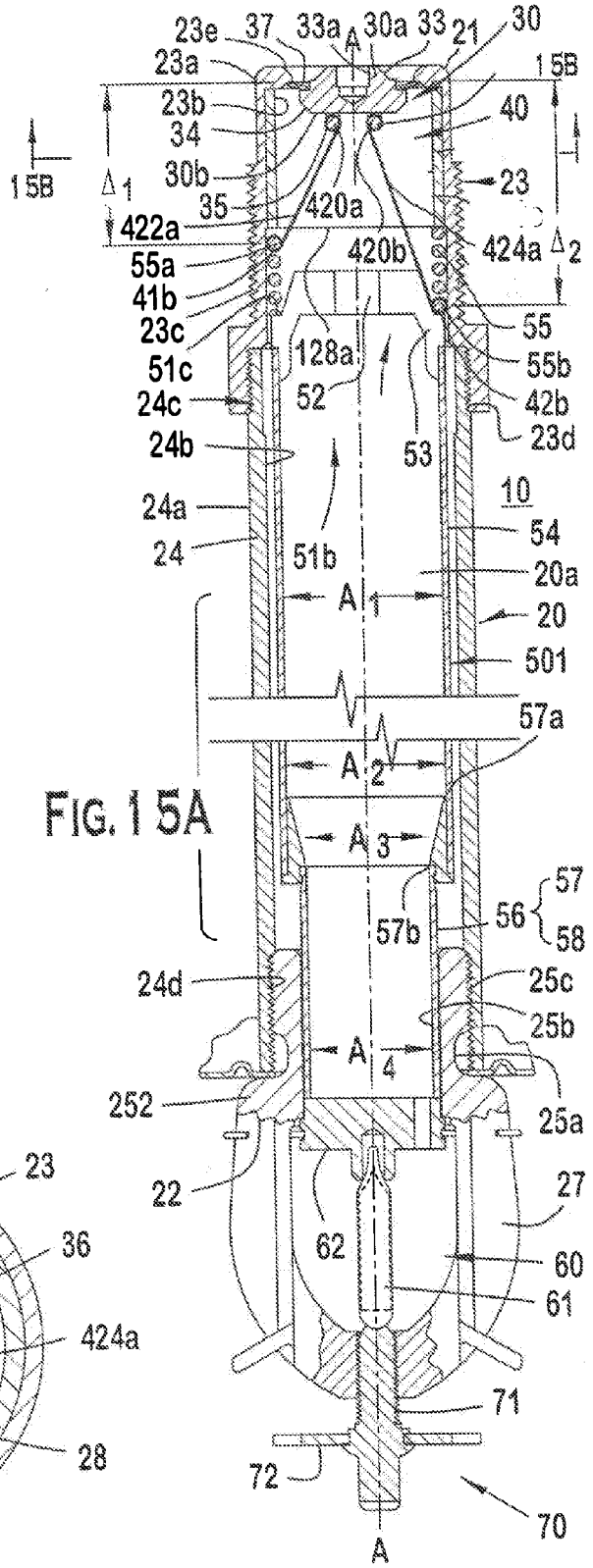

In operation, when the dry sprinkler is actuated so that the locator 50 is translated from the first position to the second position, the tension spring 418 contracts along the longitudinal axis A-A and the first end 418*a* of the tension spring 418 pulls on the body of the closure assembly 30 along the longitudinal axis A-A. Further contraction by the tension spring 418 moves the closure assembly 30 along the arcuate surface 52*a* of the elongate member 52. Thereafter, the closure assembly 30 is sufficiently tipped to one side of the longitudinal axis A-A to cause the center of mass of the closure assembly 30 to be offset relative to the longitudinal axis A-A, as shown in Fiore 13C, due in part by the spring force provided by the tension spring 418. Thus, closure assembly 30 is generally pulled by the tension spring 418 to be one side of and along the longitudinal axis A-A so that the central axis X-X of the face 37 is skewed from the longitudinal axis A-A and the expected flow rate is provided by the dry Referring to the fifteenth preferred embodiment, as shown in FIGS. 15A-15E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the closure assembly 30 includes a first portion 33 is adjacent a second portion 34. The second portion 34 is formed with a surface 34*a* facing the outlet end 22 and a beveled surface 34*b* abutting the peripheral edge of the outlet facing surface 34*a*. A first pivot 420*a* and a second pivot 420*b* extend from the outlet facing surface 34*a*. The first pivot 420*a* and the second pivot 420*b* each have a pivot axis that is transverse to the longitudinal axis A-A. Preferably, the transverse axes of the first pivot 420*a* and the second pivot 420*b* are approximately equidistantly spaced from the longitudinal axis A-A when the closure assembly 30 is in the non-actuated position. The closure assembly 30 is also connected to a strap assembly 422 that includes a first strap 422*a* and a second strap 424*a*. The second strap 424*a* is longer than the first strap 422*a*. First ends 422*b*, 424*b* of the straps 422*a*, 424*a*, respectively, are connected to the closure assembly 30, FIG. 15D. Second ends 422*c*, 424*c* of the straps 422*a*, 424*a*, respectively, are connected to a biasing member 55 (FIG. 15D). The first strap 422*a* and the second strap 424*a* cooperate to move the closure assembly 30 to the side of the longitudinal axis A-A and rotated 90 degrees to minimize the flow area, FIG. 15C. The first strap 422*a* and the second strap 424*a* can be made from a plastic material, a metallic material or other material that will provide sufficient rigidity so that the straps 422*a* and 424*a*, at most, minimally flexes when the closure assembly 30 is in either of the closed position or (FIG. 15A) the open position (FIG. 15C). As illustrated in FIGS. 15A, 15D and 15E, each ends of the straps 422*a*, 424*a* includes a loop for connecting the straps to the closure assembly 30 and to the biasing member 55. The loops of the first ends 422*b*, 424*b* are coupled to a respective one of the pivots 420*a*, 420*b*. The loops of the second ends 422*c*, 424*c* are coupled to respective first and second coil 55A and 55B.

The inner assembly 501 includes a truncated yoke 151 connected to the fluid tube 54 and guide tube 56. The truncated yoke 151 has preferably four legs 53 arrayed about the longitudinal axis A-A from a central portion 52. The truncated yoke 151 does not contact the closure assembly 30 in this embodiment.

In operation, when the dry sprinkler is actuated so that the locator 50 is translated along the longitudinal axis A-A from proximate the first position (FIG. 15A) to the second position (FIG. 15C), the second coil 55*b* of the biasing member 55 and the second end 420*c* of the second strap 424*a* translate along the longitudinal axis A-A while the first coil 55*a* of the biasing member 55 and the second end 422*c* of the first strap 422*a* remain proximate the edge 128*a* of the spring spacer 128. As the second end 55*b* of the biasing member 55 translates along the longitudinal axis A-A, the second strap 424*a* pulls the closure assembly 30 along the longitudinal axis A-A and pivots the first strap 422*a* about the first coil 55*a* at pivot 427. The first strap 422*a* pushes the closure assembly toward a side of the longitudinal axis A-A as the first strap 422*a* pivots about the first coil 55*a* at pivot 427. In turn, the closure assembly 30 pivots about both of the pivots 420*a*, 420*b* to locate the sealing surface on a side of the longitudinal axis A-A, FIG. 15D. The sealing surface 37 is pivoted about the transverse axes by the pulling the transverse axes of the second pivot 420*b* a first side of the longitudinal axis A-A and by the pushing the transverse axes of the first pivot 420*a* to the first side of the longitudinal axis A-A from a second side of the longitudinal axis A-A that is opposite to the first side. Thus, relative motion between the second end 422*c* of the first strap 422*a* and the second end 424*c* of the second strap 424*a* pivots the closure assembly 30 about the transverse axes of the pivots 420*a*, 420*b* so that the central axis X-X of the face 37 is skewed with respect to the longitudinal axis A-A and the expected flow rate is provided by the dry sprinkler.

Referring to the sixteenth preferred embodiment, as shown in FIGS. 16A-16E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the closure assembly 30 includes a second portion 34 formed with a surface 34*a* facing the outlet end 22 and a beveled surface 34*b* abutting the peripheral edge of the outlet facing surface 34*a*. A pivot 426 extends from the outlet facing surface 34*a*. The pivot 426 has a pivot axis B-B that is transverse to the longitudinal axis A-A. Preferably, the transverse axis B-B of the pivot 426 is offset from the longitudinal axis A-A when the closure assembly 30 is in the non-actuated position, FIG. 16A. A face 37 of a metallic disc annulus disc 36 is mounted so as to surround the first portion 33.

Preferably, as illustrated in FIGS. 16A, 16B, and 6D, a strap 428 includes a first end 428*a* connected to the closure assembly 30 and a second end 428*b* connected to a biasing member 55. The strap 428 moves the sealing surface 37 of the closure assembly 30 to the side of the longitudinal axis A-A, FIG. 16E. The strap 428 can be made from a plastic material, a metallic material or other material that will provide sufficient rigidity so that the strap 428 does not flex when the closure assembly 30 is in either of the closed position or (FIG. 16B) the open position (FIG. 16C). In the preferred embodiment as illustrated in FIGS. 16A-16E, each end 428*a*, 428*b* of the strap 428 includes a loop for connecting the strap 428 to the closure assembly 30 and to the biasing member 55. The loop of the first end 428*a* is coupled to the pivot 426. The biasing member 55 can include a coil spring. The loop of the second end 428*b* of the strap 428 is pivotally coupled to a first coil 55*a* at pivot 427.

In operation, when the dry sprinkler is actuated, the closure assembly 30 moves along the longitudinal axis A-A from proximate the first position (FIGS. 16A and 16D) to the second position (FIGS. 16C and 16E), the strap 428 pivots from a first strap position (FIGS. 16A and 16D)—where the strap 428 is spaced from the elongate member 52 of the yoke 51—to a second strap position (FIGS. 16C and 16E)—where the strap 428 engages the elongate member 52 to move the sealing surface of the closure assembly 30 about the transverse axes of the pivots 426 and 427—so that the face 37 of the metallic disc 36 is located on one side of the longitudinal axis A-A.

The coil 55*a* of the biasing member 55 and the second end 428*b* of the strap 428 remain proximate the edge 28*a* of the spring spacer as the inner assembly 501 translates along the longitudinal axis A-A. The strap 428 pivots about the coil 55*a* of the biasing member 55 and pushes the closure assembly 30 along the arcuate surface 52*a* of the elongate member 52. The strap 428 has a length sufficient to move the pivot 426, and the transverse axis of the pivot 426, from a first side of the longitudinal axis A-A to the a second side of the longitudinal axis A-A opposite the first side when the strap 428 engages the elongate member 52 of the yoke 51, FIG. 16D. Here, the closure assembly 30 is sufficiently tipped about the transverse axis of the pivot 426 to cause the center of mass of the closure assembly 30 to be offset relative to the longitudinal axis A-A, as shown in FIG. 16E, due in part by the motive force provided by the strap 428. Thus, the closure assembly 30 is generally moved by the strap 428 to be on a side of and along the longitudinal axis A-A as the inner assembly 501 is moved from proximate the first position (FIGS. 16A and 16D) to the second position (FIGS. 16C and 16E) so that the central axis X-X of the face 37 is skewed with respect to the longitudinal axis A-A and the expected flow rate is provided by the dry sprinkler.

Referring to the seventeenth preferred embodiment, as shown in FIGS. 17A-171, another configuration of the locator 50 is provided for repositioning of the face 37 so that the central axis X-X of the face 37 is skewed to the longitudinal axis A-A in an actuated condition of the dry sprinkler 10 and the expected flow rate to be achieved from the dry sprinkler. A closure assembly 300 includes a main body 300*a* and cap 300*b*. The main body 300*a* includes a first portion 33 that is adjacent to a second portion 34. The second portion 34 cooperates with the cap 300*b* to form a hole 300*c*. The cap 300*b* can be attached to the main body 300*a* by one or more screws 300*d*, or by any other fastener suitable for connecting the main body 300*a* and the cap 300*b*. The closure assembly 300 is mounted via the hole 300*c* for pivoting motion about a pivot axis B-B, which orthogonally intersects the longitudinal axis A-A. The hole 300*c* allows for rotation of the closure assembly 300 in the activated configuration. Alternatively, in lieu of a single hole 300*c*, relative pivoting may be accomplished by a pair of blind holes located on opposite sides of the second portion 34 and aligned along the pivot axis B-B, or any suitable arrangement that provides a shaft with a bearing surface about which the closure assembly 300 pivots. The inner assembly 501 can include a two-legged member 51, a fluid tube 54, and a guide tube 56. The member 51 is coupled to the fluid tube 54, and the fluid tube 54 is coupled to the guide tube 56, and the guide tube 56, is coupled to the trigger seat 62. The inner assembly 501 may optionally include a biasing member 55 (see FIG. 17 G).

The two-legged member 51 includes a throw journal 510 located between a first in journal 512 and a second main journal 514, and thus may be shaped similar to a crankshaft. The first main journal 512 is pivotally disposed within a first bearing 542 defined by the fluid tube 54, the second main journal 514 is pivotally disposed within a second bearing 544 defined by the fluid tube 54, and the throw journal 510 is pivotally disposed within the hole 300*c*, which defines a third bearing. The third bearing, i.e., the hole 300*c*, is preferably offset along the longitudinal axis A-A with respect to the first and second bearings 542,544.

Figures 17C, 17D, 17E:
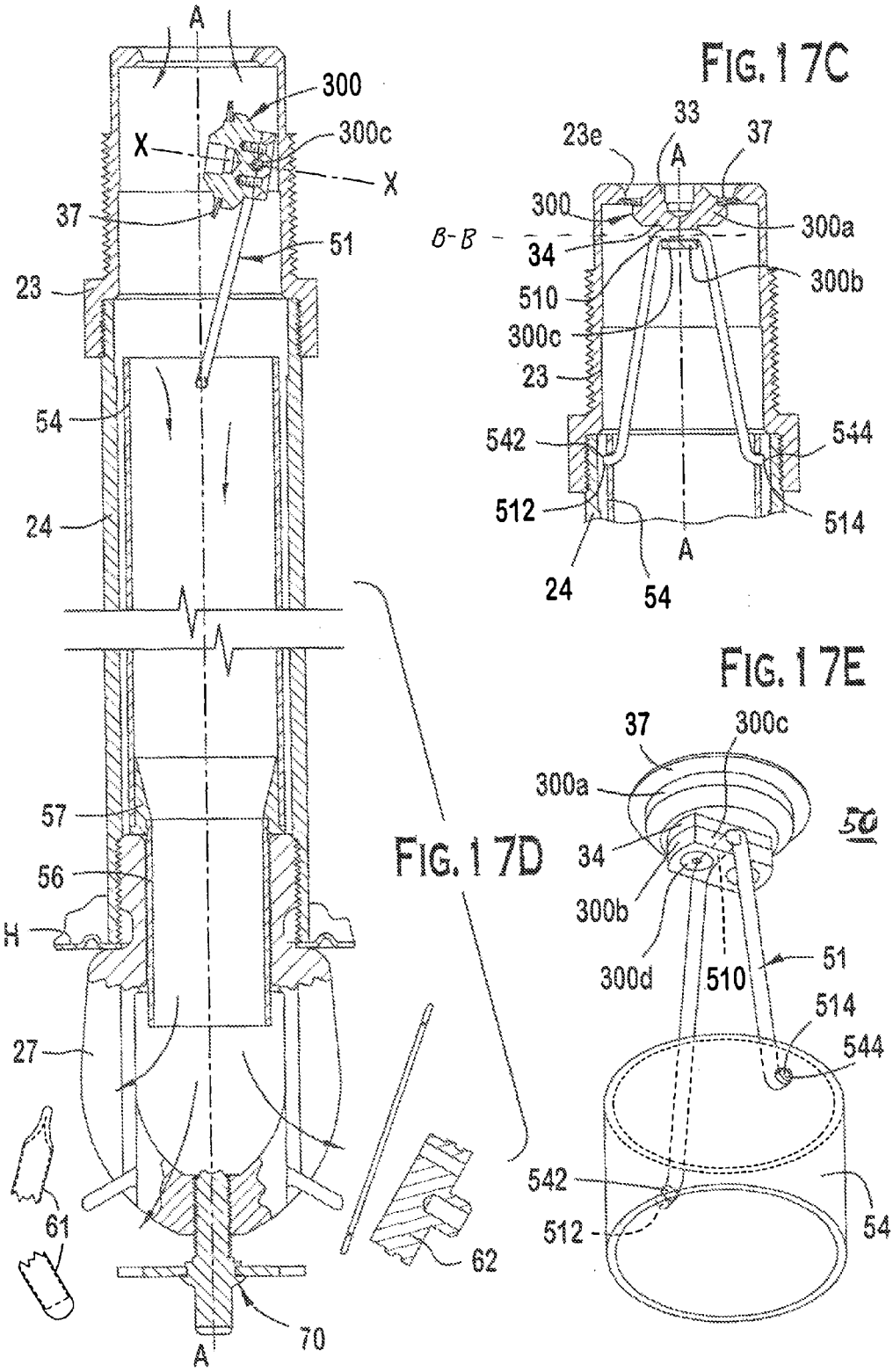
Figure 17F:
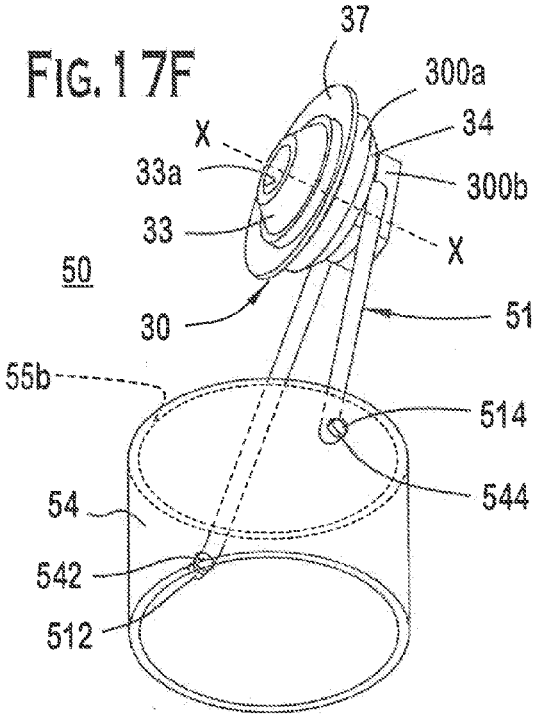
Figure 17G:
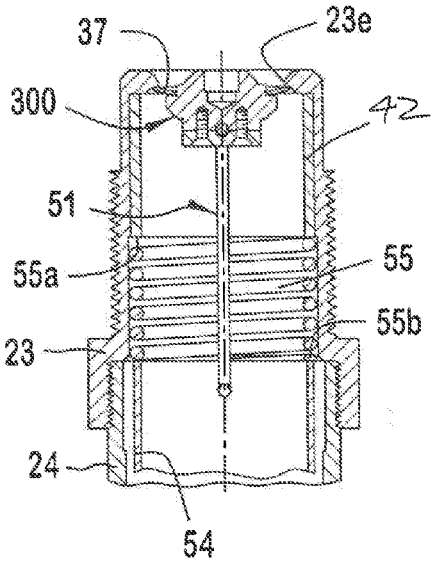

Thus, as seen in FIG. 17G, the two-legged member 51 supports the closure assembly 300 relative to the inner assembly 501 such that, in the closed position of the dry sprinkler 10, the first, second, and third bearings 542,544,300*c* lie in a plane that also includes the longitudinal axis A-A. In the actuated or open position of the dry sprinkler 10, the two-legged member 51 cooperates with the fluid tube 54 and with the closure assembly 300 to move the closure assembly 300 to a side of the longitudinal axis A-A so that the central axis X-X of the face 37 is skewed with respect to the longitudinal axis A-A and the expected flow rate is provided by the dry sprinkler.

Figure 17H:
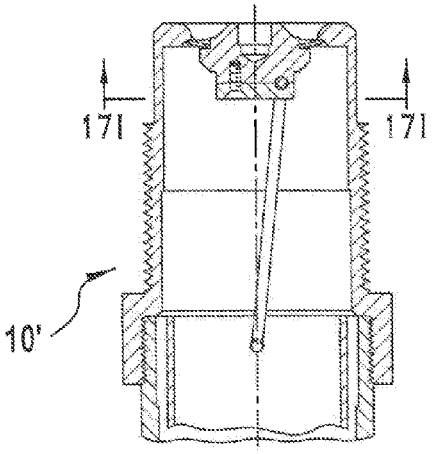
Figure 17I:
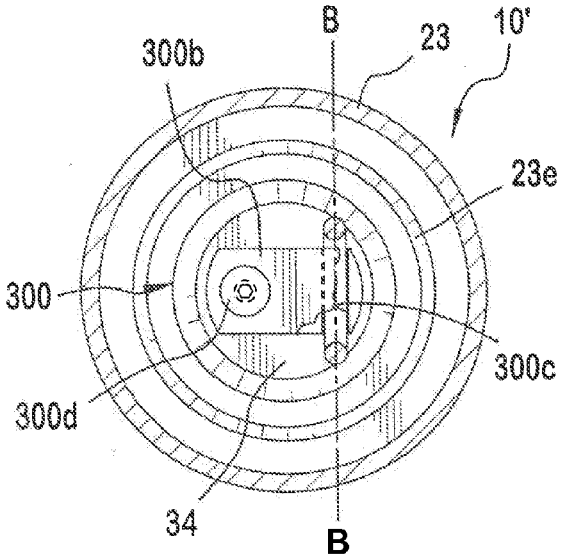

Referring now to FIGS. 17H and 17I, another configuration of the locator 50 is provided for repositioning of the face 37 so that the central axis X-X of the face 37 is skewed to the longitudinal axis A-A in an actuated condition of the dry sprinkler 10 and the expected flow rate to be achieved from the dry sprinkler. Specifically, in the closed position of the dry sprinkler 10, the plane that contains the first, second, and third bearings 542,544,300*c* is obliquely oriented with respect to the longitudinal axis A-A. The amount that the pivot axis B-B is offset from the longitudinal axis A-A is selected so as to minimally affect the engagement of the face 37 with the inlet fitting 23. That is to say, the effect of the asymmetrical support provided by the member 51 should not prevent the face 37 from properly engaging with the inlet fitting 23 so as to occlude the inlet opening 23*e*. By virtue of the pivot axis B-B being offset from the longitudinal axis A-A, the closure assembly 300 cannot avoid pivoting when the inner assembly 501 moves away from the first position.

The dry sprinkler of this embodiment can be assembled as described above in relation to the third preferred embodiment of the dry sprinkler and further in the following manner with regard to the first through third bearings and throw journal. The locator 50, including the closure assembly 30, two-legged member 51, the fluid tube 54, and the guide tube 56, are sub-assembled together, and then the whole subassembly is positioned in the casing tube 24. A guide tool is inserted, in the direction of fluid flow, through the inlet opening 23*e* and is engaged with the opening 33*a* of the closure assembly. The biasing member 55 may optionally be fitted inside the inlet fitting 23 so as to cincture the guide tool. If necessary, a sleeve 42 may also be inserted in the inlet fitting 23 to provide a seat for the biasing member 55. The tool is used to guide the closure assembly 30 the occluding position with respect to the inlet opening 23*e*, and the casing tube 24 and inlet fitting 23 are threadably coupled. While continuing to use the guide tool to maintain the closure assembly 30 in the occluding position, the outlet frame (25,251,252) including the triggering mechanism 60 is threadably coupled to the casing tube 24. Next, the adjustment screw 71 is adjusted to a sufficiently high torque value that in the final assembled position, the screw 71 in conjunction with the outer surface 25*a* will cause the outer perimeter or a portion of the face 37 to be compressed against the inlet sealing surface 38*b* and maintain all components at their intended position without damaging the frangible bulb 61.

The subassembly of the inner assembly 501 can include the following steps, The journal 510 of the two-legged member 51 can be positioned in the portion of the third bearing 300*c* defined by the main body 30*a*. The cap 30*b* is then coupled to main body 30*a* by one or more screws 30*d*, whereby the second portfolio 34 and cap 30*b* define the hole 300*c* that receives the throw journal 510. The first and second journals 512,514, of two legged member 51 are then held in an elastically deformed condition, aligned with the corresponding first and second bearings 542,544, and released from the elastically deformed condition so as to be received in the corresponding first and second bearings 542,544. Thus, a partially assembled dry sprinkler is provided at this point. Thereafter, the two-legged yoke 51 and trigger assembly 60 can be mounted to the partially assembled dry sprinkler to provide a complete dry sprinkler as described earlier.

In operation, when the dry sprinkler is actuated so that the locator 50 is translated, the closure assembly 300 is sufficiently rotated to cause the center of mass of the closure assembly 300 to be offset relative to the longitudinal axis A-A, as shown in FIGS. 17D and 17F, due in part to the propensity of the two-legged member 51 to pivot about all three of its journals 510,512,514. Thus, the central axis X-X of the face 37 is skewed with respect to the longitudinal axis A-A and the expected flow rate is achieved from the dry sprinkler as the locator 50 is moved from proximate the first position (FIG. 17A) to the second position (FIG. 17D).

Referring to the eighteenth preferred embodiment as shown in FIGS. 18A-181, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, closure assembly 30 includes a body with a first end 30*a* and second end 30*b*. The second end 30*b* includes a first contact area 30*c* that faces the outlet end 22. The first contact area 30*c* defines a pivot point that is coincidental with the longitudinal axis A-A. The inner assembly 501 can include a two-legged member 51, a fluid tube 54, and a guide tube 56. The member 51 is coupled to the fluid tube 54, and the fluid tube 54 is coupled to the guide tube 56, and the guide tube 56 is coupled to the trigger seat 62. The locator 50 may optionally include a biasing member 55 (see FIG. 18G). The two-legged member 51 includes a throw journal 510*a* located between a first main journal 512*a* and a second main journal 514*a*, and thus maybe shaped similar to a crankshaft. The first main journal 512*a* is pivotally disposed within a first bearing 542*a* defined by the fluid tube 54, the second main journal 514*a* is pivotally disposed within a second bearing 544*a* defined by the fluid tube 54, and the throw journal 510*a* is pivotally received by the recess 30*c*, which defines a partial bearing. The partial bearing, i.e., the recess 30*c*, is offset with respect to the first and second bearings 542*a*,544*a*.

Thus, as best seen in FIG. 18A the two-legged member 51 supports the closure assembly 30 relative to the inner assembly 501 such that, in the closed position of the dry sprinkler 10, the first, second, and partial bearings 542*a*,544*a*,30*c* lie in a plane that also includes the longitudinal axis A-A. In the open position of the dry sprinkler 10, the two-legged member 51 cooperates with the fluid tube 54 and with the closure assembly 30 to move the closure assembly 30 to a side of the longitudinal axis A-A.

The dry sprinkler 10 of this embodiment can be assembled as described above in relation to the assembly description of the first preferred embodiment and further in the following manner with regard to the main and throw journals. The locator 50, including the closure assembly 30, the two-legged member 51, the fluid tube 54, and the guide tube 56, are sub-assembled together as a subassembly and then the whole subassembly is positioned in the casing tube 24. A guide tool is inserted, in the direction of fluid flow, through the inlet opening 23*e* and is engaged with the opening 33*a* of the closure assembly. The biasing member 55 may optionally be fitted inside the inlet fitting 23 so as to cincture the guide tool. If necessary, a sleeve 42 may also be inserted in the inlet fitting 23 to provide a seat for the biasing member 55. The tool is used to guide the closure assembly 30 the occluding position with respect to the inlet opening 23*e*, and the casing tube 24 and inlet fitting 23 are threadably coupled. While continuing to use the guide tool to maintain the closure assembly 30 in the occluding position, the outlet frame (25,251,252) including the triggering mechanism 60 is threadably coupled to the casing tube 24. Next, the adjustment screw 71 is adjusted to a sufficiently high torque value that in, the final assembled position, the screw 71 in conjunction with the outer surface 25*a* will cause the outer perimeter or a portion of the face 37 to be compressed against the inlet sealing surface 38*b* and maintain all components at their intended position without damaging the frangible bulb 61.

The subassembly of the inner assembly 501 can include the following steps. The first and second journals 512*a*,514*a*, of two legged member 51 are held in an elastically deformed condition, aligned with the corresponding first and second bearings 542*a*,544*a*, and released from the elastically deformed condition so as to be received in the corresponding first and second bearings 542*a*,544*a*. The journal 510*a* of the two-legged member 51 can then be positioned in the recess 30*c* defined by the main body 30*a*. Thus, a partially assembled dry sprinkler is provided at this point. Thereafter, the two-legged yoke 51 and trigger assembly 60 can be mounted to the partially assembled dry sprinkler to provide a complete dry sprinkler as described earlier.

Figure 18F:
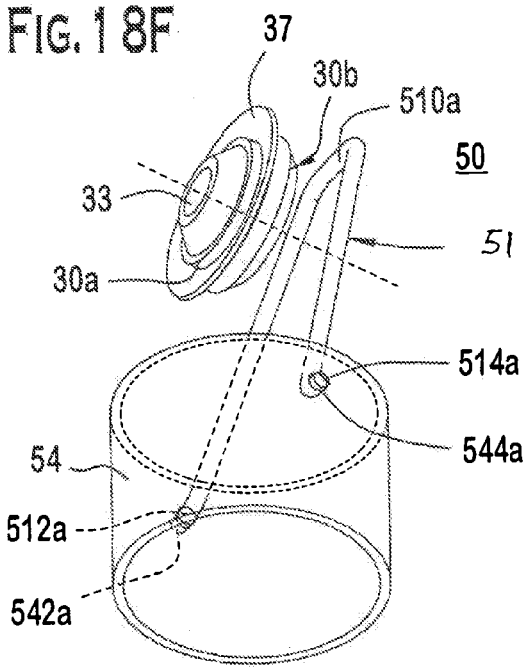
Figure 18G:
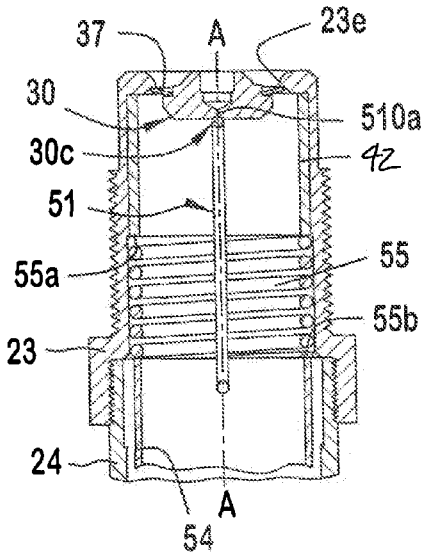
Figure 18H:
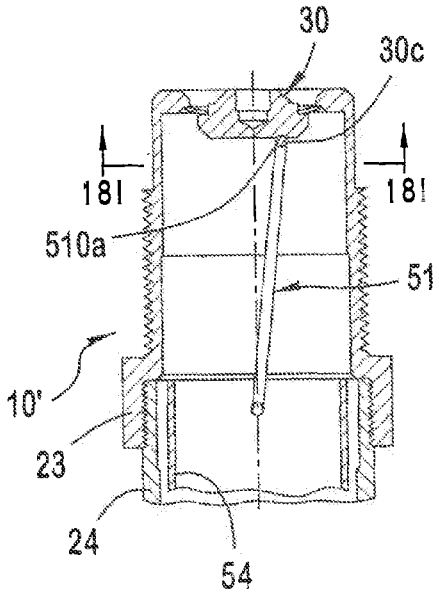
Figure 18I:
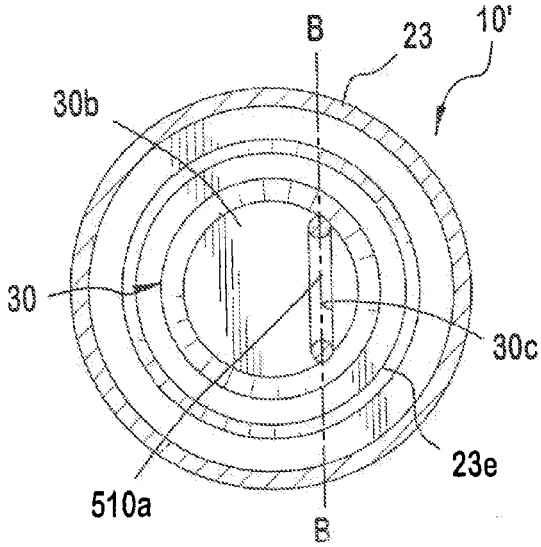
Figures 20C, 20D, 20E, 20F:
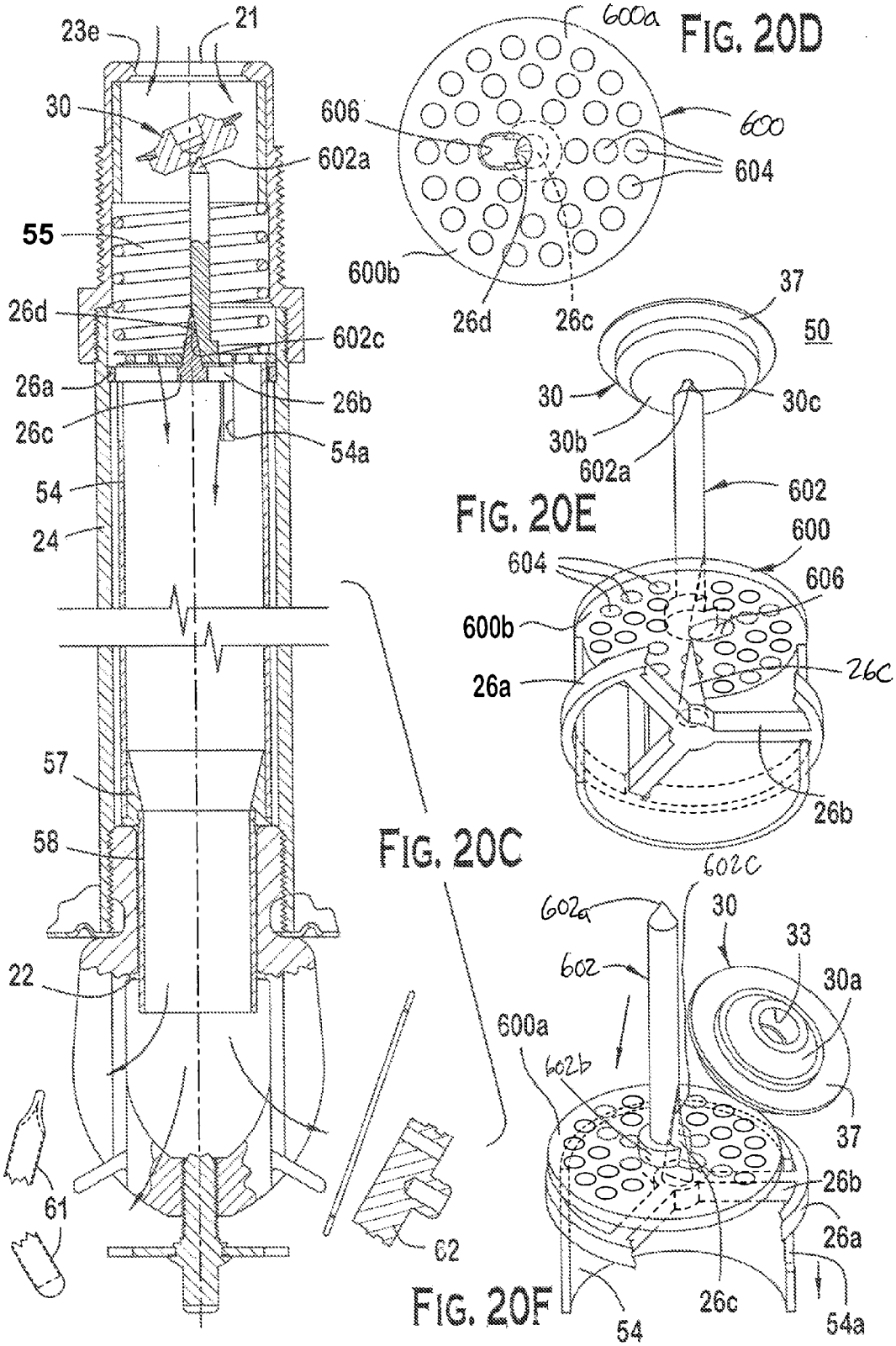
Figure 21F:
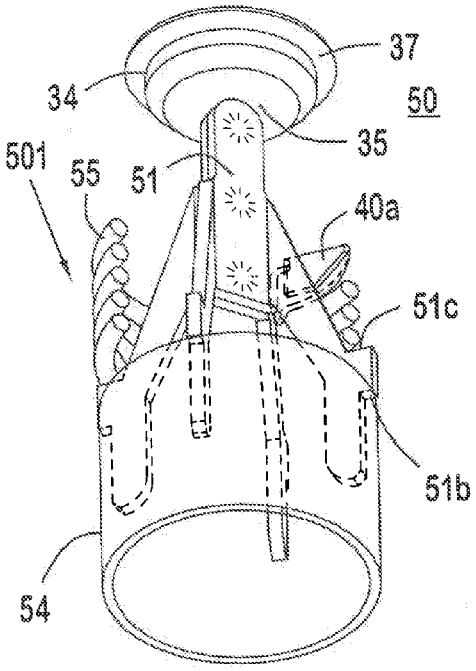
Figure 21G:
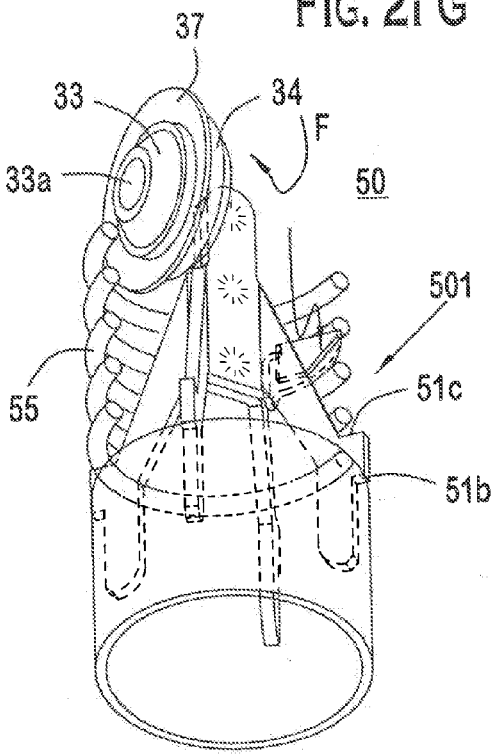
Figure 21H:
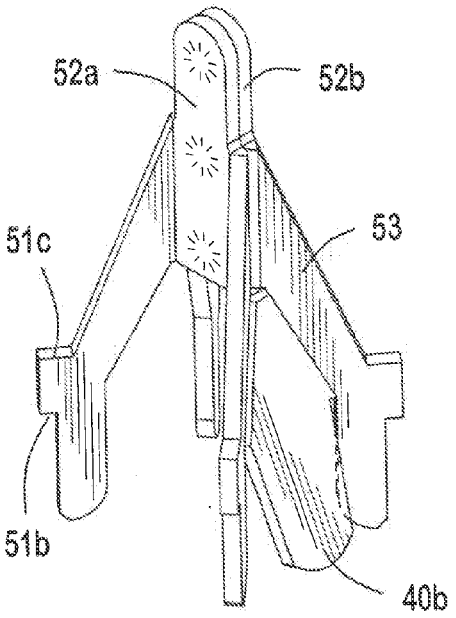
Figure 21I:
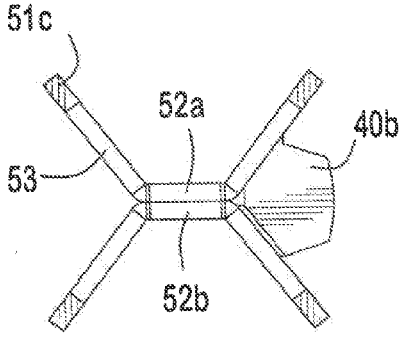

In operation, when the dry sprinkler is actuated so that the locator 50 is translated, the closure assembly 30 is sufficiently pivoted to cause the center of mass of the closure assembly 30 to be offset relative to the longitudinal axis A-A, as shown in FIGS. 18D and 18F, due in part to the propensity of the two-legged member 51 to pivot about all three of its journals 510*a*,512*a*,514*a*, and of the recess 30*a* to release from the two-legged member 51. Thus, closure assembly 30 is released and generally moves to one side of and along the longitudinal axis A-A as the inner assembly 501 is moved from proximate the first position (FIG. 18A) to the second position (FIG. 18D) so that the central axis X-X of the face 37 is skewed with respect to the longitudinal axis A-A and the expected flow rate is provided by the dry sprinkler.

Referring to the nineteenth preferred embodiment as shown in FIGS. 19A-19E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the inner assembly 501 includes a yoke 520, a bar 521, a fluid tube 54, and a guide tube 56. The yoke 520 includes a plurality of apertures 522*b* and a second contact area 522*c*. The plurality of apertures 522*b* each perforates the yoke 520 and is spaced from the longitudinal axis A-A. Preferably, the yoke 520 is in the form of a generally planar support plate that has a thickness measured parallel to the longitudinal axis A-A between a first surface 523*a* and a second surface 523*b*. Thus, each of the plurality of apertures 522*b* connects the first and second surfaces 523*a*, 523*b*. Preferably, the first surface 523*a* of the yoke 520 faces the inlet, and the second surface 523*b* of the yoke 520 faces the outlet.

The second contact area 522*c* is coincident with the longitudinal axis A-A, and has a depth less than the thickness of the yoke 520. Preferably, the second contact area 522*c* is provided on the first surface 523*a* of the yoke 520. The bar 521 extends along the longitudinal axis A-A between a first end 521*a* and a second end 521*b*. The first end 521*a* is cooperatively received in the first contact area 30*c* of the closure assembly 30, and the second end 521*b* is cooperatively received in the second contact area 522*c* of the yoke 520.

The dry sprinkler 10 of this embodiment can be assembled as described above in relation to the assembly description of the first preferred embodiment and further in the following manner with regard to the pivoting bar 521 and yoke 520. The locator 50, including the closure assembly 30, yoke 51, the fluid tube 54, and the guide tube 56, are sub-assembled together, and then the whole subassembly is positioned in the casing tube 24. A guide tool is inserted, in the direction of fluid flow, through the inlet opening 23*e* and is engaged with the opening 33*a* of the closure assembly. A temporary fixture is used to position the bar 521 within the inlet fitting 23 such that the first end 521*a* is cooperatively received in the first contact area 30*c* of the closure assembly 30. The biasing member 55 may optionally be fitted inside the inlet fitting 23 so as to cincture the guide tool. If necessary, a sleeve 42 may also be inserted in the inlet fitting 23 to provide a seat for the biasing member 55. The tool is used to guide and maintain the closure assembly 30 in the occluding position with respect to the inlet opening 23*e* while the casing tube 24 with the inner assembly 501 therein is threadably coupled to the inlet fitting 23. At the same time, the second end 521*b* of the bar 521 is cooperatively received in the second contact area 522*c* of the yoke 51. While continuing to use the guide tool to maintain the closure assembly 30 in the occluding position, the outlet frame (25,251,252) including the triggering mechanism 60 is threadably coupled to the casing tube 24. Next, the adjustment screw 71 is adjusted to a sufficiently high torque value that in the final assembled position, the screw 71 in conjunction with the outlet frame will cause the outer perimeter or a portion of the face 37 to be compressed against the inlet sealing surface 38*b* and maintain all components at their intended position without damaging the frangible bulb 61.

In operation, when the inner assembly 501 (the yoke 520, bar 521, fluid tube 54, and guide tube 56) is translated along axis A-A due to actuation of the dry sprinkler, the face 37 separates from the sealing surface 38*b*, and the support at the two pivot points becomes unstable due to the absence of the bar 521 supporting the closure assembly 30 with respect to the yoke 520. In particular, relative pivoting motion occurs at the interface between the first contact area 30*c* and the first end 521*a* of the bar 521, or between the second contact area 522*c* and the second end 521*b* of the bar 521, or both. As the closure assembly 30 translates along axis A-A, and by virtue of the bar 521 being longer than the inside diameter of the outer structure 20, the bar 521 falls to an inclined position relative to the longitudinal axis A-A. Consequently, the face 37 is also tipped so as be obliquely oriented with respect to the longitudinal axis A-A. Thus, closure assembly 30 is generally moved to one side of and along the longitudinal axis A-A as the locator 50 is moved from proximate the first position (FIG. 19A) to the second position (FIG. 19C) so that the central axis X-X of the face 37 is skewed with respect to the longitudinal axis A-A and the expected flow rate is provided by the dry sprinkler.

Referring to the twentieth preferred embodiment as shown in FIGS. 20A-20F, an arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In this embodiment, the structure 20 includes a dislodgment member 26 supported by the casing tube 24. The dislodgment member 26 includes a base 26*a* that is secured with respect the casing tube 24. At least one radially inward extending arm 26*b* connects the base 26*a* to a kicker 26*c*. Preferably, the kicker 26*c* projects along the longitudinal axis A-A toward the inlet end 21. The kicker 26*c* includes a first oblique surface 26*d* relative to the longitudinal axis A-A. The inner assembly 501 can include a yoke 600, a post 602, a fluid tube 54, and a guide tube 56. In the non-actuated configuration, the yoke 600 is coupled to the fluid tube 54, and the fluid tube 54 is coupled to the guide tube 56, and the guide tube 56 is coupled to the trigger seat 62. The yoke 600 includes a plurality of fluid flow apertures 604 and a dislodgment aperture 606. The pluralities of fluid flow apertures 604 each perforates the yoke 600 and are spaced from the longitudinal axis A-A. Preferably, the yoke 600 is in the form of a generally planar support plate that has a thickness measured parallel to the longitudinal axis A-A between a first surface 600*a* and a second surface 600*b*. Thus, each of the plurality of fluid flow apertures 604 connects the first and second surfaces 600*a*, 600*b*. Preferably, the first surface 600*a* of the yoke 600 faces the inlet 21, and the second surface 600*b* of the yoke 600 faces the outlet end 22.

Preferably, the second surface 600*b* includes a support surface that is spaced from the longitudinal axis A-A and contacts the fluid tube 54 to support the yoke 600. And the second surface 600B includes a contact surface that is coincident with the longitudinal axis A-A. Each of the first and second surfaces 600*a*, 600*b* having a surface area that is less than the cross-sectional area, generally perpendicular to the longitudinal axis A-A, of the passageway 20*a*.

The dislodgment aperture 606 includes an elongated hole that extends radially with respect to the longitudinal axis A-A. The plurality of fluid flow apertures 604 and the dislodgment aperture 606 connect the first and second surfaces 600*a*, 600*b* of the yoke 600.

The post 602 extends along the longitudinal axis A-A between a first end 602*a* and a second end 602*b*. The first end 602*a* is cooperatively received in the first recess 30*c* of the closure assembly 30, and the second end 602*b* sits on the first surface 600*a* of the yoke 600. Proximate the second end 602*b* of the post 602, there is a second oblique surface 602*c* relative to the longitudinal axis A-A. Preferably, the first and second oblique surfaces 26*d*,602*c* have the same angle of inclination with respect to the longitudinal axis A-.A.

The dry sprinkler 10 of this embodiment can be assembled as described above in relation to the previous embodiment of the dry sprinkler and further in the following manner with regard to the sliding bar and dislodgment member. The inlet fitting 23 is positioned such that the inlet opening 23*e* is on the bottom. A guide tool is inserted, in the direction of fluid flow, through the inlet opening 23*e* and is engaged with the opening 33 of the closure assembly. A temporary fixture is used to position the post 602 within the inlet fitting 23 such that the first end 602*a* is cooperatively received in the first recess 30*c* of the closure assembly 30. The biasing member 55 may optionally be fitted inside the inlet fitting 23 so as to cincture the post 602. The yoke 600 is engaged with the second end 602*b* of the post 602. The inner assembly 501, including the fluid tube 54 and the guide tube 56, are sub-assembled together, and then the inner assembly 501 is positioned in the casing tube 24 such that the slots 54*a* slidably receive a corresponding one of the radially inward extending arms 26*b* of the dislodgment member 26. The tool is used to guide and maintain the closure assembly 30 in the occluding position with respect to the inlet opening 23*e* while the casing tube 24 with the inner assembly 501 therein is threadably coupled to the inlet fitting 23. While continuing to use the guide tool to maintain the closure assembly 30 in the occluding position, the outlet frame (25,251,252) including the triggering mechanism 60 is threadably coupled to the casing tube 24. Next, the adjustment screw 71 is adjusted to a sufficiently high torque value that in the final assembled position, the screw 71 in conjunction with the outer surface 25*a* will cause the outer perimeter or a portion of the face 37 to be compressed against the inlet sealing surface 38*b* and maintain all components at their intended position without damaging the frangible bulb 61.

In operation, when the dry sprinkler is actuated, the closure assembly 30 and inner assembly 501 (the yoke 600, post 602, fluid tube 54, and guide tube 56) are translated along axis A-A. The radially inward extending arm(s) 26*b* slide within the slots 54*a* of the fluid tube 54, and the kicker 26*c* penetrates the dislodgment aperture 606 of the yoke 600. The first oblique surface 26*d* engages the second oblique surface 602*c* so as to laterally displace the post 602 relative to the longitudinal axis A-A. In the absence of the post 602 supporting the closure assembly 30 with respect to the yoke 600, the face 37 separates from the sealing surface 38*b*. In particular, relative pivoting motion occurs at the interface between the first recess 30*c* and the first end 602*a* of the post 602 as the second end 602*b* of the post 602 slides across the second surface 600*b* of the yoke 600.

As the closure assembly 30 translates along axis A-A, and by virtue of the post 602 either remaining upright, i.e., parallel to the longitudinal axis A-A, and by virtue of the post 602 being laterally displaced by the kicker 26*c*, the face 37 is tipped so as be obliquely oriented with respect to the longitudinal axis A-A. Thus, closure assembly 30 is generally moved to one side of and along the longitudinal axis A-A so that the central axis X-X of the face 37 is skewed with respect to the longitudinal axis A-A and the expected flow rate is provided by the dry sprinkler.

Referring to the twenty-first preferred embodiment, as shown in FIGS. 21A-21I, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. As described generally above, the multi-legged yoke 51 includes a single member first yoke end 51*a* and a four-legged second yoke end 51*b*. The yoke 51 has two stamped metal members 52*a* and 52*b* joined via a plurality of tack welds. Each of the members has central portion and two projections at appropriate angles that diverge from the longitudinal axis A-A. The projections 53 of respective stamped metal members 52*a* and 52*b* are configured such that they form four sectors about the longitudinal axis, where a pair of diametrical sectors (A and C in FIG. 21D) of generally equal first arcuate distance is interposed by a pair of diametrical sectors (B and D in FIG. 21D) of generally equal second arcuate distance, and where the first arcuate distance is greater than the second. Provided between two legs 53 that preferably form a smaller arcuate sector than an adjacent arcuate sector is a flow obstructing member 40*a*. The flow obstructing member 40*a* can be formed integrally with one of the leg 53. Preferably, the flow obstructing member 40*a* is a separate member that is fixed to the two adjacent legs 53 by respective tack welds 41. In one preferred embodiment, the flow obstructing member can obstruct flow generally through approximately the flow area defined by the two legs and the inner surface 23*b* of the inlet fitting 23, as shown by member 40*a* in FIGS. 21D and 21E. Alternatively, in another preferred embodiment, the flow obstructing member can obstruct flow partially through approximately the flow area defined by the two legs and the inner surface 23*b* of the inlet fitting 23, as shown by member 40*b* in FIGS. 21H and 21I. The flow obstructing member 40*a* or 40*b* causes fire-extinguishing fluid F flowing through an actuated dry sprinkler 10 (FIG. 21 C) to be obstructed through the arcuate sector C (FIG. 21D) such that the fluid F is forced to divert to other arcuate sectors about the longitudinal axis A-A. The diversion of fluid flow F tends to cause the closure assembly 30 to be moved off its support on surface 51*a* of the yoke 51 as the dry sprinkler is being actuated.

The assembly of this embodiment can be performed in a similar manner as the third preferred embodiment.

In operation, as the dry sprinkler is actuated, the closure assembly 30 and inner assembly 501 (the yoke 51, fluid tube 54, and guide tube 56) are translated along axis A-A so as to separate the face 37 from the sealing surface 38*b*. Once the outer perimeter or a portion of the face 37 is no longer in contact with sealing surface 38*b*, the closure assembly 30 can pivot off the first support end 51*a* of the yoke 51. It is noted that under one circumstance, the closure member assembly 30 may be moved off its support on the support surface 51*a* of the yoke due to movement of the locator and water pressure to permit water to flow at approximately rated flow rate. However, under other circumstances, the closure assembly 30 may nutate (i.e., wobble about the longitudinal axis A-A) such that the closure assembly 30 presents a flow obstruction to the inlet thereby allowing only a partial flow through the outlet. Under the latter circumstance, the partial flow encounters another flow obstruction in the form of either member 40*a* or 40*b* that forces fluid F to flow around the obstruction. The redirecting of flow around the flow obstruction may cause the closure assembly 30 to be further unbalanced while it is rotating about the first support end 51*a*, thereby tending to move the closure assembly off the yoke 51 such that the face 37 is skewed with respect to the longitudinal axis A-A and the expected flow rate is achieved from the dry sprinkler. Because the central axis X-X of the face 37 is skewed relative to the longitudinal axis A-A, fluid can flow at approximately 95% of the expected flow rate through the passageway 20*a*.

Figures 22C, 22D, 22E:
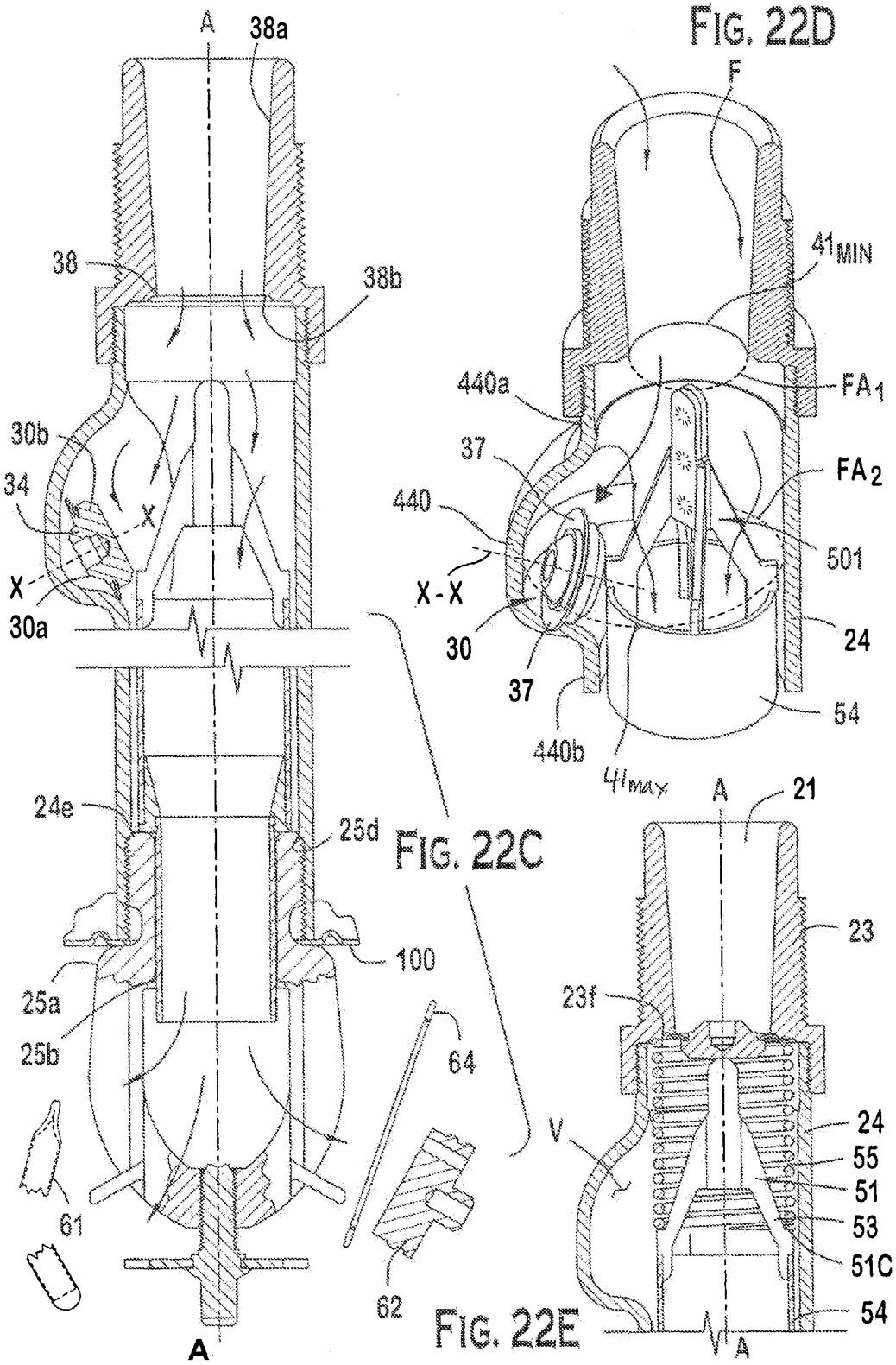

Referring to the twenty-second preferred embodiment, as shown in FIGS. 22A 22E, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the casing tube 24 has an outer casing tube surface 24*a* and an inner casing tube surface 24*b*, which surfaces cincture part of the passageway 20*a*. The casing tube 24 can be asymmetrically formed over a portion 440 located between the inlet 21 and the outlet 22. The casing tube 24 can also be formed such that the asymmetrical portion 440 can be formed between symmetrical portions 440*a* and 440*b*. The portion 440 of the casing tube 24 can be formed such that, when viewed from the inlet end on the longitudinal axis A-A, the portion 440 defines a chord 41*a* between transverse axis B-B, which has a larger magnitude than a chord 41*b* of the symmetrical portion 440*a* or 440*b* between transverse axis B-B. The casing tube 24 including the asymmetrical portion 440 can be formed by a suitable technique such as, for example, deep drawing or hydro-forming.

The inlet opening 23*e* extends about a plane generally transverse to and about the longitudinal axis A-A so as to define a first flow area FA1. The casing tube 24 can be formed so as to define a second flow area through asymmetrical portion 440 such as, for example, by providing the asymmetrical portion without a gradual increase in the flow area. The casing tube 24 can be formed so as to provide a plurality of flow areas along the longitudinal axis A-A. The plurality of flow areas allows for a gradual increase in flow area and a gradual decrease in flow area through the asymmetrical portion 440. As shown in FIG. 22D, the minimum flow area $\mathbf{41}_{MIN}$ through asymmetrical portion 440 is generally equal to a flow area of the symmetrical portion 440*a* of the casing tube 24 and the maximum flow area $\mathbf{41}_{MAX}$ through the asymmetrical portion 440 is generally much greater than the minimum flow area $\mathbf{41}_{MIN}$, and the maximum flow area is greater than the first flow area FA1.

The assembly of this embodiment can be performed in a similar manner as the third preferred embodiment.

In operation, when the dry sprinkler is actuated, the inner assembly 501 (the yoke 51, fluid tube 54, and guide tube 56) is translated along axis A-A so as to separate the face 37 from the inlet sealing surface 38*b*. Once the outer perimeter or a portion of the face 37 is no longer in contact with inlet sealing surface 38*b*, the closure assembly 30 can separate from the first support end 51*a* of the yoke 51. It is noted that under one circumstance, the closure member assembly 30 may be moved off its support on the support surface 51*a* of the yoke due to movement of the locator and water pressure to permit water to flow at approximately rated flow rate. However, under another circumstances, the closure assembly 30 may nutate (i.e., wobble about the longitudinal axis A-A) such that the closure member 30 presents a flow obstruction to the inlet thereby allowing only a partial flow through the outlet. Under the latter circumstance, the partial flow encounters a pressure differential due to the difference in flow area FA1 and flow area FA2 that forces fluid F to flow onto a side of the longitudinal axis A-A. The redirecting of flow around due to the pressure differential may cause the closure assembly 30 to be further unbalanced while it is nutating about the first support end 51*a* such that the central axis X-X of the face 37 is skewed with respect to the longitudinal axis A-A and the expected flow rate is achieved from the dry sprinkler, thereby tending to move the closure assembly off the yoke 51 into the volume V defined by the asymmetrical portion 440 of the casing tube 24, and allowing approximately expected flow rate through the passageway 20*a*.

Figure 23F:
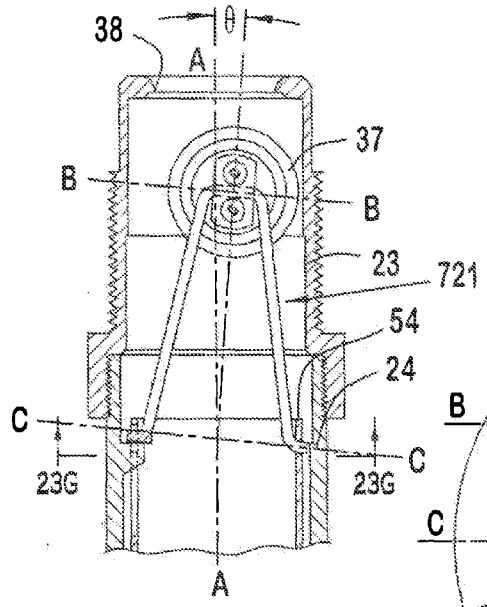
Figure 23G:
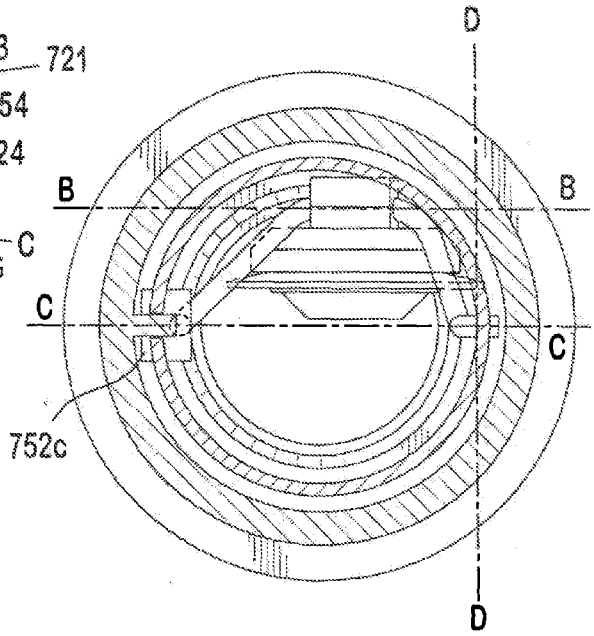
Figure 23H:
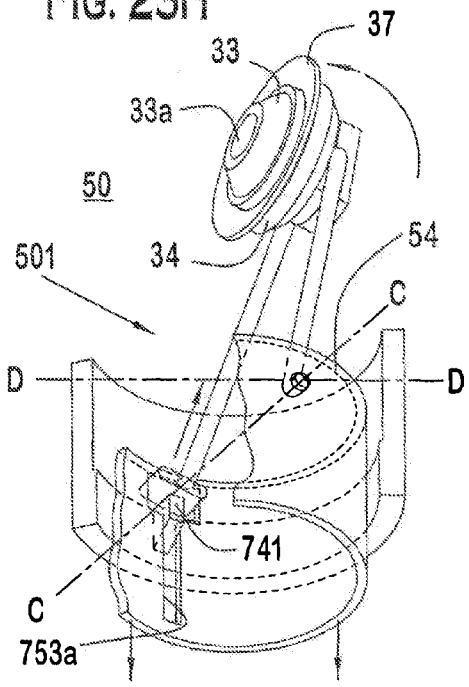

Referring to the twenty-third preferred embodiment, as shown in FIGS. 21A-21I, another arrangement of components for the locator 50 is provided for repositioning of the face 37 so that the central axis X-X of the face 37 is skewed to the longitudinal axis A-A in an actuated condition of the dry sprinkler 10 and the expected flow rate is provided from the dry sprinkler. In particular, the inner assembly 501 includes the yoke 721, a water tube 54, and a guide tube 56. In the non-actuated configuration, the yoke 721 is coupled to the guide tube 56, and the guide tube 56 is coupled to the water tube 54, and the water tube 54, is coupled to the trigger seat 62. The locator 50 may optionally include a biasing member that in a preferred embodiment includes an assist spring 55 (FIG. 23I) to assist movement of the locator from its unactuated position (FIG. 23A) to an actuated position (FIG. 23E).

The yoke 721 locates the closure assembly 30 with respect to the longitudinal axis A-A. The yoke 721 has a central journal 720 coupled to the closure assembly 30 by a bearing surface 35 of the closure assembly 30 via an end cap 35*a*, and a main journal 722 coupled to the inner assembly 501 via another bearing surface 724. The main journal 722 is rotatable in bearing surface 724 about an axis B-B orthogonal to the longitudinal axis A-A. The central journal 720 has a tubular configuration that is connected to two elongate members 721*a* and 721*b*. The first leg 721*a* is preferably connected to the main journal 722 as a unitary member. The main journal 722 is preferably coupled to the water tube 54 by the main bearing surface 724. The main journal 722 is also rotatable about an axis C-C generally parallel to axis B-B of the central journal 720. The main journal 722 is also rotatable about an axis D-D transverse to the axis C-C so that the leg 721*a* has two-degree of freedom about main bearing 724. The second leg 721*b* is preferably coupled to an impact pad 752*c*. The impact pad 752*c* can be mounted to an open-ended pocket 753 formed through the inner and outer surfaces of the water tube 54. The open ended pocket 753 can be provided with a groove 753*a* extending along the longitudinal axis A-A so that a projection 741 (formed as part of casing tube 24) can project through the groove 753*a* so as to guide the water tube 54 along the longitudinal axis A-A and to generally constrain the water tube 54 against angular (i.e., radial) movements about the longitudinal axis A-A.

The dry sprinkler 10 of this embodiment can be assembled as described above in relation to the eighteenth preferred embodiment of the dry sprinkler and further in the following manner with regard to the crank arm end and impact pad. The face 37 is connected to the member 721 via the closure assembly 30 with an end cap 35*a*. The main journal 722 is inserted into the main bearing 724 of the fluid tube 54. The impact pad 752*c* is placed into the pocket 753. The water tube 54 is coupled to the guide tube 56. These component form a locator subassembly that is preferably inserted into the inlet fitting 23.

The locator subassembly described above can be coupled to the casing tube 24. Casing tube 24 is preferably configured so that its inner diameter is generally greater than the outer diameter of the water tube 54. The water tube 54 is preferably inserted into the casing tube 24 such that a longitudinal axis of the water tube 54 is offset to the longitudinal axis of the casing tube 24 so that enough clearance is provided between the projection 741 and a solid portion of the water tube 54 before the projection 741 is fitted into the groove 753*a* as the water tube 54 is slid upward axially.

Figure 23I:
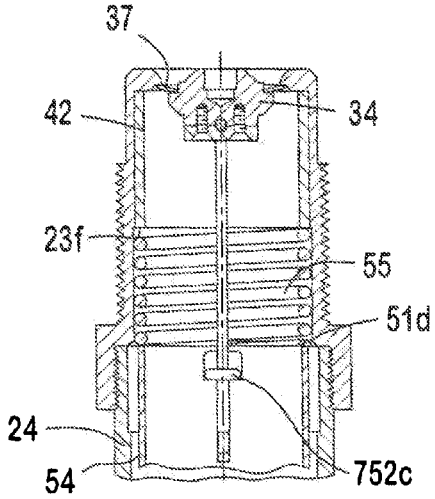

A suitable tool is inserted into opening 33*a* so as to maintain the resilient sealing member 37 in a generally transverse configuration as the locator subassembly is coupled or preferably threaded to the inlet fitting 23. The closure assembly 30 is oriented in the inlet 21 so that the resilient sealing member 37 contacts an inlet sealing surface 38*b* of the inlet 21. In another preferred embodiments, a sleeve 42 is inserted in the inlet fitting 23 and a biasing member in the form of a assist spring 55 is thereafter placed into the interior surface 23*b* of the inlet fitting 23, as shown in FIG. 23I.

As the casing tube 24 is preferably threaded to the inlet fitting 23, the axial movement of the casing tube 24 relative to the inlet fitting 23 partially compresses the resilient sealing member 37 (i.e. the metallic disc annulus in a preferred embodiment) against the inlet sealing surface 38*b* of the inlet fitting 23 so that the components described above form a partially assembled dry sprinkler. Thereafter, the member 721 and trigger assembly 60 can be mounted to the partially assembled dry sprinkler to provide a complete dry sprinkler as described earlier.

In operation, when the dry sprinkler is actuated, the inner assembly 501 (the yoke 721, water tube 54, and guide tube 56) is translated along axis A-A so as to separate the seal member 37 from the inlet sealing surface 38. As the locator 50 translates towards the second position, the projection 741 impacts against the impact pad 752*c* so as to provide an impulse force on the closure assembly 30. The impulse force tends to cause the yoke 721 to rotate on one of its legs 721*a* about the -axis C-C and axis D-D to provide roll about axis C-C and pitch about axis D-D to the leg 721*a*. That is to say, the impulse force caused by the projection 741 on impact shoe 752*c* tends to cause the leg 721*a* to rotate about its bearing on axis C-C for a roll and also to rotate about an axis D-D transverse to the axis C-C for a pitch (FIG. 23G), i.e., a compound motion involving roll and pitch of the leg 721*a*. This two-degree of freedom of movement tends to cause the closure assembly 30 to be unbalanced on its axis B-B, which could cause the closure assembly 30 to rotate or pivot about axis B-B. As the closure assembly 30 pivots about axis B-B, the closure assembly is pivoted over to a side of the longitudinal axis A-A so that the central axis X-X of the face 37 is skewed with respect to the longitudinal axis A-A and the expected flow rate is provided by the dry sprinkler.

As described above, the dry sprinkler of the preferred embodiments is believed to advantageous in that, due to the various arrangements of components within the dry sprinkler that position the central axis X-X of the face 37 (of a metallic disc annulus) skewed with respect to the longitudinal axis A-A, a minimum flow rate of 95% of the rated K-factor times the square root of the pressure of the flow of fluid fed into the inlet can be achieved. Preferably, each of the inlet fitting, means for repositioning the face 37 and bias member 55 can be made of a copper, bronze, galvanized carbon steel, carbon steel, or stainless steel material.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A dry sprinkler comprising:

a structure defining a passageway extending along a longitudinal axis between an inlet and an outlet, the structure having a rated K factor defining an expected flow of fluid in gallons per minute from the outlet divided by the square root of the pressure of the flow of fluid fed into the inlet of the passageway in pounds per square inch gauge;

a fluid deflecting structure proximate the outlet;

a metallic disc annulus having a face disposed about a central axis between an inner perimeter and an outer perimeter; and a locator movable along the longitudinal axis between a first position and a second position, wherein when in the first position, the outer perimeter of the metallic disc annulus contacts the structure so that the face prevents a flow of fluid through the passageway, the locator including means for repositioning the metallic disc annulus with the central axis of the face being skewed from the longitudinal axis within the passageway when the locator is in the second position so that a flow of fluid in gallons per minute from the outlet of the structure is at least 95 percent of the rated K factor multiplied by the square root of the pressure of the flow of fluid fed into the inlet of the structure in pounds per square inch gauge, wherein the locator includes a closure body and a tubular inner assembly disposed within the structure and movable in the passageway, the tubular inner assembly is movable along the longitudinal axis between a first position and a second position, the tubular inner assembly including a multi-legged yoke, a fluid tube, and a guide tube, the multi-legged yoke having a first yoke support end and a second yoke support end, the first yoke support end including a central elongate member, the second yoke support end including at least two support legs extending from the central elongate member; the fluid tube supporting the multi-legged yoke; and the guide tube being coupled to the fluid tube; and wherein at least one of the closure body and the multi-legged yoke includes the means for repositioning the metallic disc annulus.

2. A dry sprinkler comprising:

a tubular outer structure defining a passageway extending along a longitudinal axis between an inlet and an outlet, the tubular outer structure having a rated K-factor defining an expected flow of fluid in gallons per minute from the outlet divided by the square root of the pressure of the flow of fluid fed into the inlet of the passageway in pounds per square inch gauge;

a fluid deflecting structure proximate the outlet;

a locator movable along the longitudinal axis between a first position and a second position; the locator including a tubular inner assembly disposed within the tubular outer structure and movable in the passageway, the tubular inner assembly is movable along the longitudinal axis between a first position and a second position, the tubular inner assembly including a yoke, a fluid tube, and a guide tube, the yoke having a first yoke support end and a second yoke support end, the fluid tube supporting the yoke; and the guide tube coupled to the fluid tube;

a metallic disc annulus having a face disposed about a central axis between an inner perimeter and an outer perimeter, the outer perimeter contacting the structure so that the face occludes a flow of fluid through the passageway when the locator is proximate the first position, the metallic disc annulus being arranged with the central axis of the face being skewed from the longitudinal axis within the passageway when the locator is proximate the second position so that a flow of fluid in gallons per minute from the outlet of the structure is at least 95 percent of the rated K-factor multiplied by the square root of the pressure of the flow of fluid fed into the inlet of the structure in pounds per square inch gauge; and a resilient member that contacts at least one of the locator and the metallic disc annulus to translate the face of the metallic disc annulus to a side of the longitudinal axis when the locator moves from the first position toward the second position.

3. The dry sprinkler of claim 2, wherein the resilient member comprises a member selected from a group consisting of one of a torsion spring, helical coil spring, compression spring and tension spring.

4. The dry sprinkler of claim 2, wherein the resilient member comprises a torsion spring that moves the face of the annulus to a side of the longitudinal axis when the locator moves from the first position towards the second position.

5. The dry sprinkler of claim 2, wherein the locator further comprises a seat that supports the metallic disc annulus.

6. The dry sprinkler of claim 5, wherein the locator further comprises a closure body coupled to the yoke, the closure body having a top portion and a base portion, the top portion having at least one surface providing the seat for the metallic disc annulus, the yoke having a first wall portion and a second wall portion symmetric about a yoke axis, the first wall and the second wall portion being coupled to the surface of the base portion of the closure body.

7. The dry sprinkler of claim 2, wherein the pressure of the flow fed into the inlet comprises a plurality of start pressures between 0 and 175 psig.

8. The dry sprinkler of claim 7, wherein the plurality of start pressures comprises one of 20 psig and 100 psig.

9. The dry sprinkler of claim 7, wherein the K-factor comprises a K-factor of at least one of about 5.6, 8.0, 11.2, 14.0 and 16.8.

10. A dry sprinkler comprising:

a structure defining a passageway extending along a longitudinal axis between an inlet and an outlet, the structure having a rated K-factor defining an expected flow of fluid in gallons per minute from the outlet divided by the square root of the pressure of the flow of fluid fed into the inlet of the passageway in pounds per square inch gauge;

a fluid deflecting structure proximate the outlet;

a metallic disc annulus supported by a closure body, the metallic disc annulus having a face disposed about a central axis between an inner perimeter and an outer perimeter;

resilient means for repositioning the central axis of the face skewed to the longitudinal axis within the passageway so that a flow of fluid in gallons per minute from the outlet of the structure is at least 95 percent of the rated K-factor multiplied by the square root of the pressure of the flow of fluid fed into the inlet of the structure in pounds per square inch gauge; and a yoke that supports the resilient means, the yoke including an elongate member, the elongate member having a central portion disposed along the longitudinal axis to define at least one longitudinal side between a first end of the central portion and a second end of the central portion, the central portion having a first end portion and a second end portion, the first end portion supporting the closure body, and the second end portion supporting at least two support legs extending from the at least one longitudinal side along the second end portion.

11. A dry sprinkler comprising:

a tubular outer structure defining a passageway and extending along a longitudinal axis between an inlet and an outlet, the passageway having a K-factor 8.0 or greater, the K-factor being determined by the flow of fluid in gallons per minute through the outlet divided by the square root of the pressure of fluid fed into the inlet of the passageway in pounds per square inch gauge;

a tubular inner assembly disposed within the tubular outer structure and movable in the passageway, the tubular inner assembly is movable along the longitudinal axis between a first position and a second position, the tubular inner assembly including a multi-legged yoke, a fluid tube, and a guide tube, the multi-legged yoke having a first yoke support end and a second yoke support end, the first yoke support end including at least one elongate member, the second yoke support end including at least two support legs extending from the at least one elongate member, the fluid tube supporting the multi-legged yoke; and the guide tube coupled to the fluid tube; and a closure assembly supported within the passageway via the at least one elongate member of the first yoke support end, the closure assembly including a surface occluding a flow of fluid into the passageway when the inner tubular assembly is proximate the first position;

a resilient member that biases the closure assembly to translate the surface to a side of the longitudinal axis when the tubular inner assembly moves from the first position toward the second position; and a fluid deflecting structure proximate the outlet of the tubular outer structure.

12. The dry sprinkler of claim 11, wherein the closure assembly includes a conical portion extending between a first end and a second end along the longitudinal axis, the second end having an eyelet coupled to the elongate member of the yoke via a pin disposed generally orthogonal to the longitudinal axis.

13. A dry sprinkler comprising:

an outer tubular structure defining a passageway and extending along a longitudinal axis between an inlet and an outlet, the passageway having a rated K-factor, a metallic disc annulus proximate the inlet, the metallic disc annulus having a face disposed about the longitudinal axis;

a closure body in a first position along the longitudinal axis supporting the metallic disc annulus to occlude a flow of fluid into the passageway;

a yoke supporting the closure body, the yoke including an elongate member, the elongate member having a central portion disposed along the longitudinal axis to define at least one longitudinal side between a first end of the central portion and a second end of the central portion, the central portion having a first end portion and a second end portion, the first end portion supporting the closure body, and the second end portion supporting at least two support legs extending from the at least one longitudinal side along the second end portion;

a fluid tube supporting the yoke; and a guide tube supporting the fluid tube;

a trigger assembly supporting the guide tube, upon actuation of the trigger assembly, the closure body moves from the first position toward a second position, the second position being located along the longitudinal axis spaced from the first position so that a flow of fluid in gallons per minute from the outlet of the structure is at least 95 percent of the rated K-factor multiplied by the square root of the pressure of the flow of fluid fed into the inlet of the structure in pounds per square inch gauge; and a fluid deflecting structure proximate the outlet of the outer tubular structure.

14. The dry sprinkler of claim 13, wherein the closure body includes a conical portion extending between a first end and a second end along the longitudinal axis, the second end having an eyelet coupled to the elongate member of the yoke via a pin disposed generally orthogonal to the longitudinal axis.

15. A dry sprinkler comprising:

an outer tubular structure defining a passageway and extending along a longitudinal axis between an inlet and an outlet, the passageway having a rated K-factor, a metallic disc annulus proximate the inlet, the metallic disc annulus having a face disposed about the longitudinal axis;

a closure body in a first position along the longitudinal axis supporting the metallic disc annulus to occlude a flow of fluid into the passageway;

a multi-legged yoke supporting the closure body, the multi-legged yoke having a first yoke support end and a second yoke support end, the first yoke support end including at least one elongate member, the second yoke support end including at least two support legs extending from the at least one elongate member;

a fluid tube supporting the multi-legged yoke; and a guide tube supporting the fluid tube;

a trigger assembly supporting the guide tube, upon actuation of the trigger assembly, the closure body moves from the first position toward a second position, the second position being located along the longitudinal axis spaced from the first position so that a flow of fluid in gallons per minute from the outlet of the structure is at least 95 percent of the rated K-factor multiplied by the square root of the pressure of the flow of fluid fed into the inlet of the structure in pounds per square inch gauge; and a fluid deflecting structure proximate the outlet of the outer tubular structure, wherein a resilient member contacts the closure body and the multi-legged yoke.

16. The dry sprinkler of claim 13, wherein the closure body includes a top portion between the metallic disc annulus and the inlet of the outer tubular structure, when in the first the position, and when in the second position, top portion is to the side of the longitudinal axis.

17. The dry sprinkler of claim 13, wherein each of the at least two support legs being disposed substantially in a plane parallel to the longitudinal axis.

18. The dry sprinkler of claim 13, further comprising a resilient member selected from the group consisting of a torsion spring, helical coil spring, or tension spring.

19. The dry sprinkler of claim 13, further comprising a contact member extending from an inner surface of the structure, the contact member located in the passageway, the contact member contacting at least one of the closure body and metallic disc annulus to translate the face of the annulus to the side of the longitudinal axis when the closure body moves from the first position towards the second position so as to permit a flow of fluid through the passageway between the inlet and the outlet.

20. The dry sprinkler of claim 19, wherein the contact member comprises a projection with a free end.

21. The dry sprinkler of claim 13, further comprising a contact member disposed within the passageway and connecting to an inner surface of the structure at a plurality of points of the inner surface, the contact member contacting at least one of the closure body and metallic disc annulus to translate the face of the annulus to the side of the longitudinal axis.

22. The dry sprinkler of claim 13, wherein the dry sprinkler further comprising a tubular member disposed about the longitudinal axis, the tubular member having an inner surface and an outer surface surrounding the inner surface, the tubular member including a pair of bearings disposed between spaced points on the tubular member, each bearing having a bearing surface extending along the longitudinal axis between the inner and outer surfaces, and wherein the closure body further comprises a member extending through a portion of the closure body proximate the inlet, the member moving along the longitudinal axis on the bearing surface of the structure to translate the face of the annulus to a side of the longitudinal axis when the closure body moves from the first position towards the second position.

23. The dry sprinkler of claim 13, wherein the structure further comprises a groove formed in an inner surface of the passageway about the longitudinal axis proximate the inlet, and wherein the closure body further comprises a resilient arcuate member that connects to the groove to form a pivot so that the face is movable about the longitudinal axis to permit a flow of fluid through the passageway between the inlet and the outlet when the closure body moves from the first position towards the second position.

24. The dry sprinkler of claim 13, wherein the elongate member has an edge proximate the inlet, the edge supporting the body on a line contact offset to the longitudinal axis such that the face translates to a position on a side of the longitudinal axis when the closure body moves between the first and second position.

25. The dry sprinkler of claim 13, further comprising a contact member extending from an inner surface of the structure towards the longitudinal axis in the passageway, the contact member disposed within the passageway, and contacting the metallic disc annulus to separate the metallic disc annulus from the closure body such that the closure body falls in the passageway proximate the outlet when the closure body moves from the first position towards the second position.

26. The dry sprinkler of claim 13, wherein the closure body having a first surface provided with a first radius of curvature facing the outlet, the elongate member having a second surface provided with a second radius of curvature facing the inlet and supporting the first surface so that the first surface rotates on the second surface when the closure body moves towards the second position.

27. The dry sprinkler of claim 13, wherein the inlet comprises a sealing surface disposed about the longitudinal axis proximate the inlet, and wherein the closure body comprises a top portion extending toward the inlet past the sealing surface in the first position of the closure body, the center of the mass being moved by fluid flowing through the inlet so that the face is moved to a side of the longitudinal axis when the closure body moves from the first position towards the second position.

28. The dry sprinkler of claim 13, wherein the inlet comprises a sealing surface disposed about the longitudinal axis proximate the inlet, and wherein the closure body comprises a top portion having a chamber extending toward the inlet past the sealing surface in the first position of the closure body, the chamber being filled with fluid flowing through the inlet so that the face is moved to a side of the longitudinal axis when the closure body moves from the first position towards the second position.

29. The dry sprinkler of claim 13, further comprising a compression spring extending between a portion of the yoke and the closure body, the compression spring moving the face of the annulus to a side of the longitudinal axis when the closure body moves from the first position towards the second position.

30. The dry sprinkler of claim 13, further comprising a tension spring extending between a portion of the yoke and the closure body to move the face of the annulus to a side of the longitudinal axis when the closure body moves from the first position towards the second position.

31. The dry sprinkler of claim 13, wherein the structure comprises a compression spring disposed in the passageway proximate the inlet, the closure body having a pivot with a strap connected to the pivot and coil of the compression spring, the strap being movable between a first strap position where the strap is spaced from the elongate member and a second strap position to move the face of the annulus to a first side of the longitudinal axis when the closure body moves from the first position towards the second position.

32. The dry sprinkler of claim 13, wherein the yoke comprises a projection extending away from the longitudinal axis in the passageway so that the projection obstructs a flow of fluid on one side of the longitudinal axis in the passageway so that the face of the annulus is moveable to a side of the longitudinal axis via fluid flowing around the projection when the yoke is in the second position.

33. The dry sprinkler of claim 13, wherein the passageway comprises a first fluid flow area symmetrical about the longitudinal axis proximate the inlet and a second fluid flow area asymmetrical about the longitudinal axis spaced between the first fluid flow area and the outlet, the second fluid flow area being greater than the first fluid flow area such that when a pressure differential between the first fluid flow area and the second fluid flow area is provided, the metallic disc annulus is proximate the asymmetrical flow area.

* * * * *